US006712238B1

(12) United States Patent
Mills

(10) Patent No.: US 6,712,238 B1
(45) Date of Patent: Mar. 30, 2004

(54) DRYWALL TAPING AND TEXTURE SYSTEM USING BLADDER PUMP WITH PNEUMATIC FLIP/FLOP LOGIC REMOTE CONTROL

(75) Inventor: Gregory B. Mills, Seneca, MO (US)

(73) Assignee: Spraytex, Inc., Valencia, CA (US)

( * ) Notice: Subject to any disclaimer, the term of this patent is extended or adjusted under 35 U.S.C. 154(b) by 0 days.

(21) Appl. No.: 10/267,291

(22) Filed: Oct. 8, 2002

(51) Int. Cl.[7] ..... B67D 5/08
(52) U.S. Cl. ..... 222/61; 222/399; 417/900
(58) Field of Search ..... 222/61, 258, 261, 222/262, 263, 373, 389, 399, 394; 417/90, 93, 118, 120, 143, 900; 141/25, 26, 27, 181; 118/207

(56) References Cited

U.S. PATENT DOCUMENTS

| | | | | |
|---|---|---|---|---|
| 2,413,684 A | | 1/1947 | Ames | |
| 2,509,570 A | | 5/1950 | Lee | |
| 2,741,220 A | | 4/1956 | Belisle | |
| 2,956,839 A | | 10/1960 | Hermanns | |
| 3,057,517 A | | 10/1962 | Douglas | |
| 3,174,658 A | | 3/1965 | Wittenberg et al. | |
| 3,342,377 A | | 9/1967 | Peredy | |
| 3,343,202 A | | 9/1967 | Ames | |
| 3,344,770 A | | 10/1967 | Schaefer | |
| 3,659,675 A | | 5/1972 | Edelstein et al. | |
| 3,669,070 A | | 6/1972 | Wallace | |
| 3,704,962 A | | 12/1972 | Weeks | |
| 3,707,427 A | | 12/1972 | Erickson | |
| 3,951,572 A | | 4/1976 | Ray, Jr. et al. | |
| 4,105,490 A | | 8/1978 | Lass | |
| 4,109,831 A | | 8/1978 | Culpepper et al. | |
| 4,111,613 A | | 9/1978 | Sperry | |
| 4,196,028 A | | 4/1980 | Mills et al. | |
| 4,202,288 A | | 5/1980 | Davy, Jr. | |
| 4,373,867 A | * | 2/1983 | Campbell | 417/90 |
| 4,689,107 A | | 8/1987 | Entwistle | |
| 4,701,107 A | * | 10/1987 | Dickinson et al. | 417/86 |
| 4,828,180 A | | 5/1989 | Kristensen | |
| 4,996,941 A | | 3/1991 | Mills | |
| 5,060,826 A | | 10/1991 | Coleman | |
| 5,137,752 A | | 8/1992 | Mills | |
| 5,252,041 A | | 10/1993 | Schumack | |
| 5,497,812 A | | 3/1996 | Orosco et al. | |
| 5,535,926 A | | 7/1996 | Blitz et al. | |
| 5,570,953 A | | 11/1996 | DeWall | |
| 5,711,462 A | | 1/1998 | Hard | |
| 5,878,925 A | | 3/1999 | Denkins et al. | |
| 5,897,295 A | | 4/1999 | Rogers et al. | |
| 5,924,598 A | | 7/1999 | Bradshaw | |
| 5,964,580 A | | 10/1999 | Taga | |
| 6,116,769 A | | 9/2000 | DeWall | |
| 6,161,954 A | | 12/2000 | DeWall | |
| 6,299,686 B1 | | 10/2001 | Mills | |
| 6,367,534 B1 | | 4/2002 | McGlenn | |
| 6,378,738 B1 | | 4/2002 | Speaker et al. | |
| 6,428,287 B1 | | 8/2002 | Denkins et al. | |

* cited by examiner

*Primary Examiner*—Gene Mancene
*Assistant Examiner*—Frederick Nicolas
(74) *Attorney, Agent, or Firm*—Pillsbury Winthrop LLP

(57) ABSTRACT

A drywall tape and texture system for pumping fluid material from a container to a work surface includes a pump housing, a compressed air supply, a plurality of air release mechanisms, and an inflatable bladder mounted within the pump housing and held between upper and lower valves for controlling the flow of the material. The pump housing may be fully or partially immersed into a container filled with fluid material. An automatic pneumatic pressure relief valve automatically cycles open and closed whenever a control line is held closed by an operator. When the normally closed automatic air release mechanism is closed, the control line may also be closed by the operator, causing the bladder to inflate and pump fluid out of the pump housing. When the control line to the atmosphere is opened, the bladder deflates and a partial vacuum is created, thus refilling the pump through the lower valve.

26 Claims, 46 Drawing Sheets

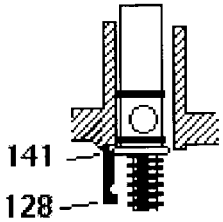
Fig. 34a
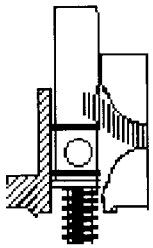
Fig. 34c
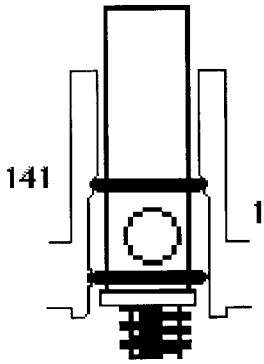
Fig. 34e
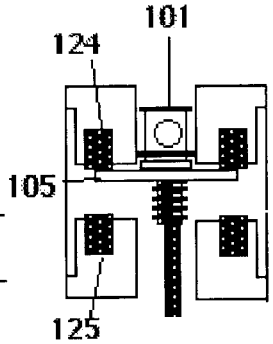
Fig. 34g
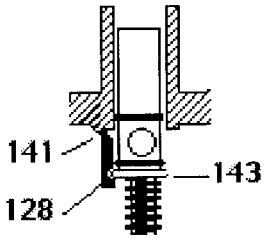
Fig. 34b
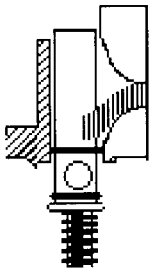
Fig. 34d
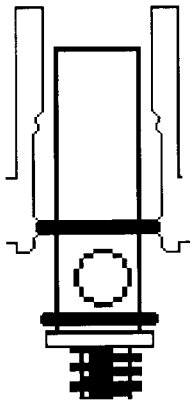
Fig. 34f
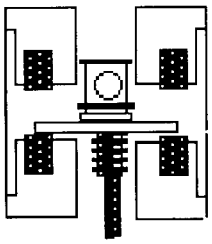
Fig. 34h
Fig. 34

DRYWALL TAPING AND TEXTURE SYSTEM USING BLADDER PUMP WITH PNEUMATIC FLIP/FLOP LOGIC REMOTE CONTROL

RELATED APPLICATION

This application is related to U.S. patent application Ser. No. 09/113,002, filed Jul. 9, 1998, now U.S. Pat. No. 6,299,686.

FIELD OF THE INVENTION

This invention relates to drywall taping and texture systems, and, in particular embodiments, to a drywall taping and texture system using an automatic pneumatic bladder pump with a flip/flop logic mechanism, that may be controlled remotely by an operator.

BACKGROUND OF THE INVENTION

Traditionally, in gypsum wallboard or "drywall" panel installation, sheets of drywall are nailed or screwed in place. Seams between the drywall sheets must be taped over, and the nail or screw heads must be coated with paper tape and mastic material to form a continuous wall surface. Tape and mastic material must also be applied to inside corners to form a complete wall system. The task of applying drywall tape and mastic drywall mud is generally laborious, tedious, and messy. Although inventions have made the task easier, improvement is still needed. One currently available drywall taping tool is the pedestrian mud pan and drywall knife.

With a mud pan and drywall knife, a workman manually applies drywall tape and mud. First, the workman removes a scoop of mud from a bulk container in a mud supply area and places it in the mud pan. This action is repeated until the pan is full. The workman then walks from the mud supply area to the seam that he wishes to tape. The workman then scoops a quantity of mud onto the knife, turns the knife blade towards the wall, and with a series of wiping motions, coats the seam with mud more or less uniformly. After precutting the tape, the workman lays paper tape over the seam and presses it into the mud to achieve tape attachment. He then glides the knife over the tape, forcing mud and air out from behind the tape, and begins to smooth the surface. A first coat of mud is applied to the drywall tape either at the time that the tape is applied or later, depending on the workman's technique.

After a period of drying, another coat of mud is applied to the tape and dressed with a drywall knife, thus covering the seam with a wider coat of mud. The same steps of walking to the mud supply area, scooping out mud until the pan is full, and then walking back to the work area are repeated.

After a second period of drying, most inexperienced workmen sand the seams before applying a final coat of mud. The final coat of mud requires further walking between the mud supply and the work areas and further scooping and filling of the mud pan as before.

Complicating the situation are inside corner seams. Most occasional drywall workmen find inside corner seams the hardest and most time consuming to tape and coat of any seam. There are special knives that have a ninety degree bend to help dress these difficult seams.

To overcome the drawbacks of pedestrian drywall tape application and finishing tools such as the mud pan and drywall knife, a professional "automatic" drywall taping system has been developed by Ames Tool Company (Ames), for example, that includes a manual, lever action, fluid mud pump that fills assorted mud applicator tools from a 5 gallon bucket filled with slightly thinned drywall mud. A hand lever on the manual pump is pumped up and down to transfer drywall mud out of the bucket directly into a mud applicator tool. The mud is squirted into a slot in some tools and into other tools through a special fitting.

However, this system still requires walking between the mud supply station and the current work areas, thus wasting time and energy. Only about ninety feet of tape can be applied with the Ames taper tool before a mud refilling is required, while each roll of paper tape is about 500 feet. Only about three to four vertical seams, where each seam is about eight feet long, can be filled with the Ames box tools before more mud is required. Thus, a day's work may require hundreds of trips for mud refills between the mud supply and work areas with the Ames drywall taping system.

Additionally, each of the tools in the Ames system takes some toll upon the user's energy. The Ames taper tool is powered by the user forcing a wheel to turn as it contacts the wall at the end of the tool. The Ames box tool requires the operator to forcefully wipe a heavy box of mud held out on an extended handle. Each of the Ames tools mechanically disgorges drywall mud as the result of strenuous human labor. Many tasks in drywall taping with Ames type systems are thus prone to cause repetitive stress injury.

Furthermore, Ames tools require both a reservoir that holds one shot of mud and a mechanical device to manually exude the shot of mud out of the tool and onto a drywall surface. The Ames system is expensive, heavy, and manually actuated. Ames-type tools are now manufactured by several companies using similar designs that are based upon many complicated and varied machined metal parts and are thus expensive to manufacture. Those tool designs do not lend themselves to mass production of most of the parts (e.g., in plastic) for the "do it yourself" market. There is also a learning curve with Ames-type tools due to the skill required to properly operate them. In addition, there is extensive tool cleaning required after each use to ensure proper operation, and tool failures are common in the Ames system due to dried mud and mechanical failures.

The stator tube pump is well known to the drywall industry, particularly with commercial drywall texture sprayers. This type of pump has a hollow threaded internal rubber sleeve encompassing a softly threaded extended rod. As the rod is turned, fluid drywall material is forced to exit the pump under pressure into a material hose. However, the stator pump requires an electric motor or gas engine to operate. As such, it is expensive to build and costly to buy and operate. The stator pump is also very inefficient due to tremendous friction, so a large power source is required. Therefore, fluid material delivery systems using a stator pump for drywall work are an expensive way to go, with a market limited to professionals.

A second approach to spraying drywall textures is a hopper device with a gun and compressed air, which atomizes the material. This device is less expensive than pump units. However, it must be held overhead in the case of ceiling texturing, thus making its use very messy and tiring due to the stress of holding a heavy hopper full of texture overhead for extended periods. Presently, a gun on a hose is by far the preferred tool for texture application; however, such a device is currently too expensive for "do-it-yourself", non-professional users.

An ideal system would be one in which the automatic tape functions of the Ames System are combined with the preferred spray functions of a material pump with a gun on a hose in such a way as to provide for an inexpensive solution for "do it your self" users. In such a system, the disadvantage in existing systems of carrying drywall mud back and forth will be reduced since the material is delivered by hose directly to the wall.

Examples of such a drywall taping and texture system are described in U.S. Pat. No. 6,299,686. In various embodiments discussed therein, the system includes various interchangeable tools that connect to a pump. A pump residing in a housing forces fluid drywall material through a material line. A control line hose also runs from the pump to the various tools.

The tools may include a button or trigger, allowing the user to remotely control the function of the pump by covering or uncovering an air release hole on the tool that is inter-connected to the control line to the pump. The control line outlet to the atmosphere is "normally open" at the distal, tool end. To close the control line, a plug is inserted into the air release hole to the atmosphere. Thus, opening the control line to the atmosphere releases air and resets the pump, whereas closing the control line starts the pumping action.

Additional air release mechanisms may be also be included in the pump housing itself, such as a pneumatic automatic flip flop logic switching system. This function may be performed in several ways. For example, in various embodiments of the invention of U.S. Pat. No. 6,299,686, this may be achieved electronically, with sensors and an electrical solenoid pneumatic valve, and/or mechanically, with a two-stage pressure relief valve. Both of these approaches provide for a less-expensive way of building and operating a bladder pump control than is available in previous mud pumping systems. In addition, in both cases, the device may be remotely controlled by an operator and run on a small, inexpensive air compressor of ¼ horsepower. Still, improvements may be made in the bladder pump and pneumatic system.

Other features and advantages of the invention will become apparent from the following detailed description, taken in conjunction with the accompanying drawings, which illustrate, by way of example, various features of embodiments of the invention.

BRIEF DESCRIPTION OF THE DRAWINGS

A detailed description of embodiments of the invention will be made with reference to the accompanying drawings, wherein like numerals designate corresponding parts in the several figures.

FIG. 4*a* shows the pump during intake of drywall material, and FIG. 4*b* shows the pump during exhaust of drywall material.

FIG. 6*a* is a cross-sectional view of a seat in accordance with an embodiment of the present invention. FIG. 6*b* is a perspective view of the seat, and FIG. 6*c* is a top plan view of the seat. FIG. 6*d* is a cross-sectional view of a ball in accordance with an embodiment of the present invention.

FIG. 8*a* depicts the air release mechanism in the open position, and FIG. 8*b* depicts the air release mechanism in the closed position.

FIG. 9*a* is a partial cross-sectional view of the interior of the pump. FIG. 9*b* is an exploded perspective view of a solenoid module for controlling the electrical version of the pump. FIG. 9*c* is an exploded, partial cross-sectional view of an inflation sensor for electronically sensing the condition of the bladder.

FIGS. 11*a* and 11*b* are partial cross-sectional views of the pneumatic tape cutter. FIG. 11*c* is a cross-sectional view of the pneumatic tape cutter.

FIG. 12*a* is a perspective view of the wand tool, and FIG. 12*b* is a partial cross-sectional view of the wand tool.

FIG. 18*a* shows perspective and top plan views of an Ames adapter button. FIG. 18*b* is a perspective view of an Ames adapter gooseneck. FIG. 18*c* shows perspective and top plan views of an Ames adapter box filler.

FIGS. 19*a* and 19*b* are cross-sectional views of the universal tool fitting part, FIG. 19*c* is a perspective view of the universal tool fitting part, and FIGS. 19*d* and 19*e* are cross-sectional views of components of the universal tool fitting part.

FIGS. 21*a* and 21*b* are cross-sectional views of a wheel taken through the point at which air holes are located, depicting the wheel with a wheel air hole surrounding a hollow axle with an axle air hole. FIGS. 21*c* and 21*d* are cross-sectional views depicting the same wheel taken through the point at which material dispensing holes are located, depicting the wheel with multiple material dispensing holes around the same hollow axle with a material hole. FIG. 21*e* is a cross-sectional view of the same wheel, the cross-section taken at a plane perpendicular to those in FIGS. 21*a*–21*d*, depicting a wheel with a wheel air hole and multiple dispensing holes around a hollow axle with an axle air hole and an axle material hole.

FIG. 22*a* is a perspective view of a pressure release valve situated on a housing. FIG. 22*b* is a perspective view of a pressure release valve in the closed position.

FIG. 24*a* shows the pump during exhaust of drywall material, and FIG. 24*b* shows the pump during intake of drywall material.

FIG. 34 is a chart showing 4 described methods of creating an active valve core which flips abruptly to open or close. FIG. 34*a* shows a closed valve with clip, FIG. 34*b* show a closed valve with clip, FIG. 34*c* shows a valve with a changing vector spring in the closed position, FIG. 34*d* is closed, FIG. 34*e* is a cylinder with grooves that catch on the o-rings of the valve core, FIG. 34*f* is closed, FIG. 34*g* is a magnetically closed valve core, and FIG. 34*h* is the magnetic valve core in the open position.

DETAILED DESCRIPTION OF THE PREFERRED EMBODIMENTS

Figure 1:
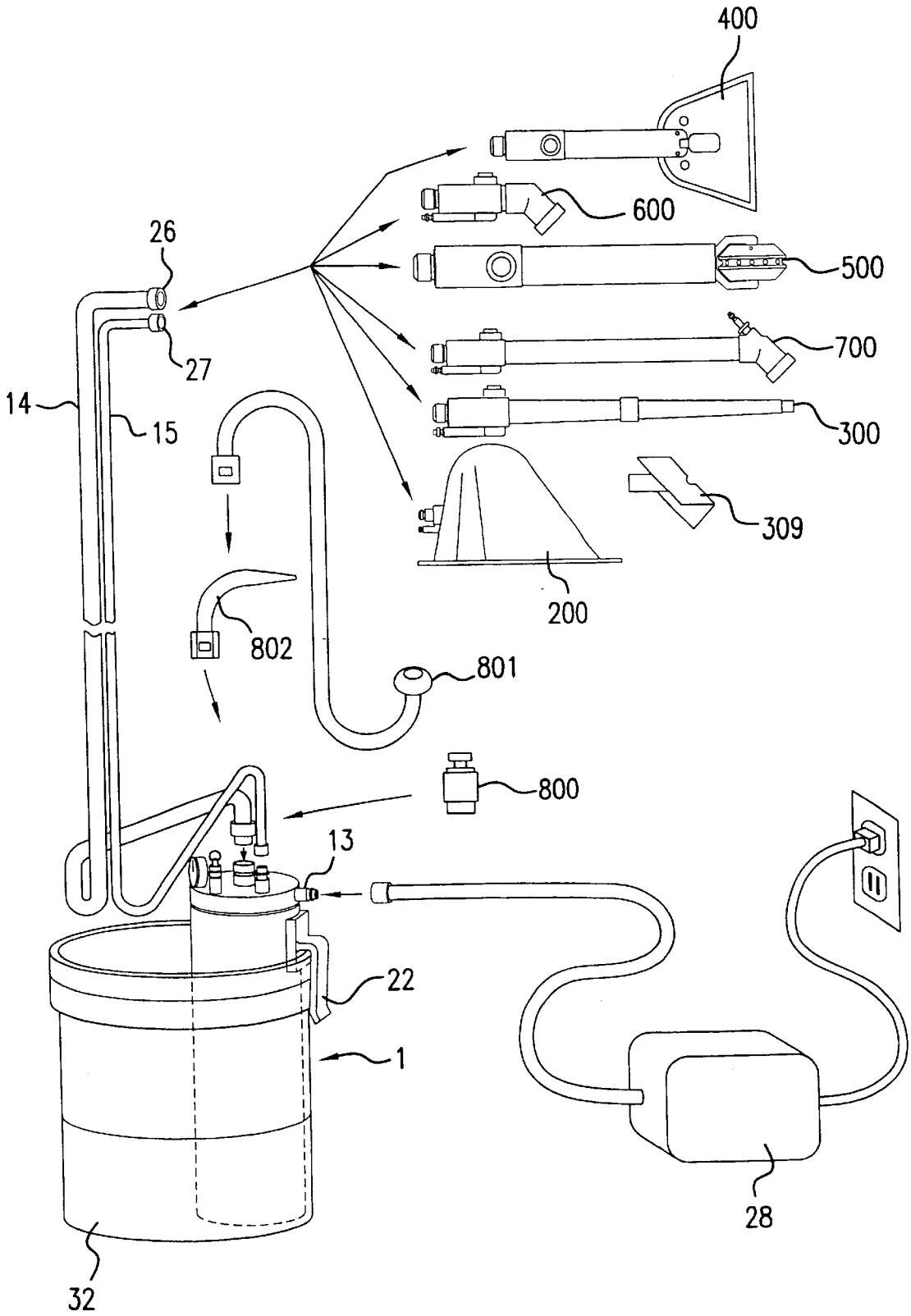
FIG. 1 is a perspective view of a drywall taping and texture system using a pump in accordance with an embodiment of the present invention.

As shown in the drawings for purposes of illustration, the invention is embodied in a drywall taping and texture system and a pump. In preferred embodiments of the present invention, the drywall taping and texture system utilizes the pump and various tools connected to the pump for applying drywall tape, as well as mastic or fluid drywall mud and texture, to wall surfaces. However, it will be recognized that the disclosed bladder pump may be used in other systems and with other fluids, such as water, oil, gas, or the like.

Figure 2:
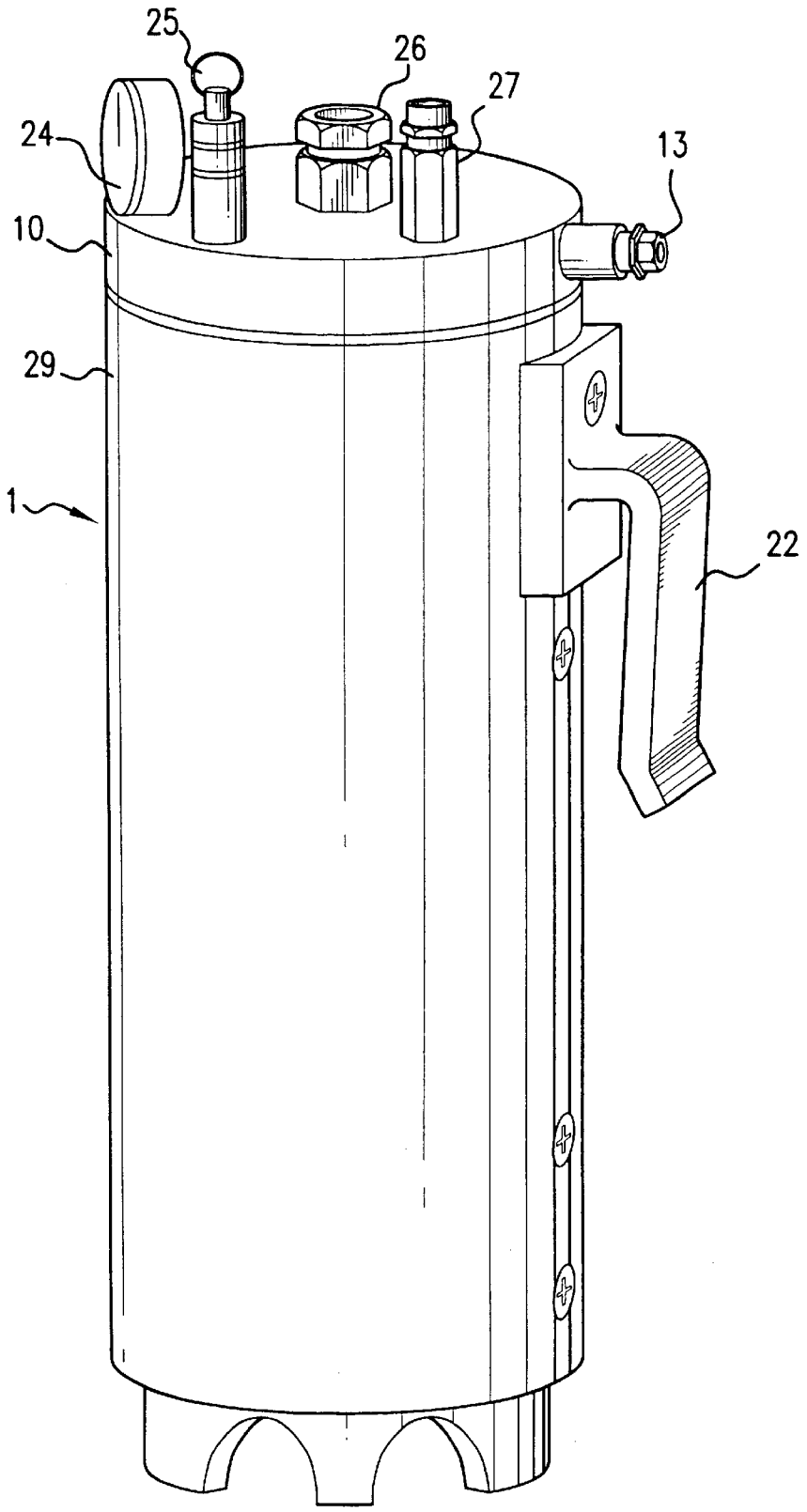
FIG. 2 is a perspective view of the exterior of the pump shown in FIG. 1.
Figure 18A:
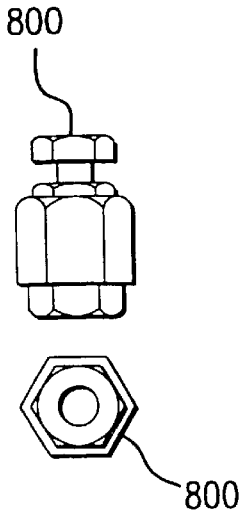
FIGS. 18*a*–18*c* are views of adapter parts that allow use of the pump with Ames Tool Company's tools in accordance with an embodiment of the present invention.
Figure 18B:
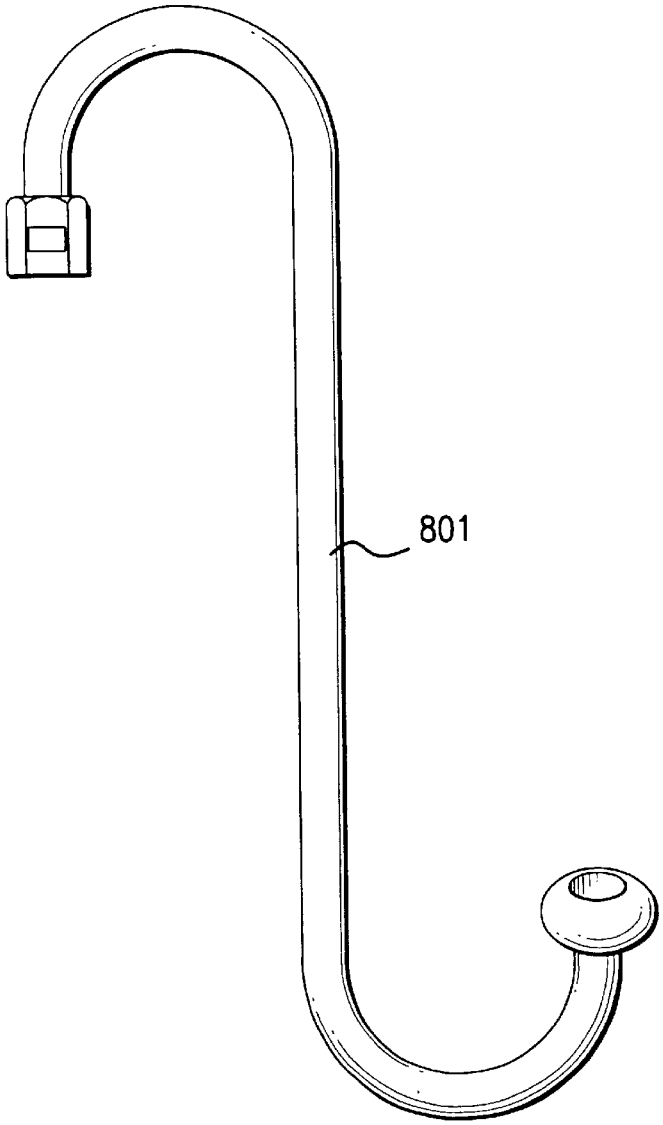
Figure 18C:
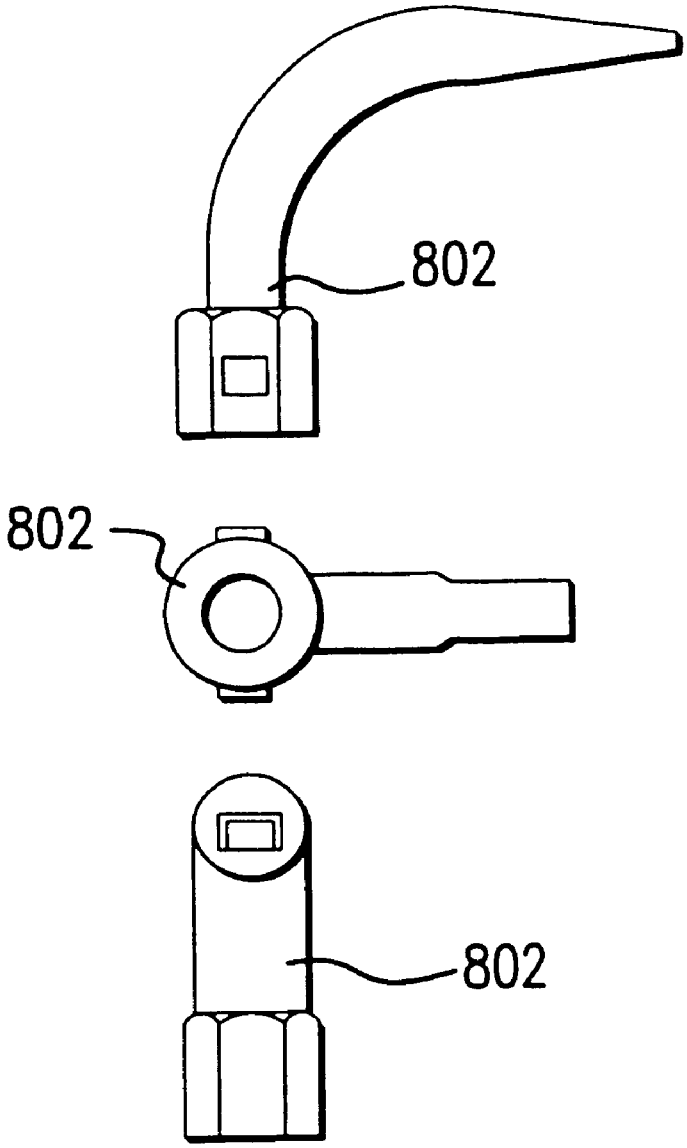
Figure 19A:
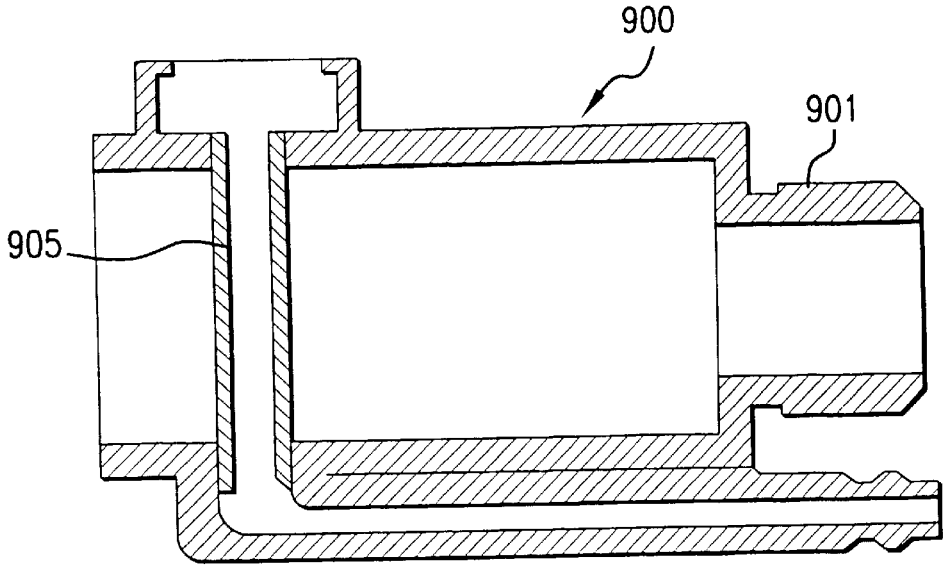
FIGS. 19*a*–19*e* are views of an universal tool fitting part in accordance with an embodiment of the present invention.
Figure 19B:
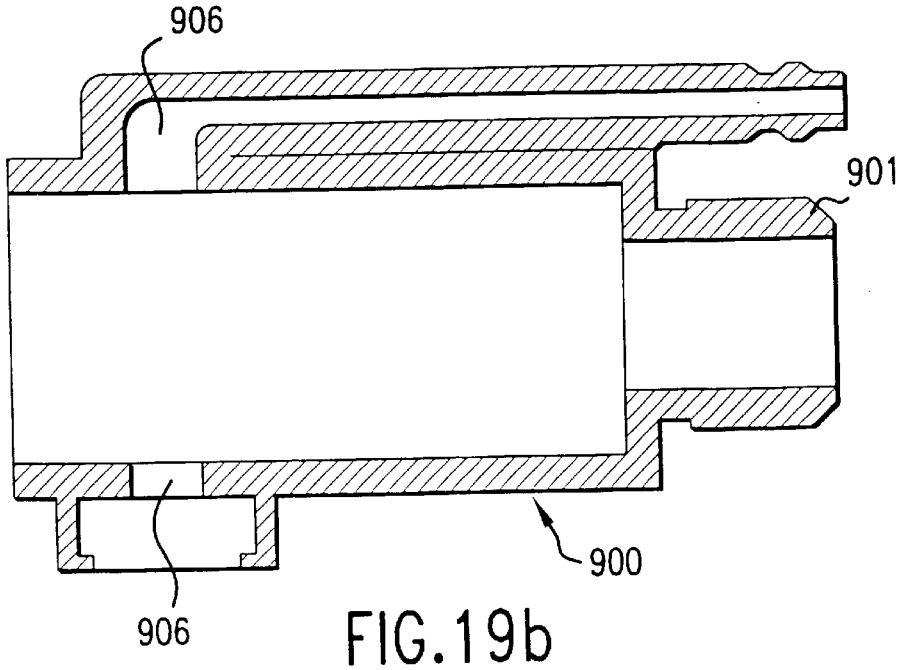
Figure 19C:
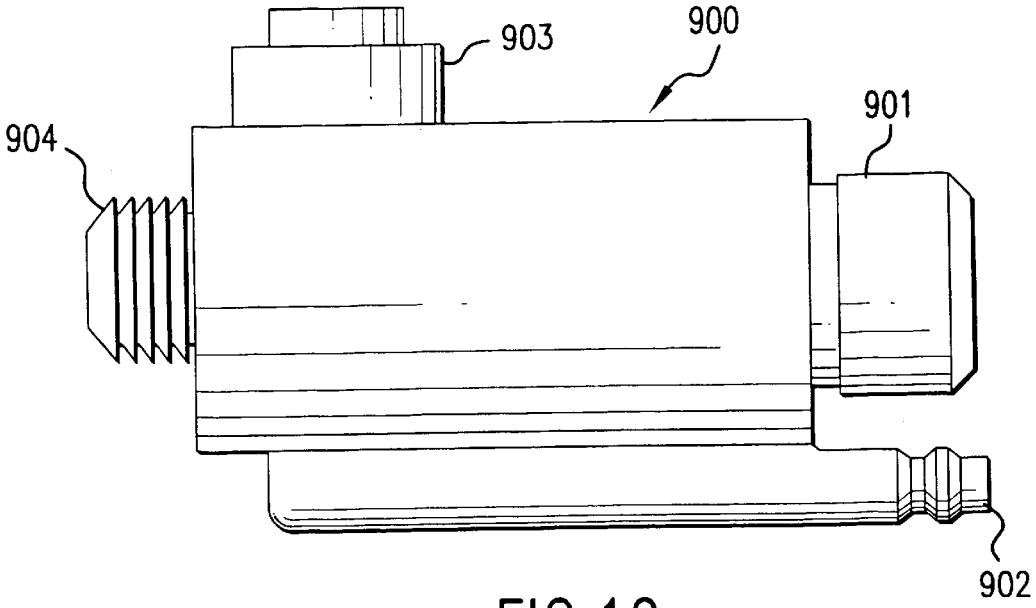
Figure 19D:
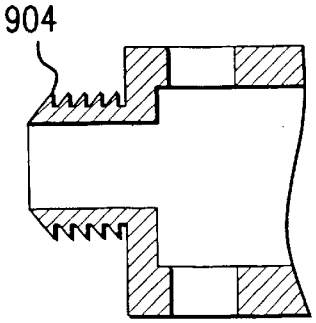
Figure 19E:
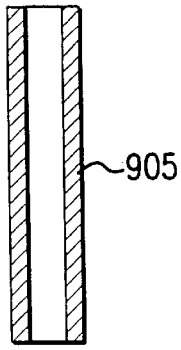

FIG. 1 shows a perspective view of a drywall taping and texture system using a pump in accordance with an embodiment of the present invention. The drywall taping and texture system preferably includes a pump 1 immersed in a container of mastic or fluid drywall material 32. The pump 1 may be supported in the container by a bucket clip 22. Referring to FIGS. 1 and 2, the pump 1 is preferably contained within a generally cylindrical housing 29. The housing 29 may be a solid shell with strength to withstand changes in pressure within the pump 1 and to support various parts of the pump 1. The housing 29 may be manufactured from a plastic extrusion, such as simple plastic drain pipe, which is cut to an appropriate length and then drilled to hold fasteners, such as screws or the like, that penetrate into various parts of the pump 1. The pump 1 may include a cap 10 attached to the housing 29 using fasteners such as a pin or bolt, or the like. The pump cap 10 may further include an air stem fitting 13 for connecting to an air compressor 28; a material line fitting 26 for connecting a preferably plastic material line 14 to the pump 1; and a control line fitting 27 for connecting a preferably plastic control line 15 to the pump 1. The material line 14 and the control line 15 may attach at their respective distal ends through another material line fitting 26 and another control line fitting 27, respectively, to a variety of tools, such as a tape applicator tool 200, a wand tool 300, a mud knife tool 400, a mud bead tool 500, a wall texture spray tool 600, or an acoustic texture spray tool 700. The pump 1 may also be attached to a variety of tools manufactured by Ames Tool Company See FIG. 18*a*–*c* and the like, through adapter parts 800, 801, and 802.

In the embodiment illustrated in FIGS. 1 and 2, the pump 1 preferably has an air gauge 24 and a pressure relief valve 25. The pressure relief valve 25 is one type of air release valve or mechanism for releasing air from the drywall taping and texture system, as will be discussed below. In alternative embodiments, the air gauge 24 and the pressure relief valve 25 may be omitted.

Figure 3A:
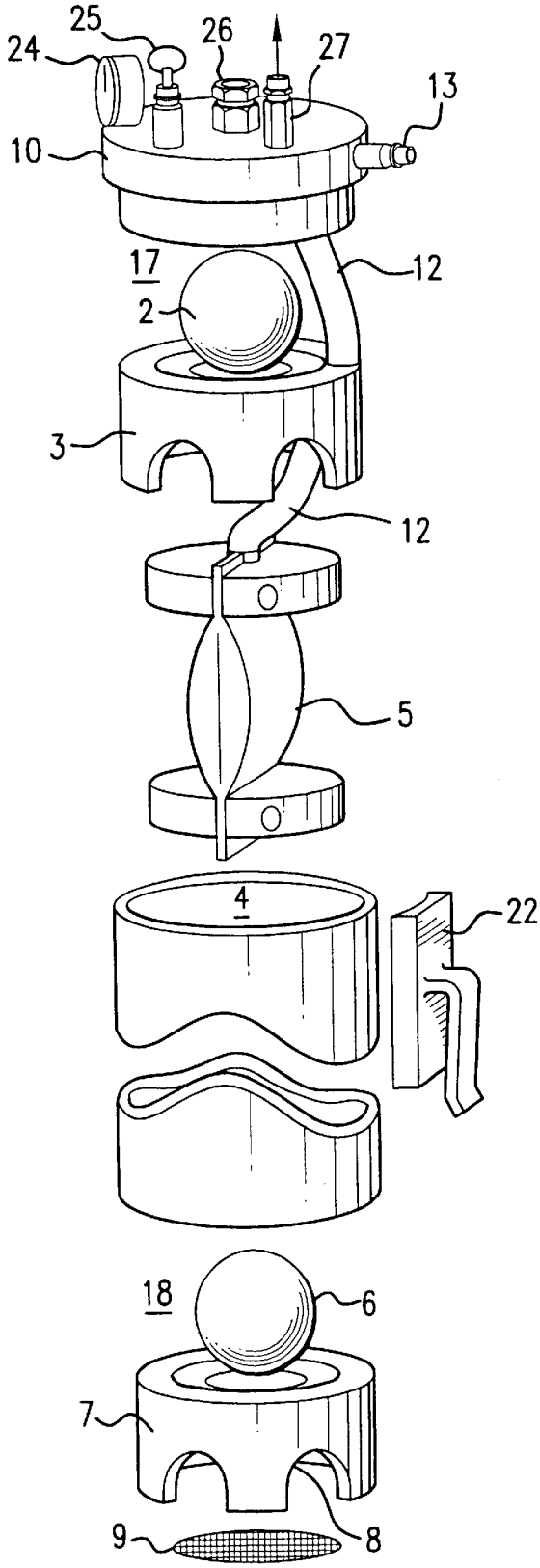
FIG. 3*a* is a perspective view of the interior parts of the pump shown in FIG. 1.
Figure 3B:
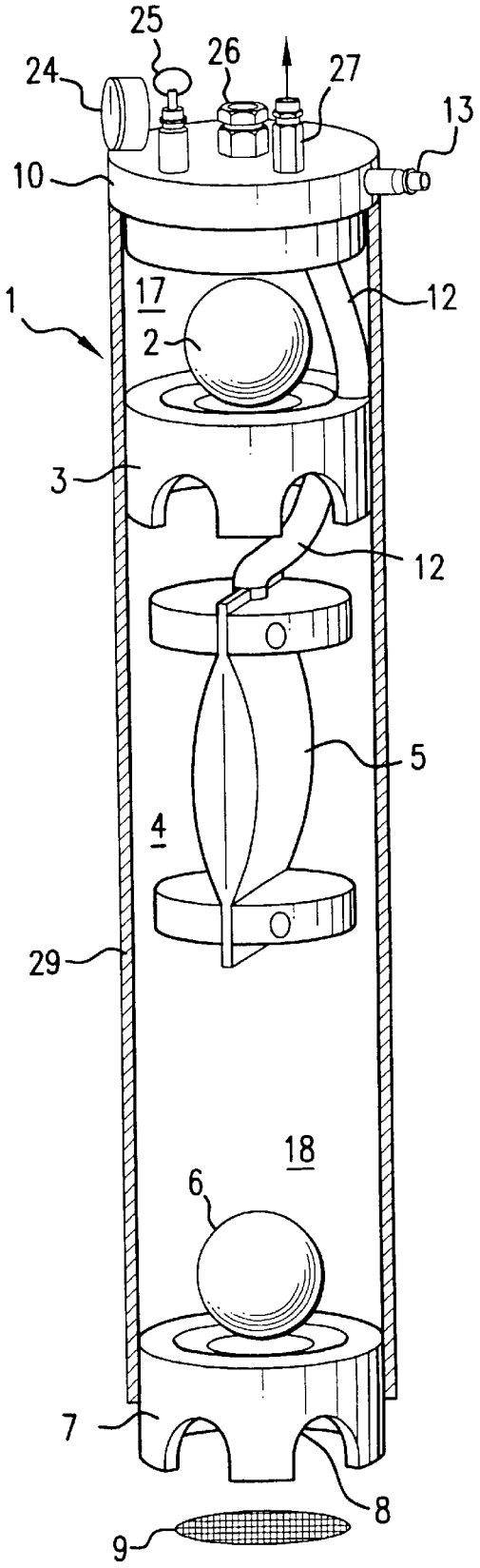
FIG. 3*b* is a partial cross-sectional view of the interior of the pump shown in FIG. 1.

As shown in FIGS. 3*a* and 3*b*, the bottom of the pump 1 may include an intake orifice 8 covered with a screen 9, which may be a barrier to particulate matter that might ruin the drywall finish or plug the tool attached to the pump 10. The mesh size of the screen 9 is preferably large enough to allow passage of acoustic ceiling grains, but small enough to stop larger particles. A user may change the screen 9 to screen mud or to spray acoustic. The screen 9 may be positioned over the intake orifice 8 so that all drywall material 32 passes through the screen 9 prior to entering the pump 1.

In preferred embodiments, the pump 1 has upper and lower valves for controlling the flow of the drywall material 32. In preferred embodiments, the valves are check valves that create a one-way flow of the drywall material 32 upward through the pump 1. In the embodiment illustrated in FIGS. 3*a*–4*b*, each valve includes a seat 3 or 7 having an orifice 17 or 8, respectively, through which the drywall material 32 flows, and a member 2 or 6 for controlling the flow of the drywall material 32 through the orifice 17 or 8, respectively. See FIG. 6*a*–*d*. However, in alternative embodiments, the valves may include other components, such as flappers or the like. The lower valve is preferably formed from a lower seat 7 and a lower member or ball 6. The upper valve may be similarly formed from an upper seat 3 and an upper member or ball 2. The upper and lower members may, in some embodiments, be formed as a plug, as illustratively depicted in FIGS. 23, 24, 26 and 27.

Referring to FIGS. 3*a*–4*b* and 6*a*–6*d*, the upper and lower seats 3 and 7 may be generally shaped as a band or ring, configured to fit with the upper and lower balls 2 and 6, respectively. The seats 3 and 7 may be secured to the housing 29 using fasteners, such as screws, glue, bolts, or the like. Drywall material 32 may flow through an orifice 8 at about the center of the seat 3 or 7. The seat 3 or 7 may include a raised ring that contacts the ball 2 or 6, respectively, to separate granular elements from the drywall material 32 for proper sealing of the seat 3 or 7 and the ball 2 or 6, respectively. In alternative embodiments, the seat 3 or 7 may have other shapes.

In the illustrated embodiment, the lower seat 7 holds the screen 9. The intake orifice 8 in the lower seat 7 may alternatively have lateral vents so that pump 1 is not closed off by contact with the bottom of the container of drywall material 32.

Preferably, the upper and lower balls 2 and 6 are similar. The ball 2 or 6 is preferably made from a heavyweight material, such as iron, lead, or the like, and covered with a soft rubber or rubber-like material, such as elastromeric material or the like. The rubber or rubber-like material may help the ball 2 or 6 to seal with the seat 3 or 7 when stopping the backwards flow of the drywall material 32. By way of example, the ball 2 or 6 may be a solid material ball with a rubber coating, a rubber ball with a lead shot filling, or a spring-loaded ball. Most preferably, the ball 2 or 6 plugs the seat 3 or 7, respectively, when the drywall material 32 flows backwards, but does not stick in the orifice 17 or 8 of the seat 3 or 7, respectively. The upper and lower valves may thus create a one-way flow of the drywall material 32 upward through the pump 1.

The pump 1 may include a bladder 5 mounted within the housing 29 between the upper and lower valves. Referring to FIGS. 3*a*–4*b* and 7, the bladder 5 may be made from a resilient, rubber or rubber-like material, such as elastomeric material or the like, with a diameter smaller than the diameter of a material chamber 4 of the pump 1. When inflated, the bladder 5 could be larger than the material chamber 4, but is preferably restrained by the cylinder body pump housing 29. The rubber-like material of the bladder 5 preferably has a plastic memory and will resiliently seek from a hyper inflated state to return to its "normal size" (uninflated).

The bladder 5 may be inexpensively built and easily replaced using adjustable bands 108 that clamp a rubber cylinder between them and the bladder attachment to pump head part 115 at the top and the lower bladder part 116 at the bottom. An alternative bladder 5 forming arrangement may be provided using a plurality of bladder clips 11 which seal the top and bottom of the bladder 5.

As shown in FIGS. 3*a*–5*a*, an airway 18 in the cap 10 may connect a pressure relief valve 25; a control line fitting 27 that is in turn connected to a control line 15; an air stem fitting 13 that is in turn connected to the air compressor 28; and the bladder 5 via the air stem 12. Air flow communication may thus be established among these parts.

Figure 4A:
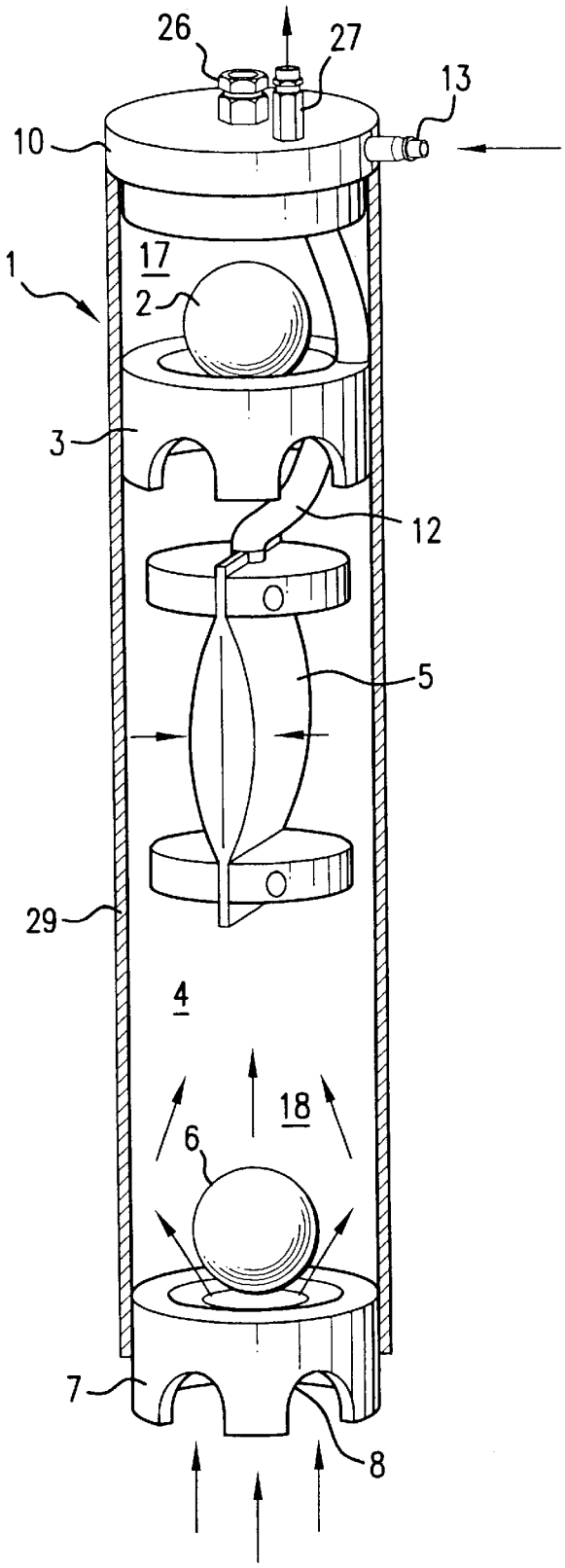
FIGS. 4*a* and 4*b* are partial cross-sectional views of the interior of the pump illustrating the pump in action.
Figure 4B:
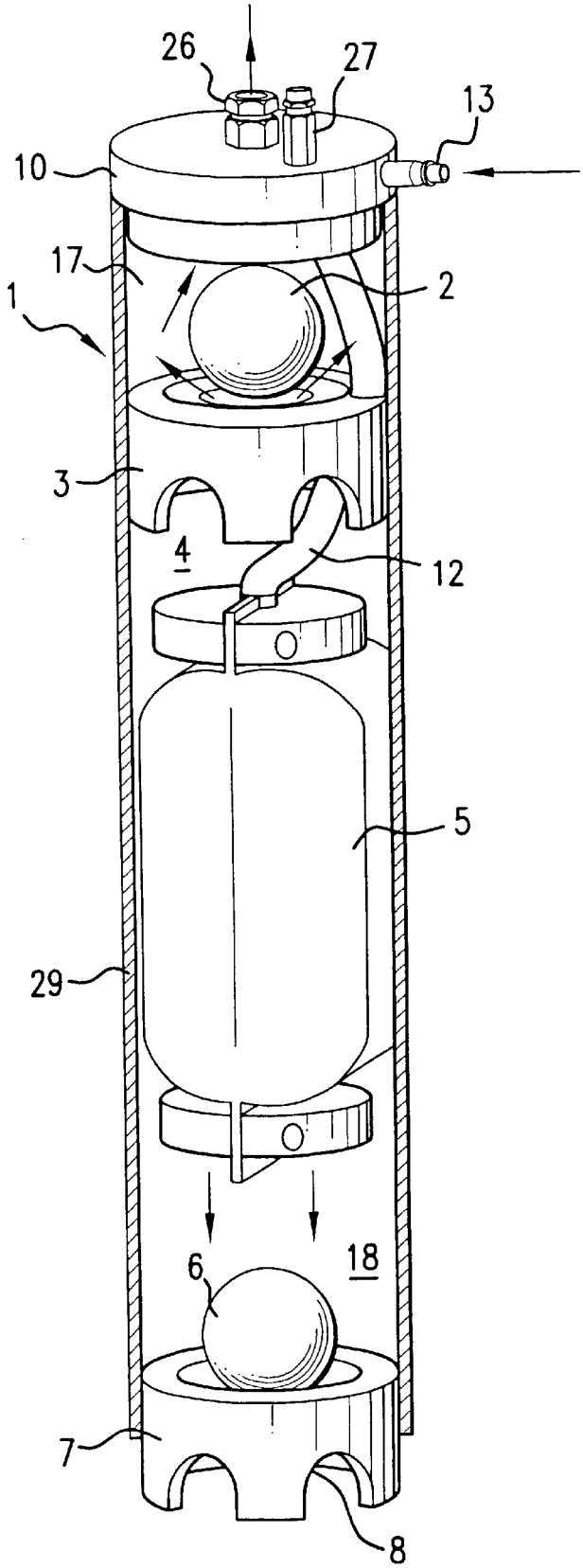
Figure 5A:
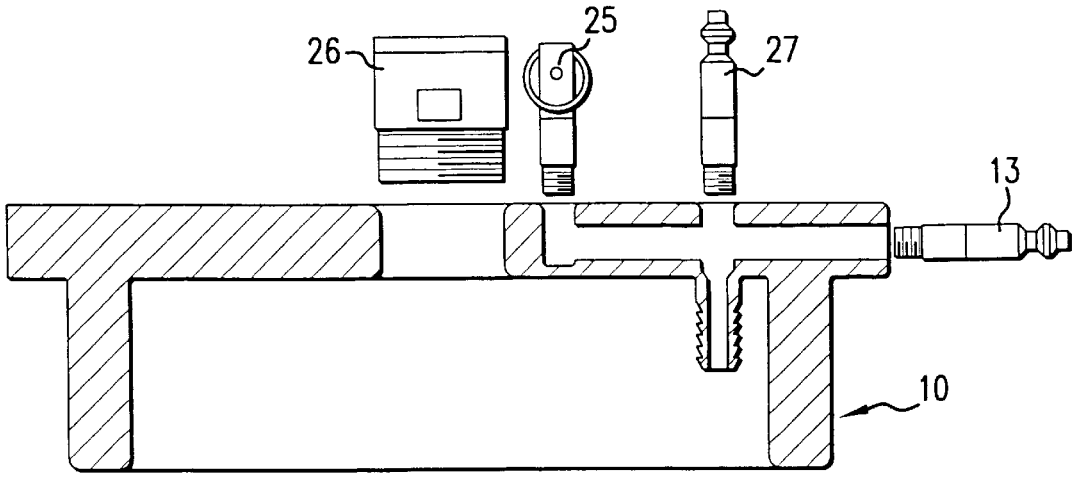
FIG. 5*a* is a side, cross-sectional view of a pump cap in accordance with an embodiment of the present invention.
Figure 5B:
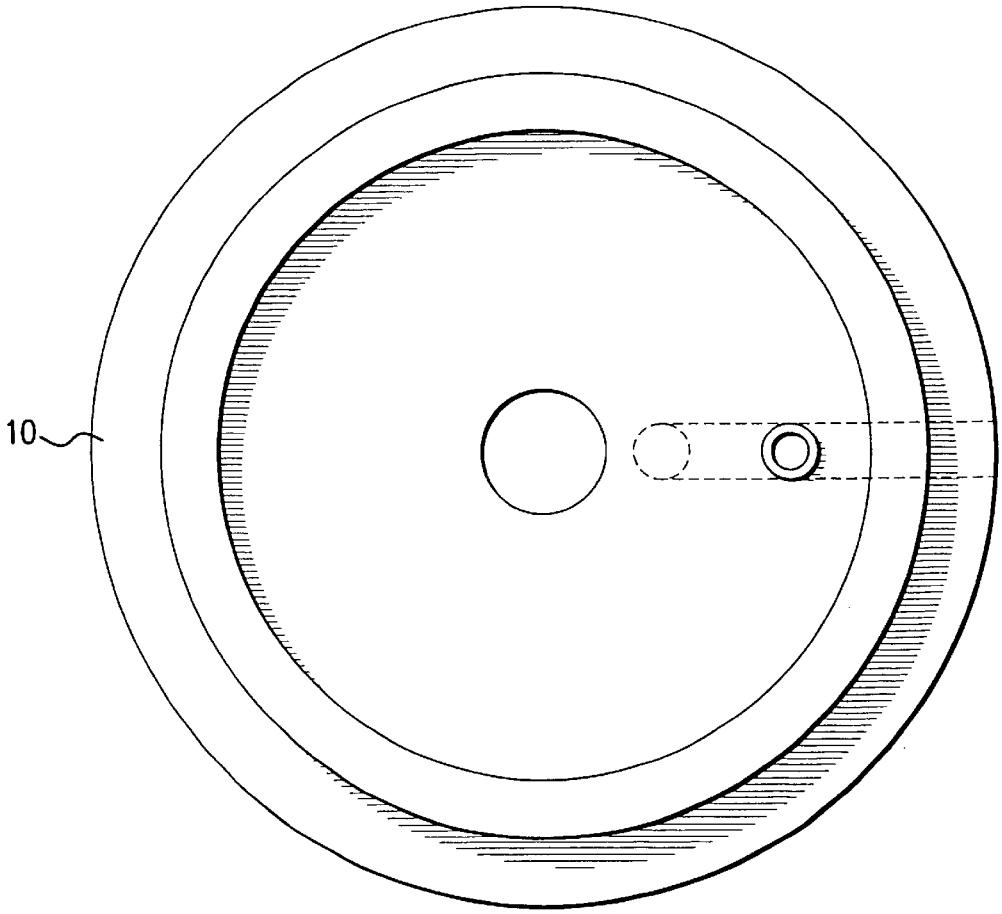
FIG. 5*b* is a top plan view of the pump cap.
Figure 5C:
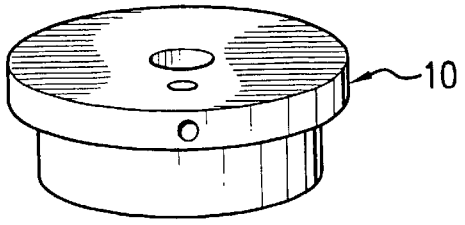
FIG. 5*c* is a perspective view of the pump cap.
Figure 6A:
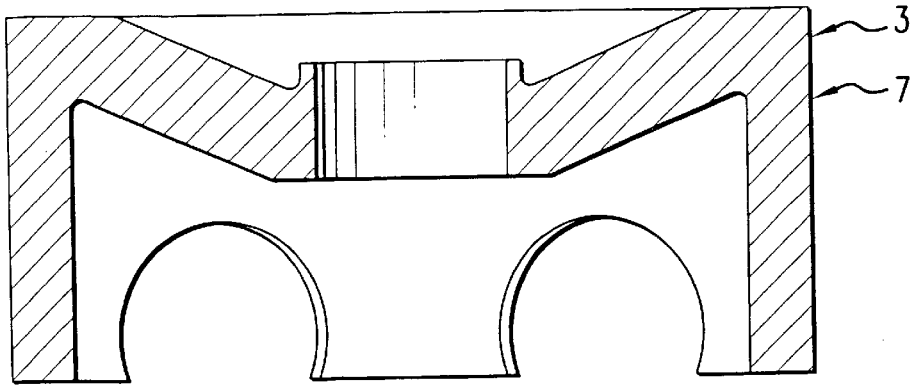
FIGS. 6*a*–6*d* are views of seat and ball components of a valve in accordance with an embodiment of the present invention.
Figure 6B:
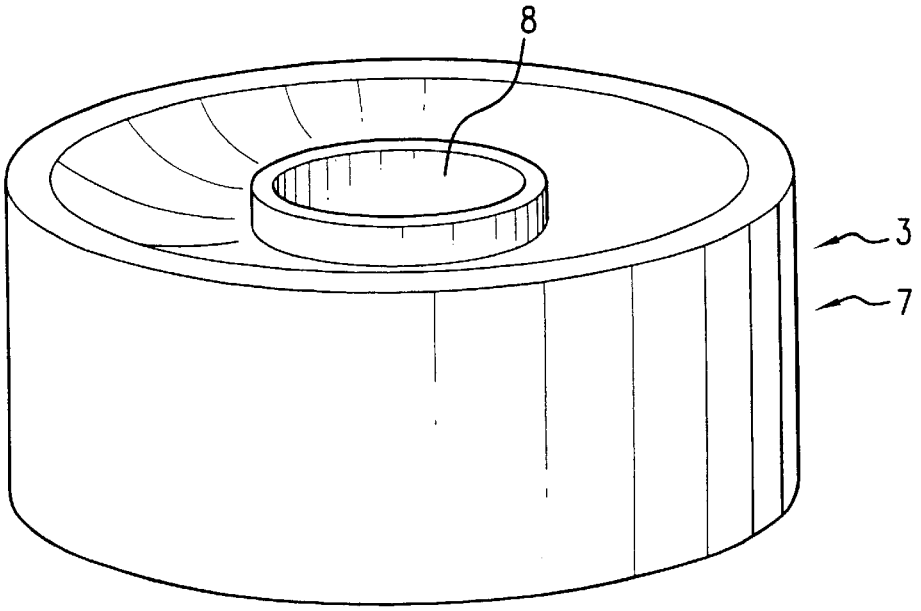
Figure 6C:
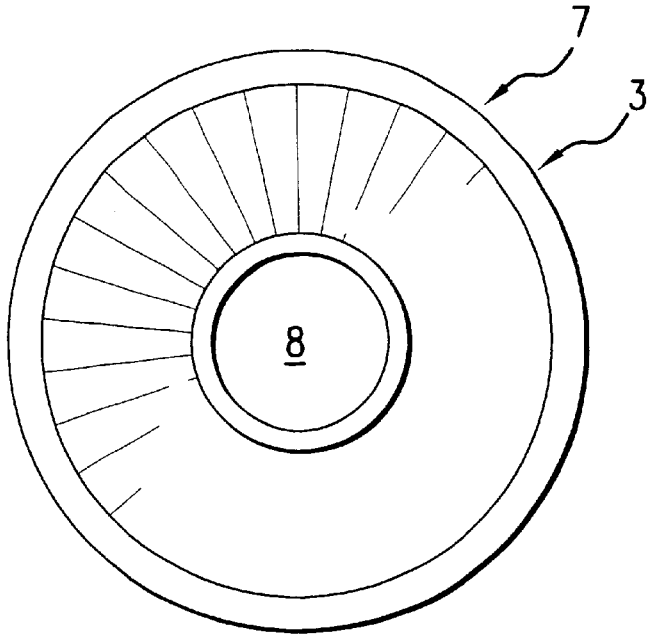
Figure 6D:
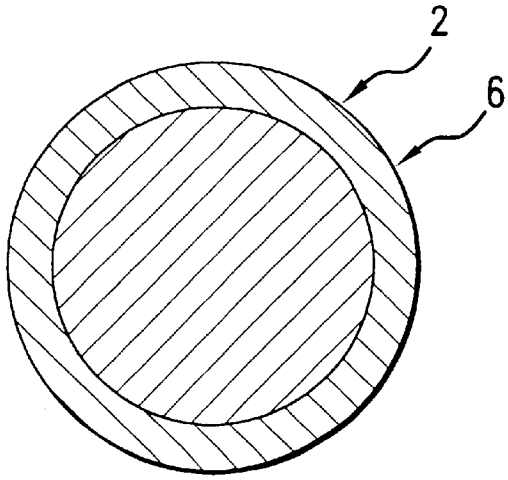
Figure 7:
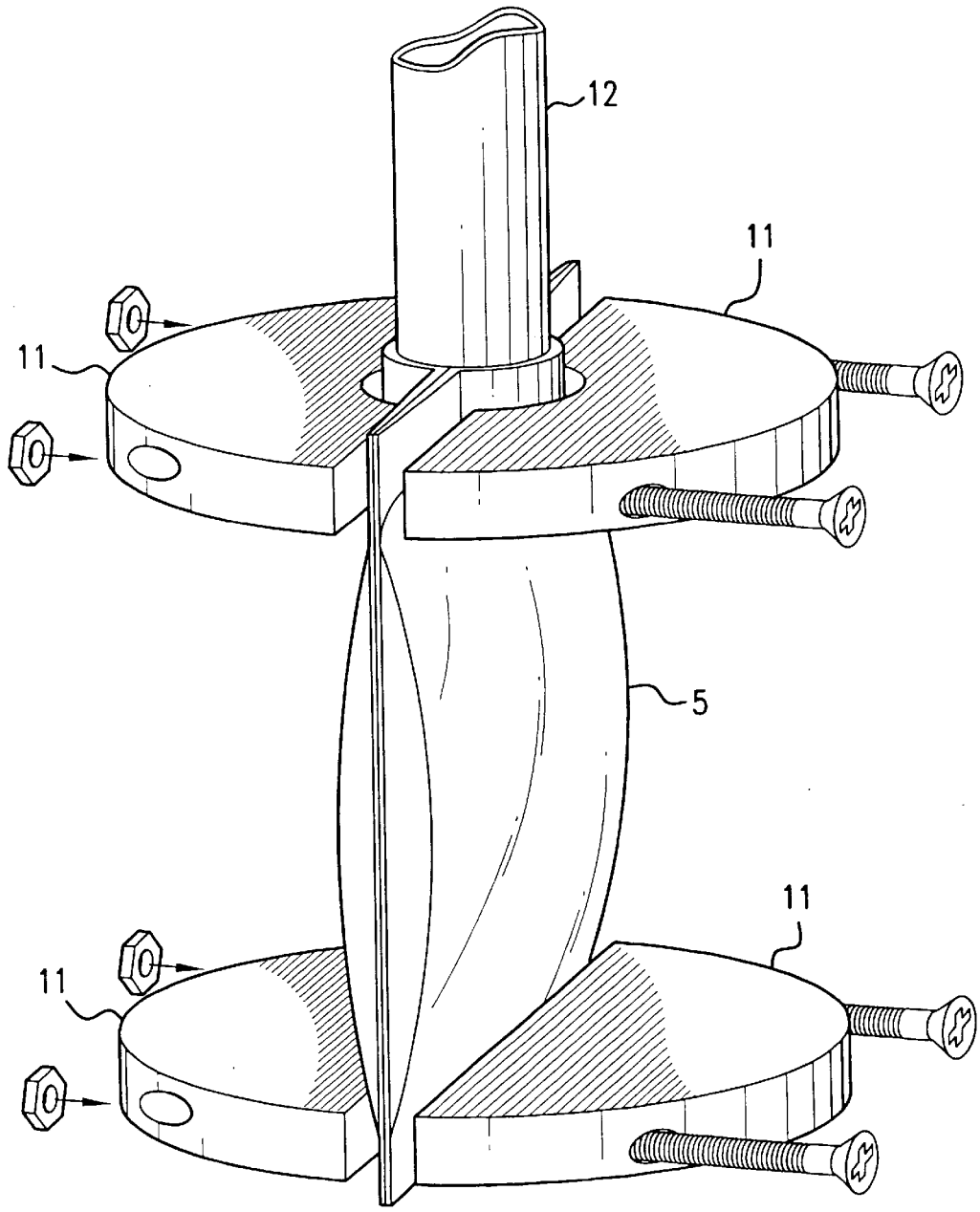
FIG. 7 is a perspective view of bladder clips and a bladder in accordance with an embodiment of the present invention.

Referring to FIGS. 4*a* and 4*b*, when the pump 1 is placed in the container filled with mastic or fluid drywall material 32, drywall material 32 preferably wants to flow into the pump 1. The lower ball 6 may be lifted out of the lower seat 7 due to greater pressure outside the pump 1 and lower pressure inside the pump 1. Resistance to the flow of the drywall material 32 from the container into the pump 1 may be minor because the lower valve resists flow in the opposite direction. Once the pump 1 is filled with drywall material 32, the bladder 5 may be inflated, resulting in positive pressure within the pump 1. This pressure may close the lower valve and lift the upper ball 2 out of the upper seat 3, forcing drywall material 32 through the material line 14 and the attached tool, and onto the work surface.

An automatic air release mechanism may be included to vent air from the bladder of the system. When the air release mechanism is open the bladder will deflate, pulling more drywall material into the housing. When the air release mechanism is closed, however, air may enter and inflate the bladder, forcing drywall material to the work surface via a control line and tool. Multiple air release mechanisms may be included in particular embodiments of the present invention, and most preferably at least one such mechanism is included (e.g., a button 50 or a trigger 147) and a pump mounted pressure relief valve.

Each tool preferably includes an air release mechanism, such as a button 50 or trigger 147, that allows the user 146 to remotely control the pump I, via the control line 15. In particular, the user may utilize the air release mechanism to deliver drywall material 32 to the work surface as needed and to control an air release valve or mechanism remotely located on the pump 1 (i.e., when an air release mechanism included on the tool is continually sealed, a second automatic air release mechanism on the housing may be forced to open). FIGS. 8*a*–8*b*, 21*a*–21*e*, 22*a*–22*c* and FIG. 35*a* illustrate four types of such tool related air release mechanisms.

Figure 8A:
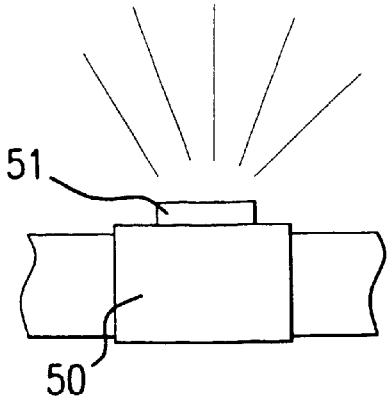
FIGS. 8*a* and 8*b* are perspective views of a button with a hole, which is an air release mechanism in accordance with an embodiment of the present invention.
Figure 8B:
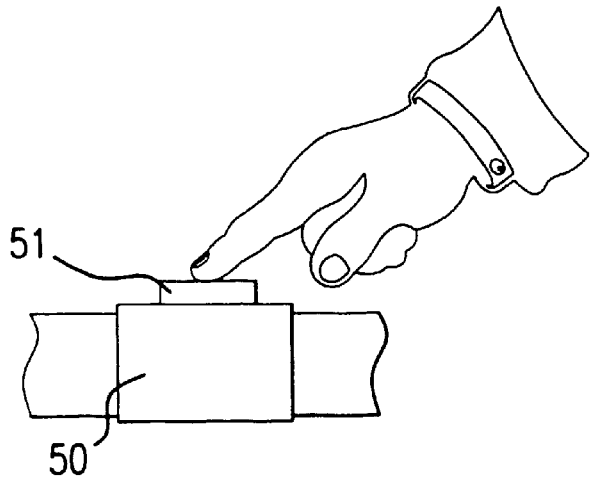

As illustrated in FIGS. 8*a* and 8*b*, an air release mechanism may be a button 50 with an air release hole 51 at about the center of the button 50. The user may open and close the air release mechanism by alternatively uncovering and covering the hole 51, respectively. This type of air release mechanism may be directly connected to the tool.

Figure 21A:
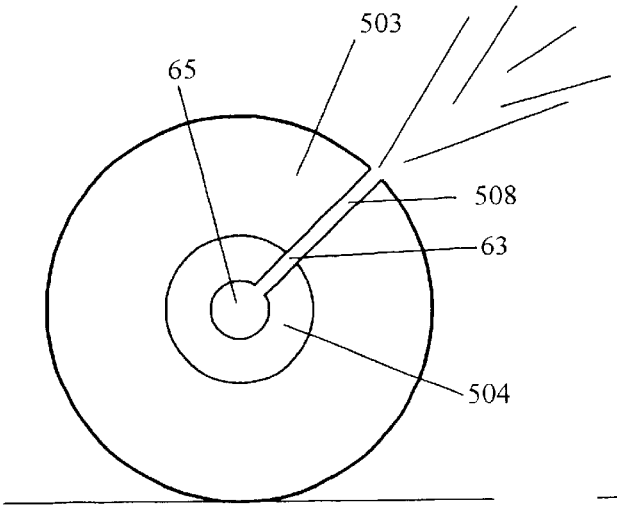
FIGS. 21*a*–21*e* are views of a wheel with a hollow axle, which is a wheel air release mechanism in accordance with an embodiment of the present invention.
Figure 21B:
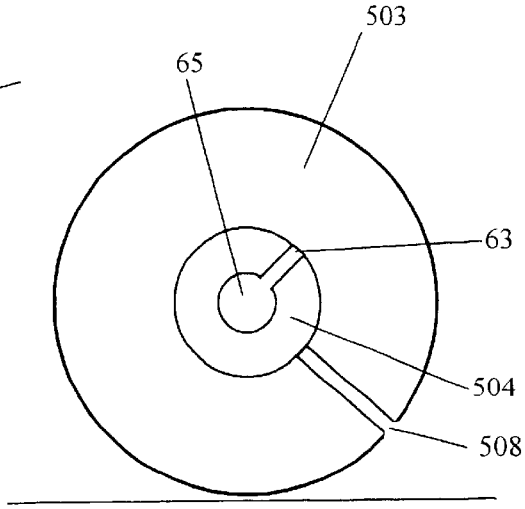

Referring to FIGS. 21*a* and 21*b*, a wheel air release mechanism may include a hollow axle 504 with a radial air hole 63 and a wheel 503 with a radial air hole 508. As the wheel 503 is rolled along the work surface, the wheel 503 preferably rotates around the axle 504. When the radial air hole 63 in the axle 504 is aligned with the radial air hole 508 in the wheel 503, the wheel air release mechanism may temporarily open. Otherwise, when the radial air hole 63 in the axle 504 is not aligned with the radial air hole 508 in the wheel 503, the air release mechanism is preferably closed. The wheel air release mechanism may also be directly connected to the tool.

Figure 22A:
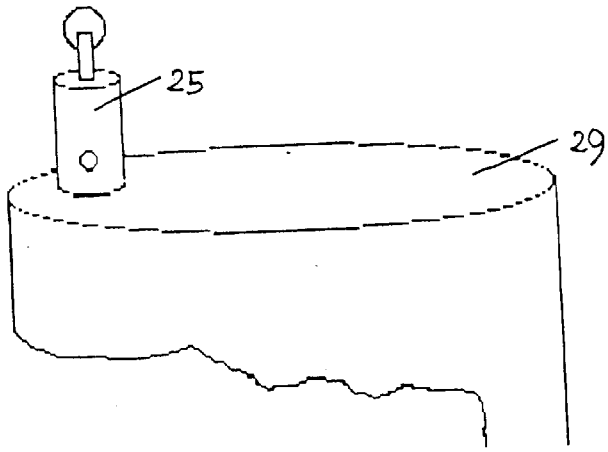
FIGS. 22*a*–22*b* are views of an air release mechanism in accordance with an embodiment of the present invention.
Figure 22B:
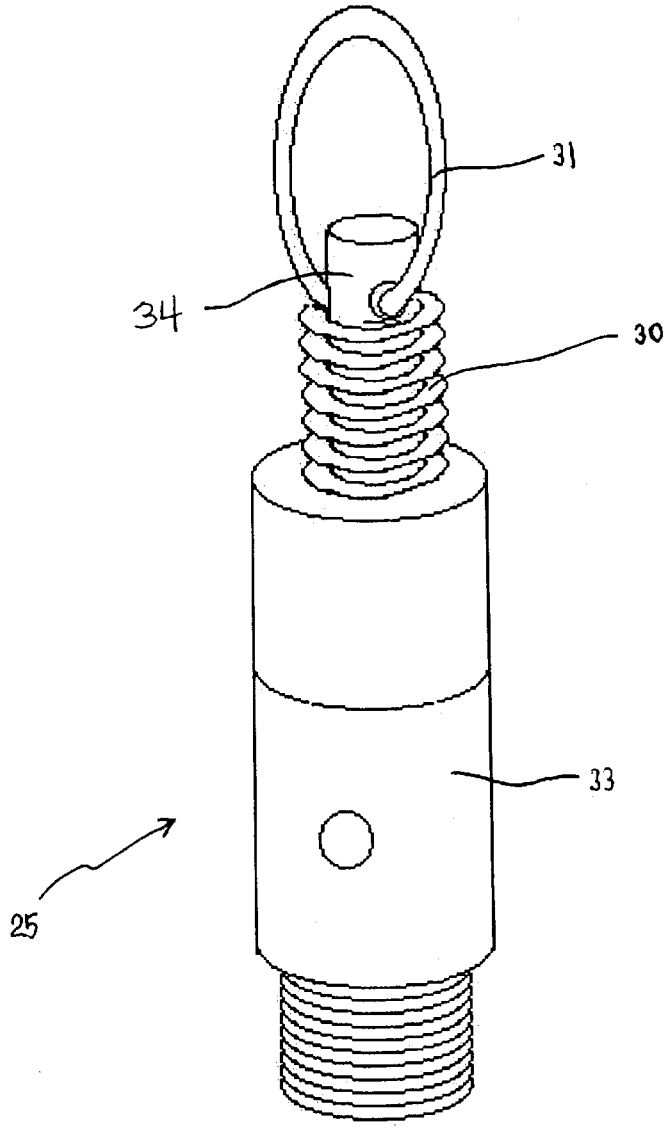

Referring to FIGS. 22*a*–22*c*, an air release mechanism may be a pressure relief valve 25 connected to the pump housing 29. The pressure relief valve 25 may include a pull ring 31, a valve core 34, and a valve body 33. The pressure relief valve 25 may also include an added compression spring 30 inserted over and surrounding the valve core 34, to dampen closing to thus expand the range of pressure variation during which pressure relief valve 25 remains in the open position. The pressure relief valve 25 preferably opens momentarily when the bladder 5 inflates to a maximum air pressure level, and the pressure relief valve 25 preferably closes (FIG. 22*b*) when the bladder 5 deflates to a minimum air pressure level. Absent spring element 30, or another similar mechanism, pressure relief valve 25 may open when bladder 5 reaches a maximum air pressure level and may close once the pressure drops slightly below this maximum level. Thus, in a preferred embodiment, spring element 30 possesses sufficient mechanical and elastic properties such that pressure relief valve 25 opens at a maximum air pressure level of approximately 80 psi, and remains open until the pressure drops to a minimum pressure level of approximately 40 psi. This same preferred pressure relief valve 25 may close at a pressure level of approximately 60 psi when spring element 30 is not included therein. A two stage air release regulator (not shown) which opens at 80 psi and closes at 10 psi may be used but is much more expensive than the modified pressure relief valve 25, with a simple spring 30.

Figure 35A:
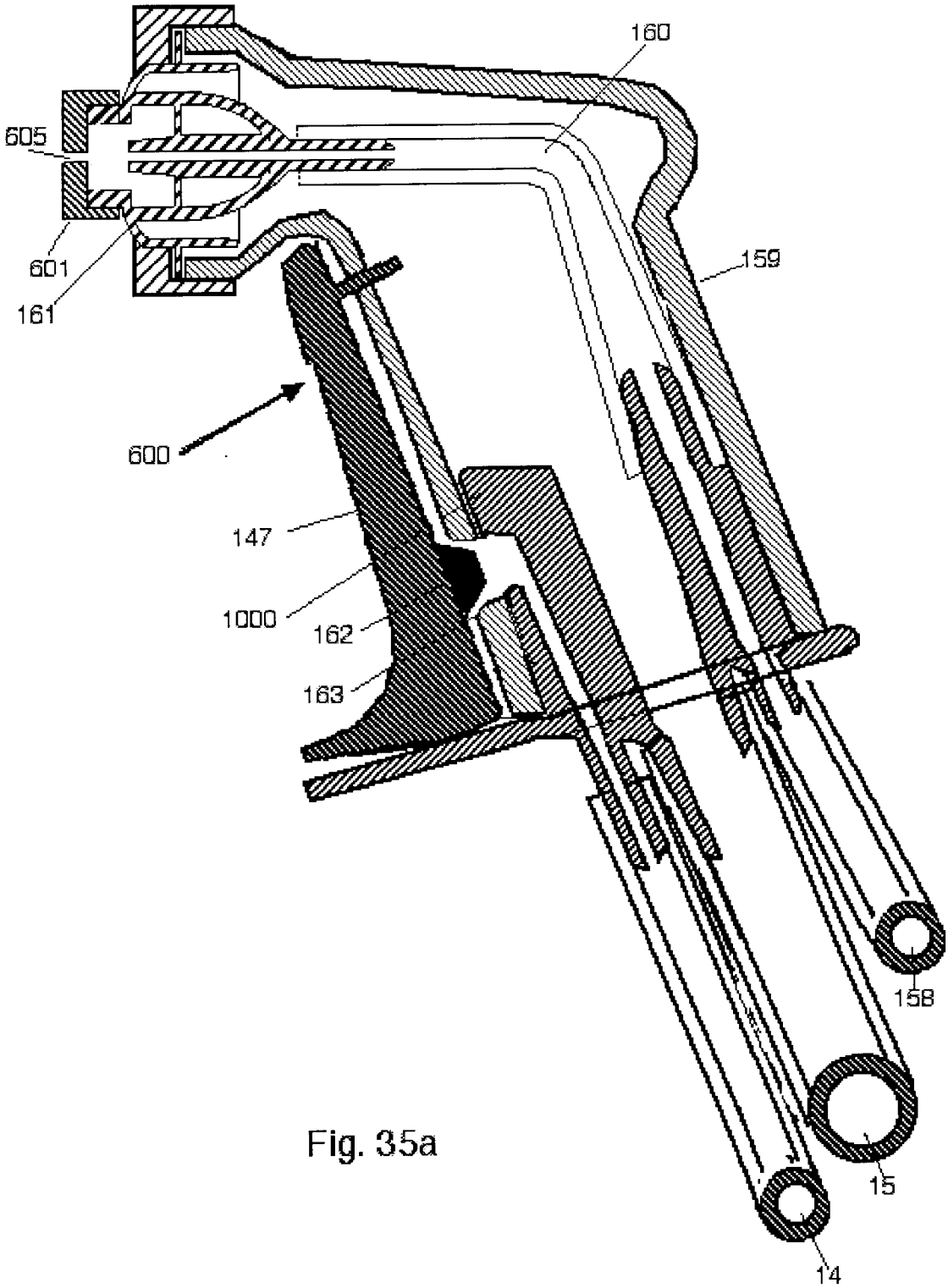
FIG. 35*a* is a sectional view of a texture gun showing a universal hose connector and trigger assembly.

The trigger 147 may be used on a number of various tools to release air which controls the pump. The trigger best shown on FIG. 35*a* shows a rubber air seal washer 162 which is attached to the under side of the trigger 147 such that as the trigger is pulled back by the user operator 146, the air flow from the control line 15 is selectively held to remotely start pump action.

Therefore, in preferred embodiments, each tool has a button or trigger 147, for remotely controlling the pump 1 via the control line 15. When the user presses the button 50, or pulls the trigger, the normal release of air at the tool is stopped and air release at the pump 1. The default condition of the pump bladder is deflated and the control valve default is closed. Pressure then builds up in the control line 15 and causes the bladder 5, to inflate, thus forcing drywall material 32 through the upper valve and out of the pump 1, through the material line 14 and the tool, and onto the work surface. After a surge of a certain volume of drywall material 32, the user may reduce the air pressure by releasing air at the tool by releasing the trigger preferably included therein. The bladder 5 quickly deflates upon the release of air through the button 50 or trigger 147. The resulting partial vacuum formed by the shrinking bladder 5 refills the material chamber 4 of the pump 1 with drywall material 32 through the lower valve. Subsequent inflation of the bladder 5 forces drywall material 32 through the upper valve, as previously discussed.

Figure 15A:
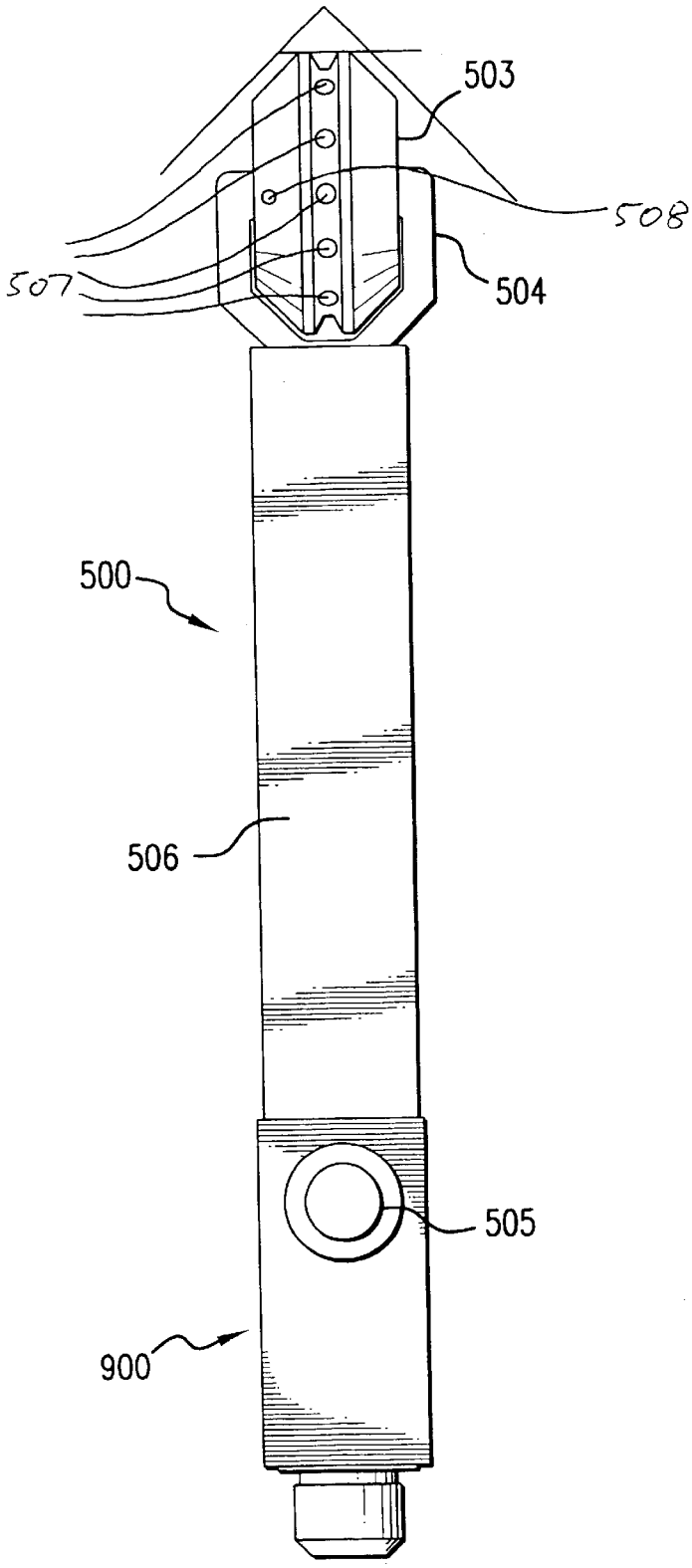
FIGS. 15*a* and 15*b* are top and side plan views of a mud bead tool in accordance with an embodiment of the present invention.
Figure 15B:
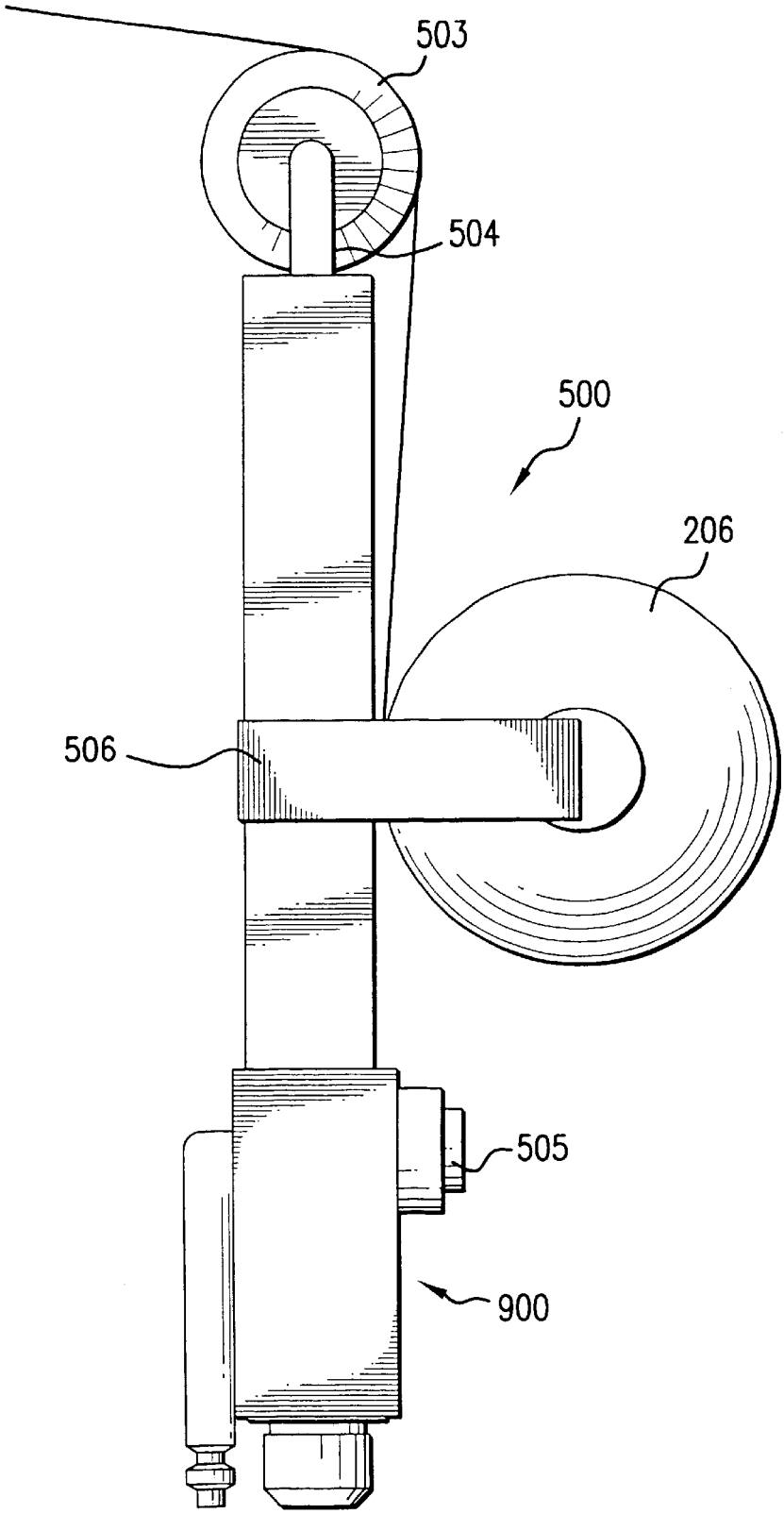

When a more continuous flow of drywall material 32 is desired, a pressure relief valve may be additionally included such that the user may continuously hold down the trigger 147 on the tool. This may cause the pressure within the bladder 5 to rise until the maximum air pressure level of the pressure relief valve is reached. At that point, the pressure relief valve preferably opens, deflating the bladder and drawing fresh drywall material into the housing. The pressure relief valve preferably closes once pressure drops to a minimum air pressure level, causing the bladder to again inflate and force drywall material to the work surface. Notably, a trigger 147, if included on the tool, need not be released for this continuous, cyclic action of the device, sometimes referred to as a "flip flop" action controlled by pneumatic logic.

Where periodic, user-controlled extrusions of drywall material onto a work surface are desirable, a trigger may be sufficient as a sole air release mechanism in the tool. However, in alternate embodiments, such as the mud bead tool 500 depicted in FIGS. 15*a*–15*b*, the additional inclusion of a second air release mechanism in the tool may allow air to periodically be released from the bladder even while the aforementioned button is depressed, thereby cyclically refilling the pump housing with drywall material as the bladder deflates with each release of air from the additional air release mechanism. This feature allows the tool to be used continuously, without the user having to release the button on the tool at particular time intervals to refill the housing with drywall material. This is particularly advantageous when the tool is one where a substantially consistent flow of drywall material is desired, as opposed to a periodic extrusion. In this latter embodiment, the trigger may need only be released when the user desires to terminate the extrusion of drywall material from the tool altogether. In a most preferred embodiment of the system used with a mud bead tool, three air release mechanisms may be included: a button 50, or trigger 147, on the tool as a pressure relief valve, and a wheel air release mechanism as well.

Figure 9A:
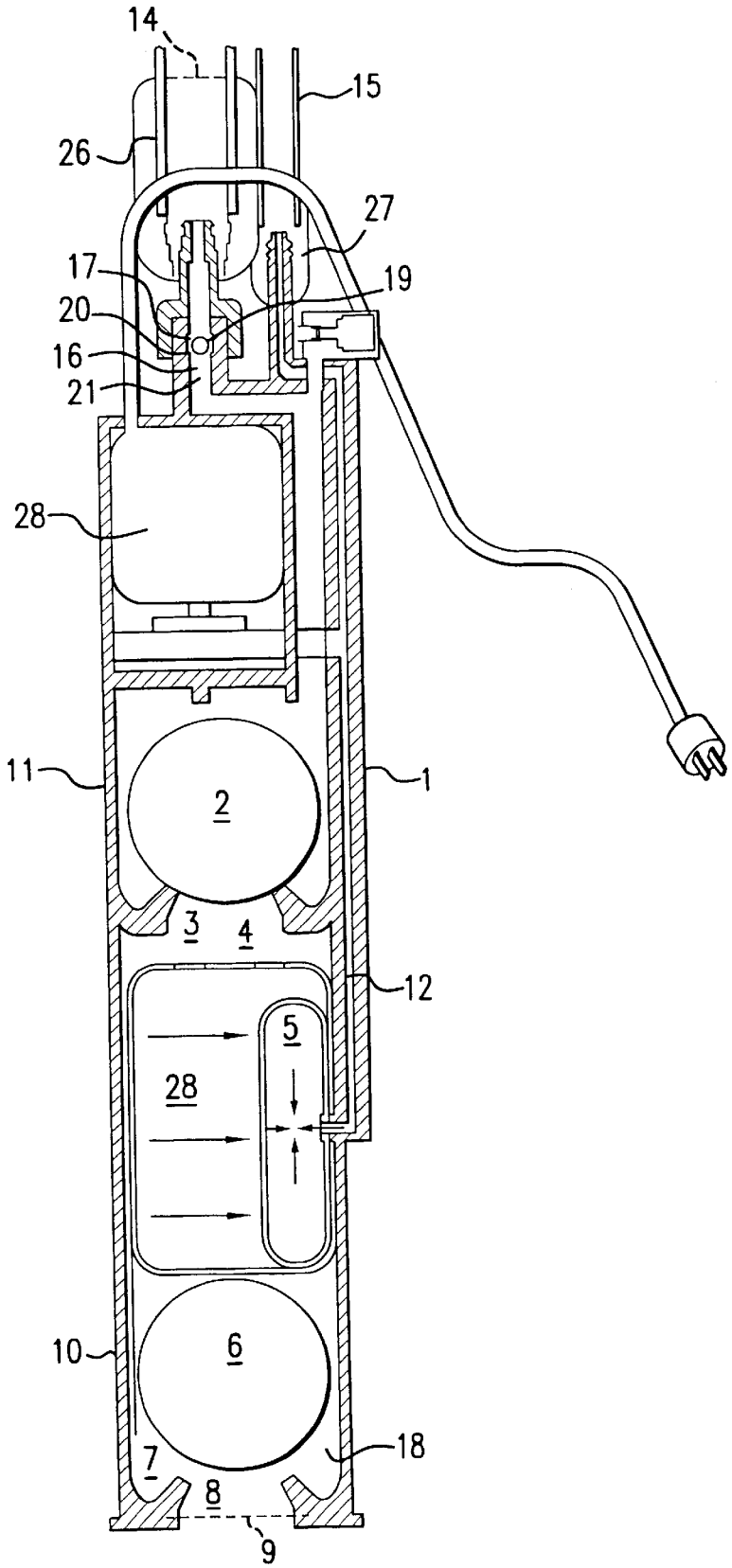
FIGS. 9*a*–9*c* are views of an electrical version of the pump in accordance with an alternative embodiment of the present invention.
Figure 9B:
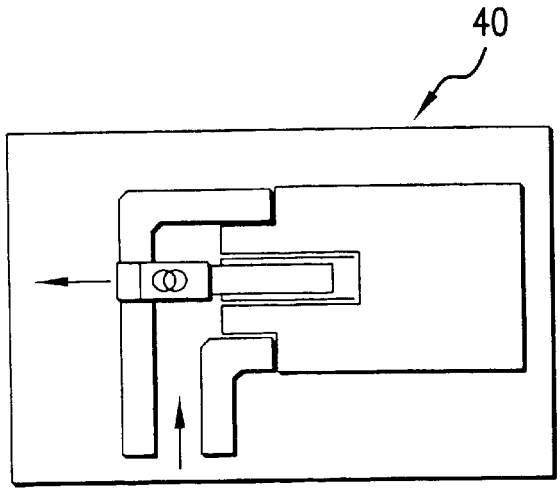
Figure 9C:
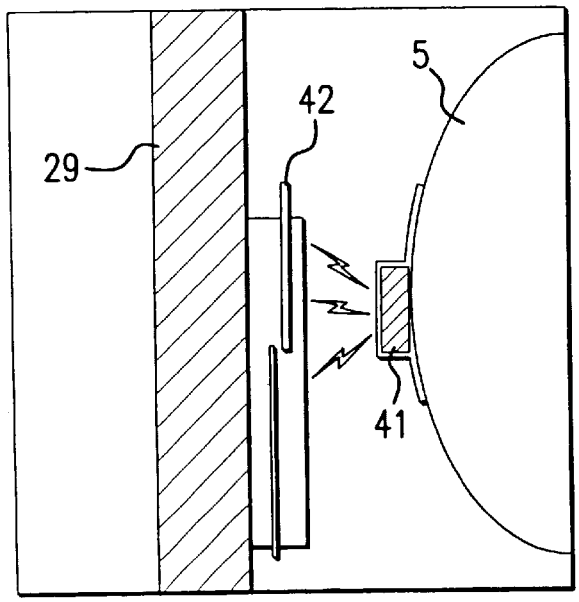

FIGS. 9*a*–9*c* illustrate an electrical version of the pump 1 in accordance with an embodiment of the present invention. An air compressor 28 may be mounted within the pump housing 29 and connected to the bladder 5. An inflation sensor may include a first sensor element 41, preferably a magnet, attached to the bladder 5, and a second sensor element 42, preferably a reed switch, attached to the housing 29. The inflation sensor may determine the inflation state of the bladder 5. When the inflation sensor determines that the bladder 5 is deflated (e.g., when the first and second sensor elements are separated by a distance sufficient to result in minimal magnetic force therebetween), the air compressor 28 is preferably turned on to inflate the bladder 5. When the inflation sensor determines that the bladder 5 is inflated (e.g., when the first and second sensor elements are sufficiently near one another to result in substantial magnetic force therebetween), the air compressor 28 is preferably turned off. The air compressor 28 may be pneumatically controlled with a solenoid module 40 or electrically controlled.

As shown in FIG. 9*a*, the pump 1 may include a secondary exhaust valve with a material exhaust orifice 16, connected to the material line fitting 26 and the material line 14. The secondary exhaust valve may further include a secondary check ball 19, a seat 20, and a chamber 21, which support the material line fitting 26. This secondary valve may be advantageous where the drywall material or other fluid utilized with the present invention has particles suspended therein that might prevent the valve member from seating properly in the orifice. The inclusion of a secondary valve thus provides an added protection against undesirable backflow of material.

The set of tools that may be used with the pump 1 includes drywall mud, tape, and texture application and finishing devices. Each tool preferably connects to the material line 14 and the control line 15. Referring to FIGS. 19*a*–19*e*, a universal hose/tool fitting part 900 may be used with the tools, where appropriate. The universal fitting part 900 is preferably made using an injection molding process. The universal fitting part 900 may form part of the handle, the material line fitting 901, the control line fitting 902, a high pressure air fitting 904 and the control line orifice 903 on a wand tool 300, a mud knife tool 400, a mud bead tool 500, a wall texture spray tool 600, and an acoustic texture spray tool 700.

Figure 20A:
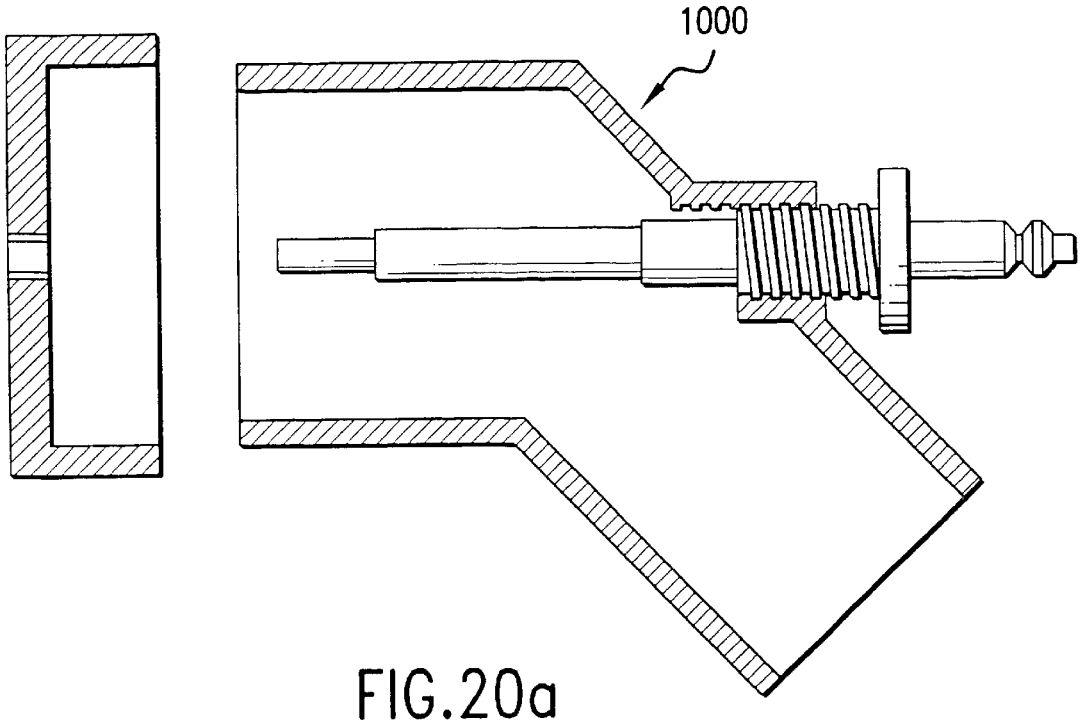
FIGS. 20*a*–20*c* are partial cross-sectional views of an universal spray head part in accordance with an embodiment of the present invention.
Figure 20B:
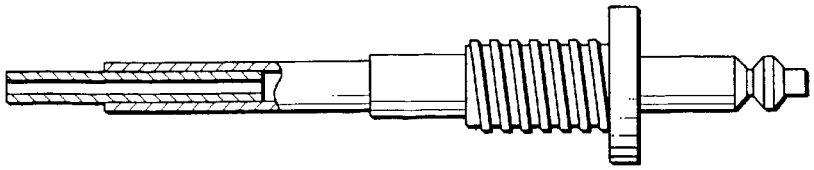
Figure 20C:
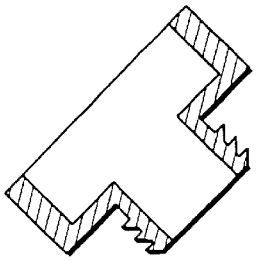

Referring to FIGS. 20*a*–20*c*, a universal spray head part 1000 may be used with the two spray tools: the wall texture spray tool 600 and the acoustic texture spray tool 700. The universal spray head part 1000, in combination with a universal tool fitting part 900 and a short section of PVC pipe, may form a wall texture spray tool 600. The universal spray head part 1000, in combination with a universal tool fitting part 900 and a section of PVC pipe, may form an acoustic texture spray tool 700.

Figure 10A:
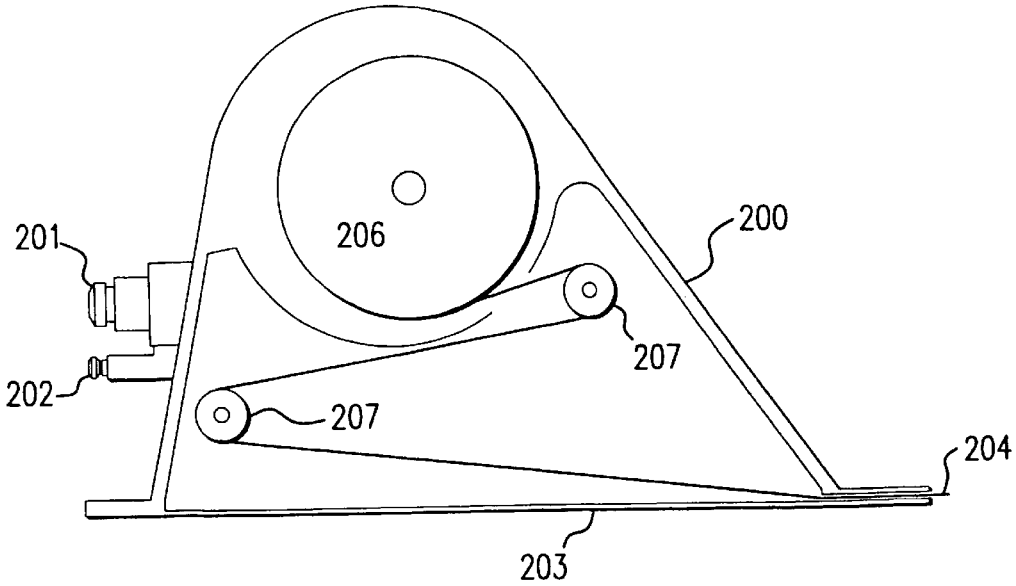
FIGS. 10*a* and 10*b* are front and back perspective views of a tape applicator tool in accordance with an embodiment of the present invention.
Figure 10B:
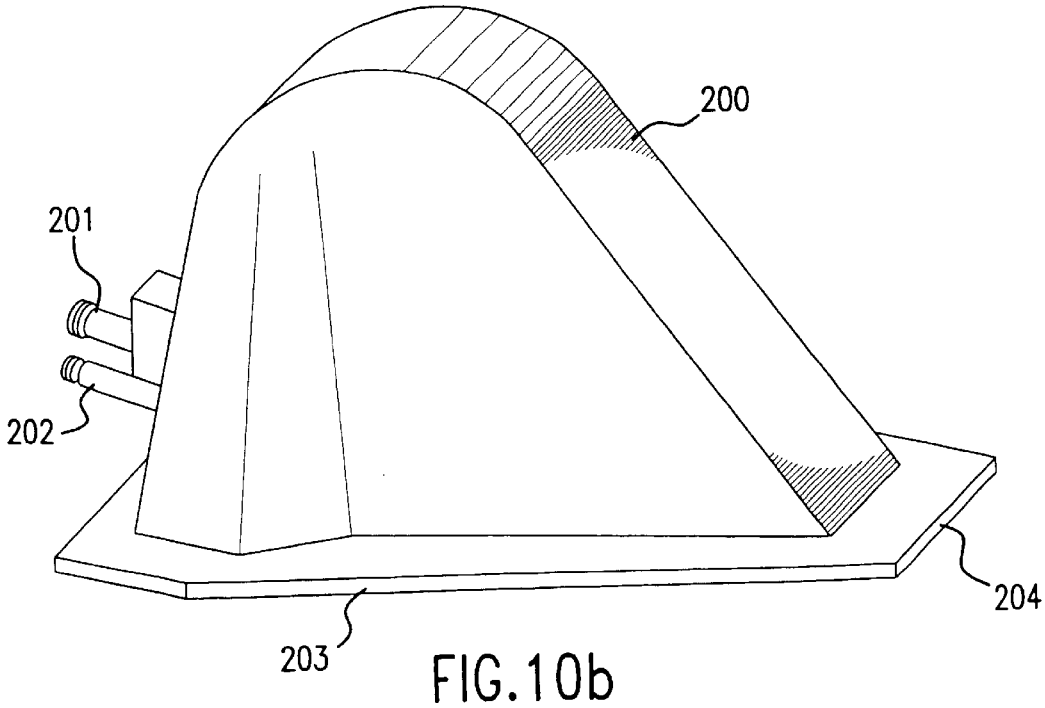
Figure 11A:
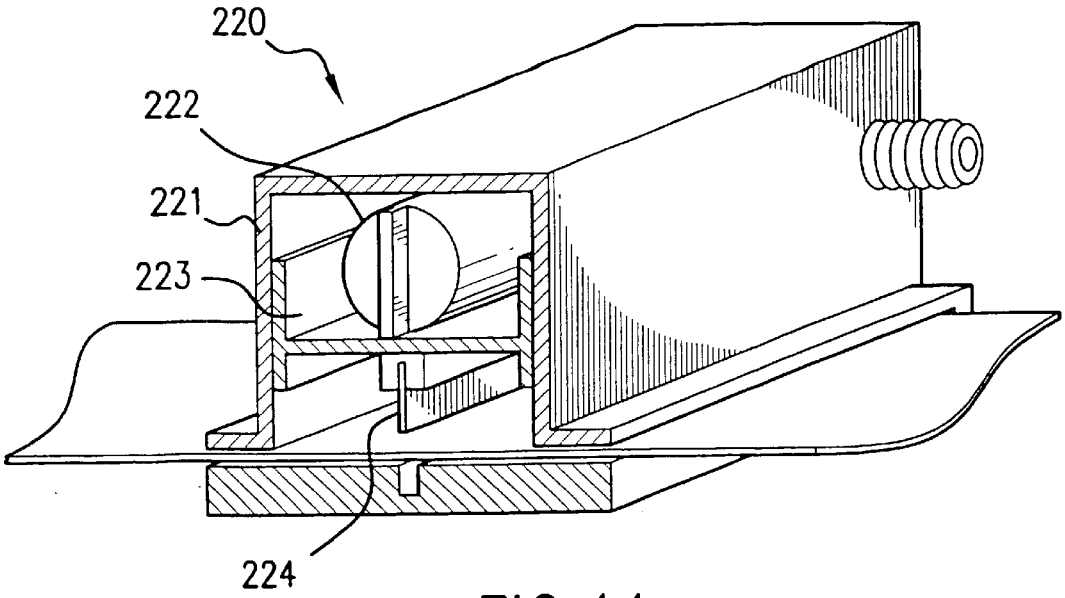
FIGS. 11*a*–11*c* are views of a pneumatic tape cutter in accordance with an embodiment of the present invention.
Figure 11B:
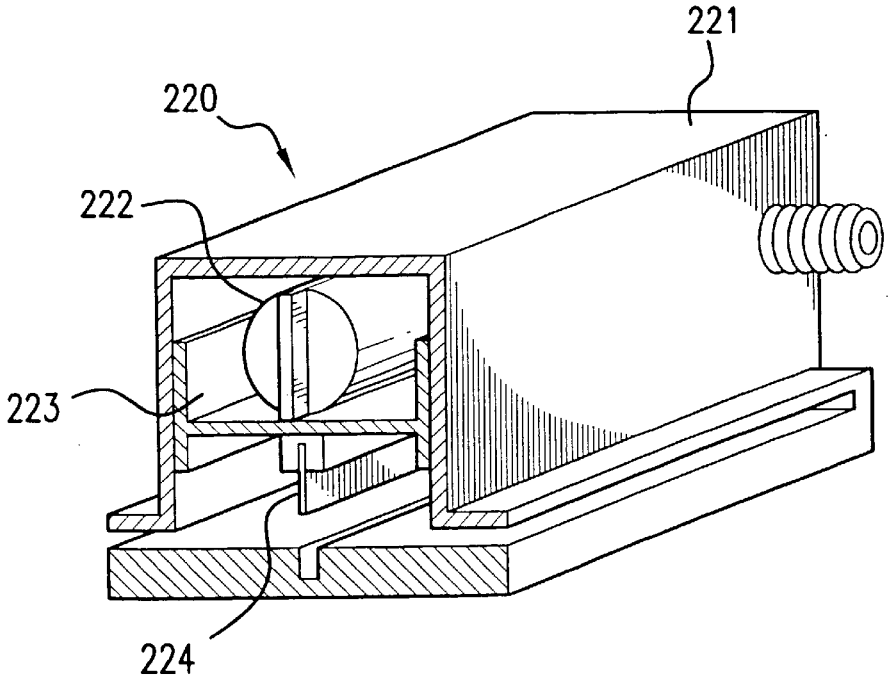
Figure 11C:
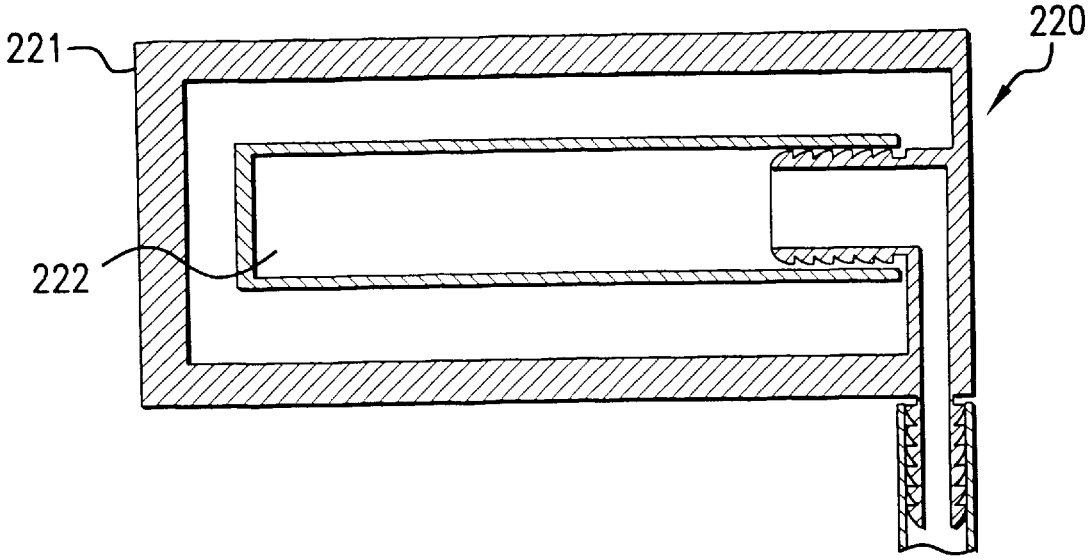

As shown in FIGS. 10*a* and 10*b*, the tape applicator tool 200 may be used to hold, cut, and apply drywall tape and mud. The tool 200 preferably connects to the material line 14 and control line 15 via fittings 201 for material and fitting 202 for control air. The tape applicator tool 200 may have a cavity that holds a supply of drywall tape 206 and an area to advance and cut off the tape 204. The tool 200 may also have a material line that feeds the drywall material 32 into a wetting chamber as it flows out of the tool 200 onto the work surface. The tool 200 may further include a base plate 203 to enclose the tool and a set of tape rollers 207. The tape applicator tool 200 may have a metering wheel to retrieve drywall material 32 from the pump 1 according to the distance that the tool 200 is moved along the work surface. As illustrated in FIGS. 11*a* through 11*c*, a pneumatic tape cutter 220 may also be added to the tape applicator tool 200 for cutting the drywall tape 204.

Figure 12A:
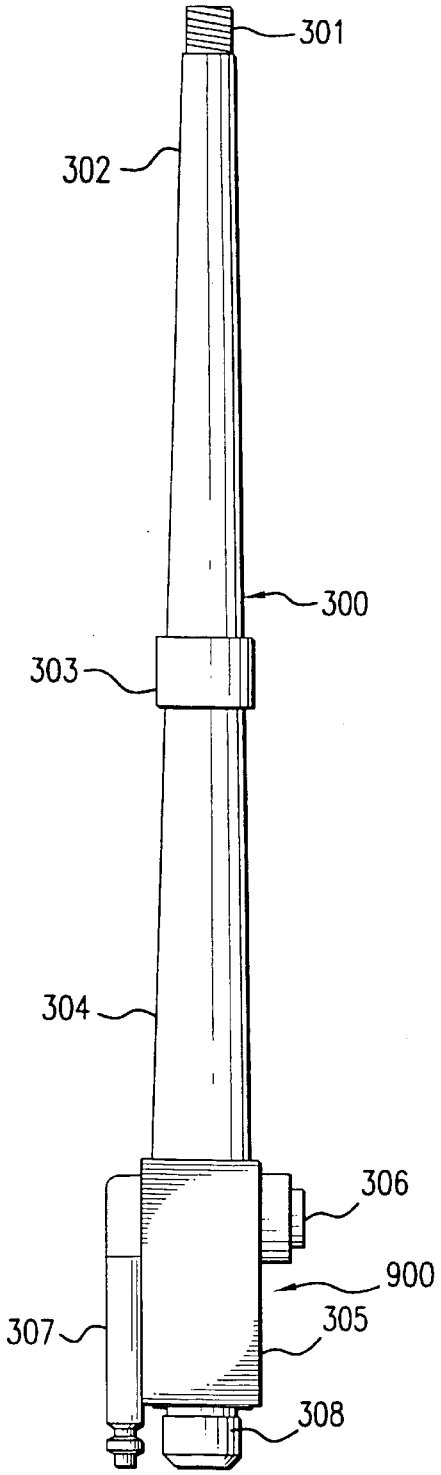
FIGS. 12*a* and 12*b* are views of a wand tool in accordance with an embodiment of the present invention.
Figure 12B:
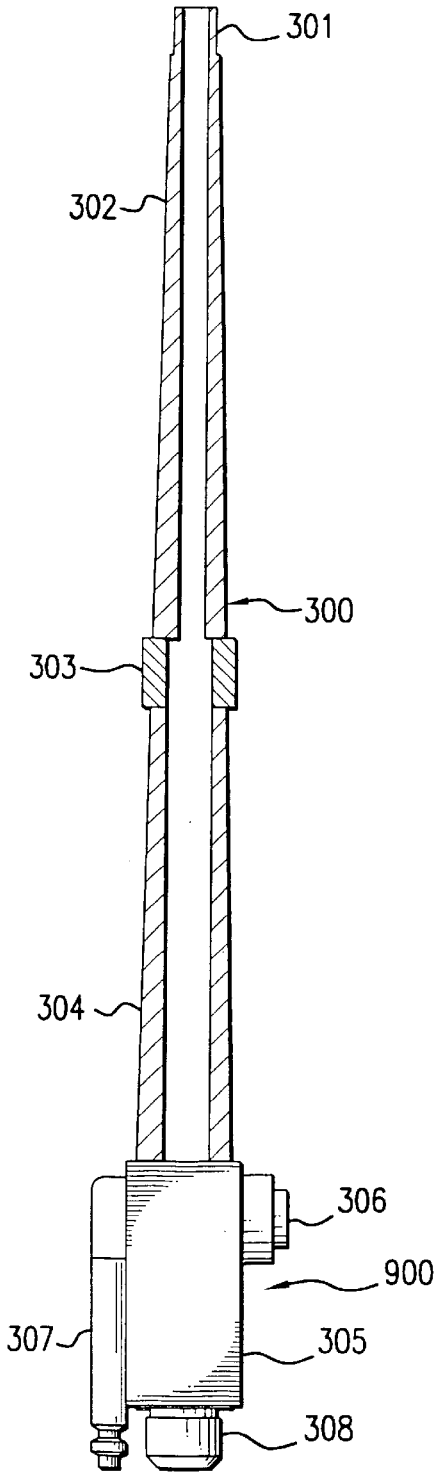
Figure 13:
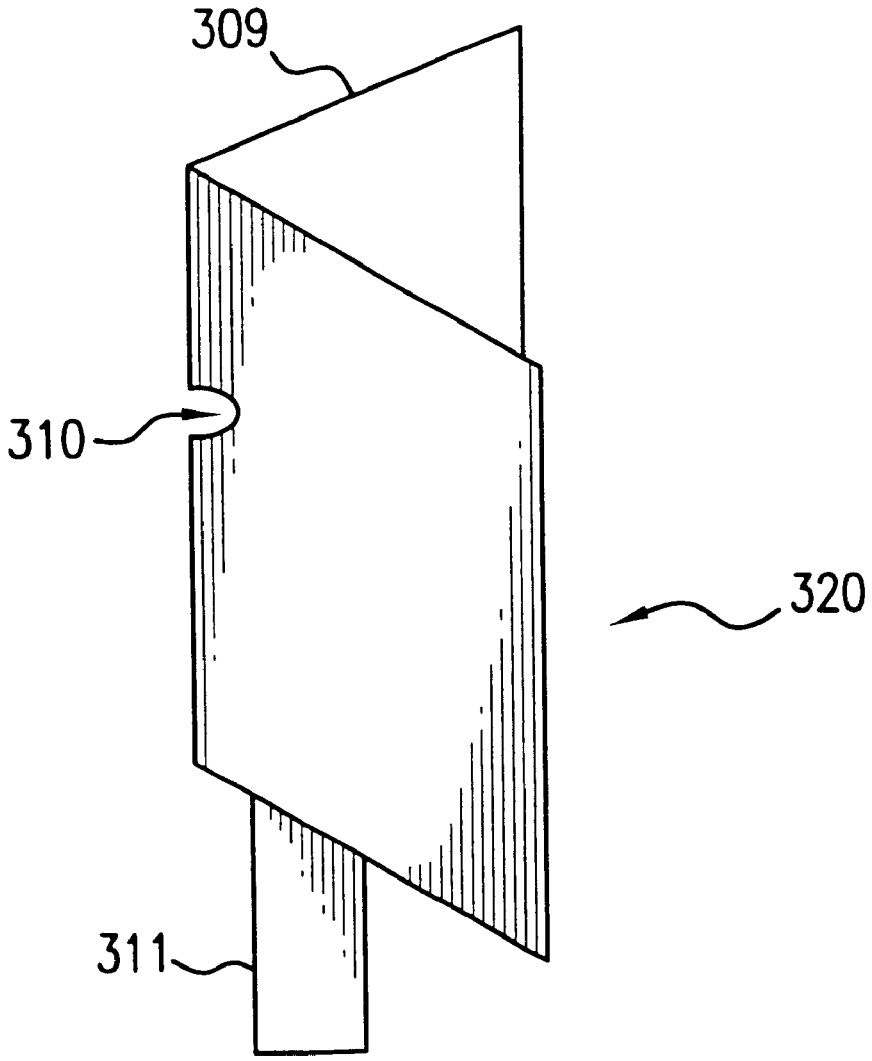
FIG. 13 is a perspective view of a corner tool in accordance with an embodiment of the present invention.

Referring to FIGS. 12*a* and 12*b*, the wand tool 300 may be used to apply drywall mud to seams. The tool 300 may be a hollow, elongated tool with threads 301 on the distal end, material and control line fittings 307 and 308, and a control button 306. Referring to FIG. 13, a corner tool 320 may be attached to the threaded end 301 of the wand tool 300 via a threaded end 311 of the corner tool 320. The corner tool 320 may be used to deliver drywall material 32 into corners through a hole 310. The corner-shaped blades 309 may finish the corners as the tool 320 is slid back and forth over the corner seam.

Figure 14A:
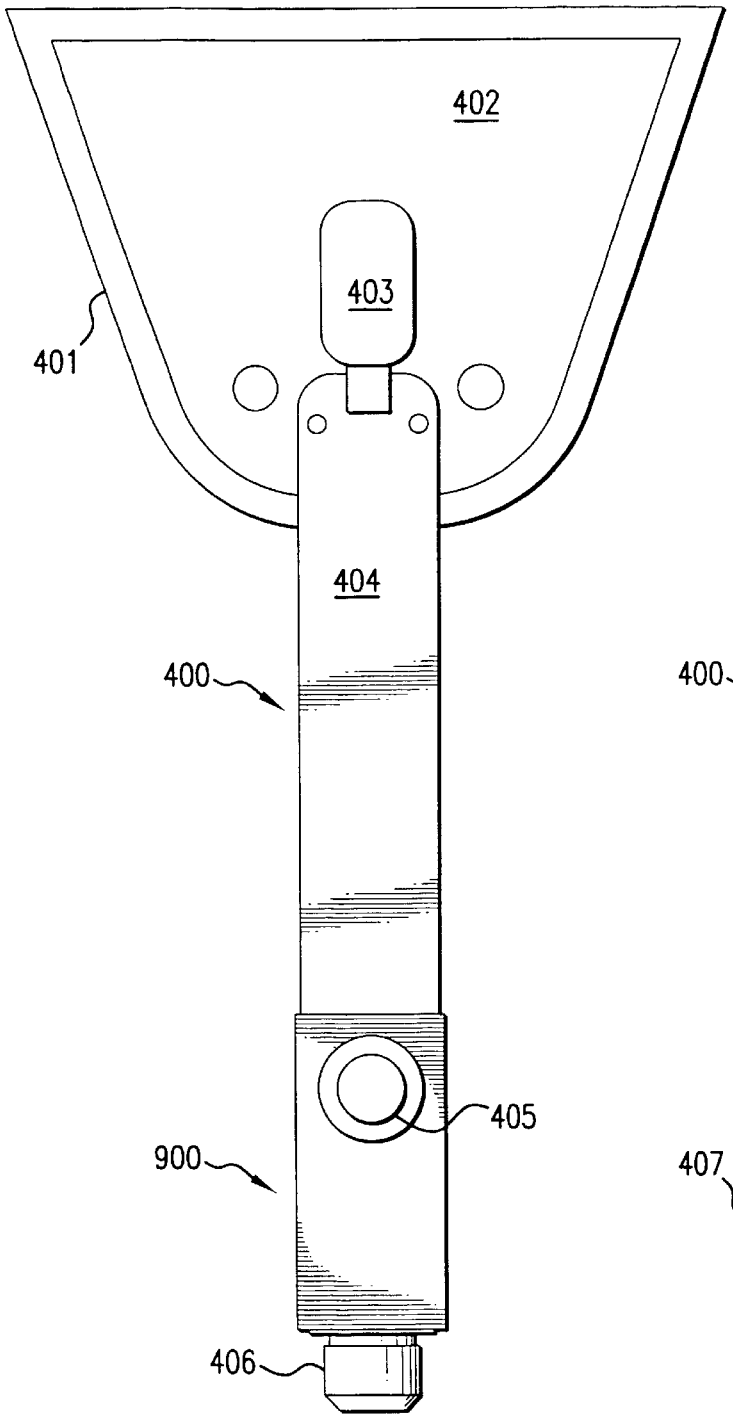
FIGS. 14*a* and 14*b* are top and side plan views of a mud knife tool in accordance with an embodiment of the present invention.
Figure 14B:
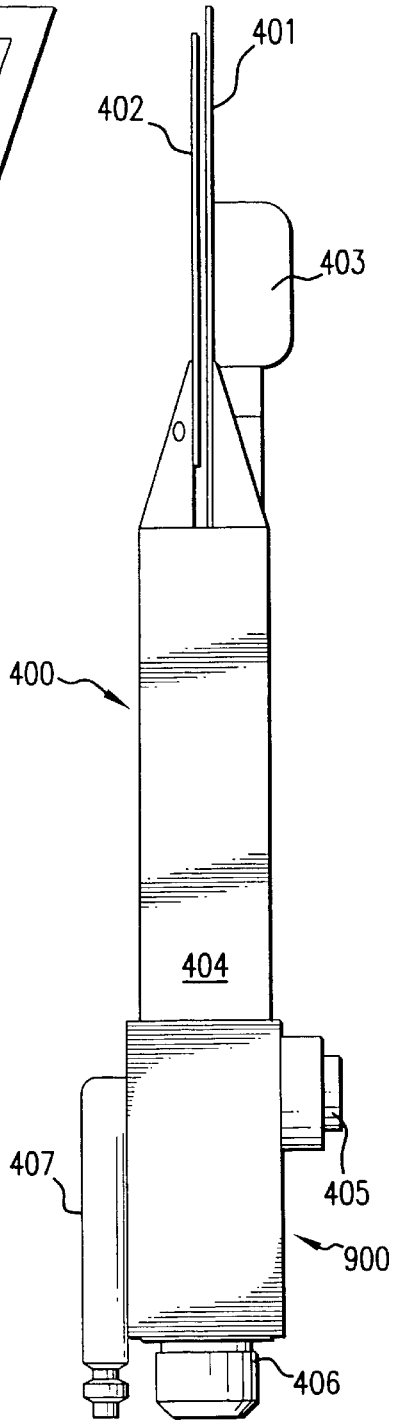

Referring to FIGS. 14 and 14*b*, the mud knife tool 400 may be used for dispensing and dressing coats of mud. The tool 400 may include a broad knife blade 401 and a smaller knife blade 402 mounted next to the broad knife blade 401. The tool may also have a handle 404, material and control line fittings 406 and 407, and a control button 405. The mud valve 403 is preferably activated when the blades 402 and 401 are flexed against the work surface while the trigger 405 is pulled.

Figure 21C:
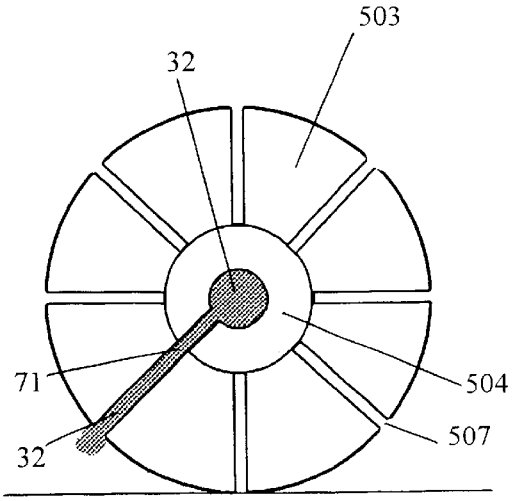
Figure 21D:
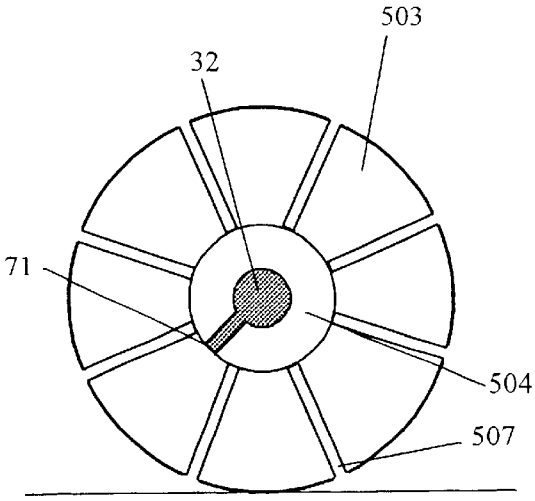

As illustrated in FIGS. 15*a*–15*b* and 21*a*–21*e*, the mud bead tool 500 may be used to measure a distance rolled and to apply a bead of mud for other tools. The tool 500 may include an elongated hollow body 506, material and control line fittings 501 and 502, a control button 505, and a wheel 503 on the distal end of the tool 500 that is rolled upon the work surface. As depicted in FIG. 21*c*, when the wheel 503 is rolled upon the work surface and the control button 505 is depressed, drywall material 32 preferably flows through the hollow axle 504, through axle material hole 71, and finally out the distal end of mud bead tool 500 through dispensing holes 507. As shown in FIG. 21 d, when axle material hole 71 is not aligned with one of dispensing holes 507, drywall material is preferably not extruded to the exterior surface of the wheel 503. Notably, material may be present on the outer surface of the wheel 503 even at times when it is not being extruded thereto, since this material may have been pumped to the outer surface of the wheel while the holes 71 and 507 were previously aligned.

As depicted in FIG. 21*a*, when wheel air hole 508 in wheel 503 is momentarily aligned with axle air hole 63 in hollow axle 504, air 65 is preferably released from mud bead tool 500, causing the bladder 5 to at least partially deflate, and drywall material 32 to flow into the pump 1 from the container. However, during periods when wheel air hole 508 and axle air hole 63 are not aligned, air is preferably not released through the end of mud bead tool 500. The resulting effect is periods of pressurization and quick periods of depressurization as the wheel 503 is rolled along a work surface. Thus, when there is but one radial air hole in each of axle 504 and wheel 503, as illustratively depicted in FIGS. 21*a* and 21*b*, air may be released only once per revolution of the wheel 503. The number of holes in axle 504 and wheel 503 may be varied, as appropriate for particular applications, though in preferred embodiments there is one axle air hole 63 and one wheel air hole 508. Similarly, multiple material holes 71 may be included in axle 504 in alternate embodiments of the instant invention, though in the preferred embodiment, there is but one material hole 71.

Figure 21E:
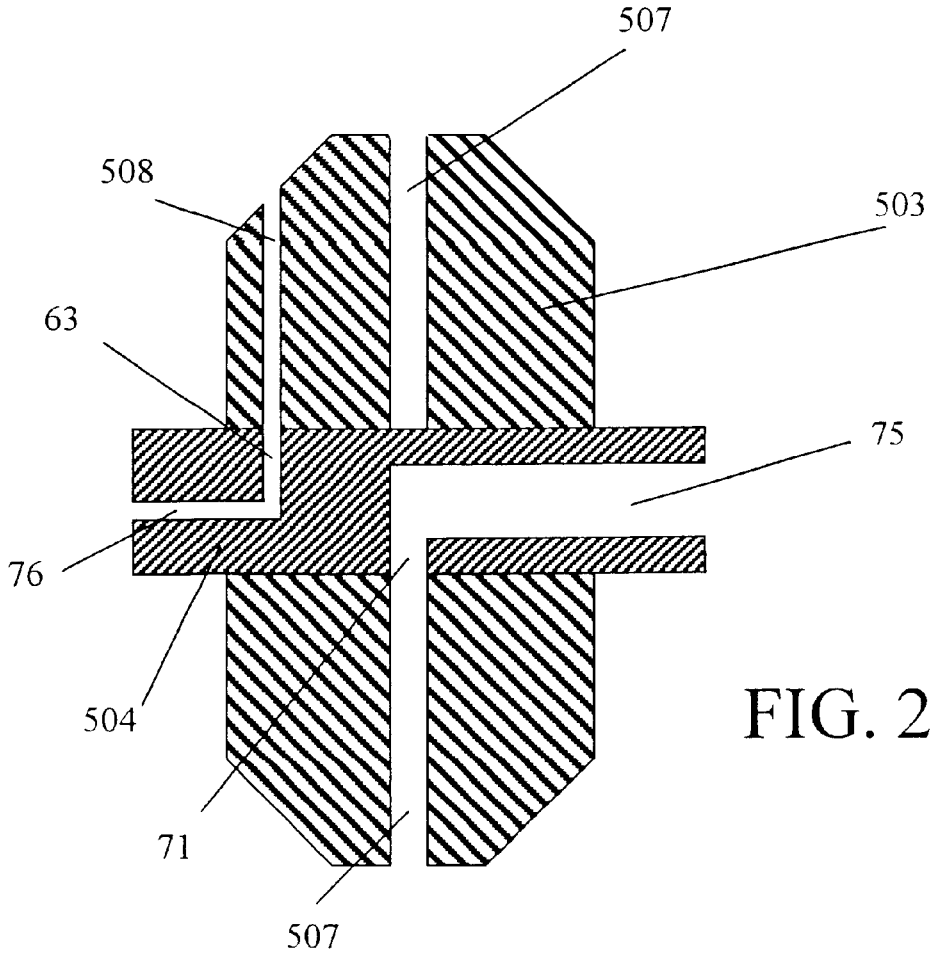

In preferred embodiments employing mud bead tool 500, drywall material 32 and air 65 simultaneously flow through hollow axle 504, however, in such preferred embodiments, the two substances are not mixed together. As depicted in FIG. 21*e*, hollow axle 504 preferably contains two interior cavities: an air cavity 76 and a material cavity 75. The air cavity 76 is preferably in fluid communication with the control line of tool 500 such that air may flow through the system, from the pump to the wheel air hole 508 or other air release mechanism (e.g., the control button 505 on the handle of the tool 500). Similarly, material cavity 75 is preferably in fluid communication with the material line of mud bead tool 500 such that drywall material 32 may flow through the system, from the pump to a dispensing hole 507.

A tape roll holder 509 that supports a roll of drywall tape 204 may be attached to the mud bead tool 500 to form a tape applicator tool. A pneumatic cutter 320 may also be attached to the mud bead tool 500.

In addition to the tools described above, the pump 1 may be used with tools manufactured by the Ames Tool Company. See FIG. 18*a*–*c* To employ these tools, the control line 15 may be replaced with an adapter button 800, and the material line 14 may be replaced with an adapter gooseneck 801 and an adapter box filler part 802.

In an alternative embodiment of the instant invention, as depicted in FIGS. 23–28, a pneumatic pressure relief valve may be included in the drywall taping and texture system as an air release mechanism. The pneumatic pressure relief valve utilizes flip flop pneumatic logic to regularly maintain two states: fully open and fully closed, corresponding to progression from inflated and deflated bladder states, respectively. In preferred embodiments, the transition between the open and closed states of the pneumatic pressure relief valve is fast, owing in part to the valve preferably including a flip flop effect clip 128. This fast, preferably spring-loaded transition may prevent the valve from freezing in a position between its two regular states, open and closed.

The pneumatic pressure relief valve may include a valve core 101, which is preferably a hollow plug fitted with one or more O-rings 103, about its outer circumference, to provide an airtight fit of the valve core within the valve hollow chamber 126. The lower end of the valve core stem 129 is preferably solid, though a small hole 130 may be bored there through to accommodate a steel leader 114. The valve core 101 may include at least one orifice 104 through its side, which allows air to vent from the interior of the bladder 127 to the exterior of the system when the valve is in the open position. Most preferably, the valve core 101 includes two or more such orifices 104 disposed opposite one another. In a most preferred embodiment, the valve core 101 also includes a circumferential steel ring or washer 105 about the exterior surface of its lower end that may interact with a flip flop effect clip 128.

The valve core 101 may be affixed to a closing tube or closing rod 109, which is preferably a hollow member that supports the valve core 101 by the valve core rod 107 and holds the valve core 101 in proper alignment within the hollow valve chamber 126. The interior of the valve core 101 is preferably in fluid communication with the atmosphere such that air may pass from the interior of the pump head, through the at least one orifice 104, when the valve core is in the open position. Once air reaches the interior of the pump head, it may travel through the closing tube 109 and the bladder attachment to the pump head part. The valve core 101, valve rod assembly is preferably slidably disposed within the hollow valve chamber 126, such that the valve may be readily opened by sliding the assembly 101/107 down, relative to the valve chamber 126, or closed by sliding the assembly 101/107 up, relative to the valve chamber 126.

A closing rod 109 may further be included within the bladder wall 127 of the pump. The lower end of the closing rod 109 is preferably secured to the lower bladder part 116, and the upper end preferably accommodating a shelf member 143 that is in mechanical contact with a closing spring 110. Most preferably, closing spring 110 forcefully contacts the valve core 101 only upon closing the discharge of air from the bladder 5. A leader attachment 111 may be secured to the closing rod 109 near the lower end of the closing rod 109. A spring attachment cable 112 may connect the leader attachment 111 to an opening spring 113, and a steel leader 114 may further connect the opening spring 113 to the valve rod 107 and thus the valve core 101. The steel leader 114 may pass through the interior of the closing spring 110, and may further pass through a small hole 106 bored through the lower end of the valve core rod 109 to affix the steel leader 114 thereto.

A flip-flop effect clip 128 may be included in the pneumatic pressure relief valve. The flip flop effect clip 128 may include both an upper groove 141*a* and a lower groove 141*b* configured to receive a single corresponding circumferential ring 148 disposed on the exterior surface of the valve core 101. When the pneumatic pressure relief valve is in the fully open position, the circumferential ring 148 preferably resides in the lower groove 141*b*. When the pneumatic pressure relief valve is in the fully closed position, the circumferential ring 148 preferably resides in the upper groove 141*a*. The flip flop effect clip 128 may aid in the transition of the pneumatic pressure relief valve between valve states (i.e., from the fully closed to the fully open position, and the reverse), by increasing the level of force required to effect this change. The clip positions resist change until spring tension becomes unstoppable and the clip flips back to allow a valve state change.

For example, to effect a transition in valve state from fully open to fully closed, not only must the force of air pressure flowing through the valve be overcome, but the friction force provided by the interlocking of the lower groove 141*b*/circumferential ring 148 must be overcome as well. This heightened force requirement may equate to a greater initial velocity of the valve core 101/valve stem 107 assembly relative to the valve chamber 126 upon closure of the valve. This initial velocity may be further increased by the inclusion of a closing spring 110. The energy stored in the closing spring 110 will increase as the spring is compressed between the assembly. 101/107 and the rigid closing tube 109 during deflation of the bladder 5. Thus, when the assembly 101/107 begins to close, the energy stored in closing spring 110 may translate to faster movement of the assembly 101/107. The greater velocity preferably results in a reduced likelihood of the valve reaching only a partially closed state.

Conversely, by way of example, to effect a transition in valve state from fully closed to fully open, the interlocking force of the upper groove 141*a*/circumferential ring 143 must be overcome in conjunction with the force of elevated air pressure inside the bladder 5 relative to atmospheric pressure. Furthermore, an opening spring 113 may be included, and the energy stored in the opening spring 113 may increase as the spring is stretched between the closed assembly 101/107 and the leader attachment 111 during inflation of the bladder 127. Thus, when the assembly 101/107 begins to open, the energy stored in opening spring 113 may translate to increased movement of the assembly 101/107. This heightened force requirement and inclusion of an opening spring 113 may result in a greater initial velocity of the assembly 101/107 relative to the valve chamber 126 upon opening, preferably resulting in a reduced likelihood of the valve reaching only a partially open state.

To accommodate the pneumatic pressure relief valve, a valve stem rod 107 and a series of interlocking manifolds is preferably included in the pump head housing. The valve stem rod 107 and closing tube may be included to provide an means for the pneumatic pressure relief valve and the elements that operate with the valve that preferably reside within the bladder wall 127 (i.e., spring attachment cable 112, opening spring 113, steel leader 112, closing rod 109, and closing spring 110) to function together without sacrificing the preferred airtight nature of the bladder 5. As such, the valve rod preferably reaches from within the bladder 5 at its lower end to within the interlocking manifolds at its upper end, and is most preferably mounted to the pump by way of the bladder attachment to the pump head part 115 with an adjustable hose band. The inclusion of interlocking manifolds may be desirable as the manifolds may be cast separately and combined to form the single pump head cartridge unit. In a most preferred embodiment, there are three interlocking manifolds: a valve manifold 122, a cartridge manifold 121, and a cap manifold 120. The interlocking manifolds may connect to one another by any appropriate means, including snap fittings or simple male-female friction fittings or glue, and most preferably prevent the mixing of drywall material with the compressed air that drives the system. The lower end of the system may be constructed as in other embodiments of the instant invention (i.e., a lower valve including a seat 118 with an orifice 119 and a member 117 that mates therewith to prevent backflow of drywall material). The member may have a soft washer 145 mounted thereon to facilitate a proper fluid seal with the beveled upper edge 144 of the seats 131 and 118.

A fluid valve manifold 122 may include a valve that is similar to those described in alternate embodiments above (i.e., an upper valve including a seat 131 with an orifice 132 and a member 133 that mates therewith to prevent backflow of drywall material). However, in alternative embodiments, the valve may include other components, such as flappers or the like. A most preferred valve includes a seat 131 and the member 133 is a plug.

A cartridge manifold 121 may interlock on its lower end with a valve manifold 122 and on its upper end with a cap manifold 120. Most preferably, the cartridge manifold 121 has an O-ring 123 disposed about its outer circumference to create a seal between the cartridge manifold and the interior of the hollow pump housing. This may prevent the leakage of drywall material along the outer portion of the cartridge manifold 121 and, subsequently, the top of the pump.

Figure 32:
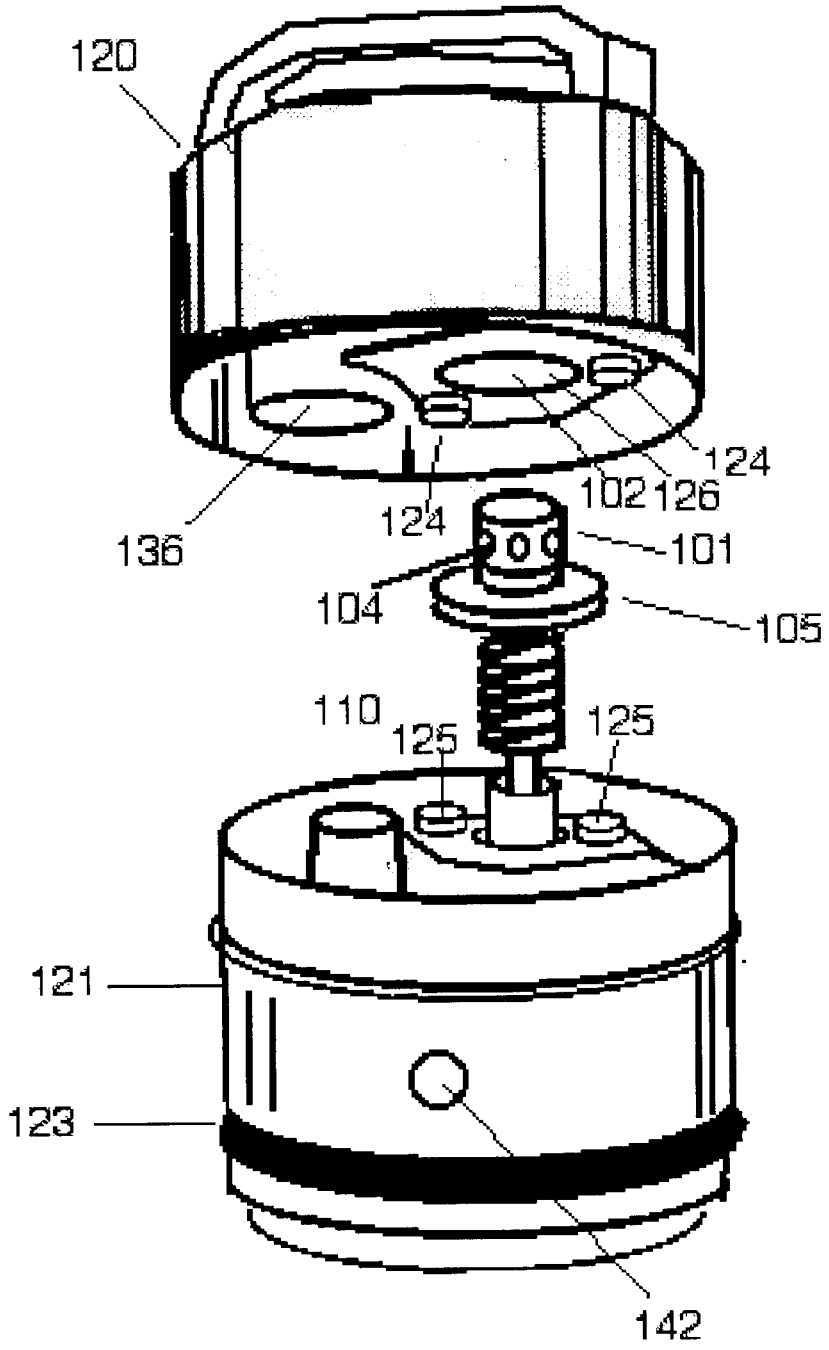
FIG. 32 is a drawing of the under side of the cap manifold as it attaches to the cartridge manifold showing the valve core assembly as it inserts into the valve cavity.

A cap manifold, see FIG. 32, 120 may include an air chamber 148 that provides gaseous communication among an air intake fitting 134, a control line 13, the bladder 5 and the local atmosphere via the valve. See FIG. 5*a*–FIG. 5*c*. The control line 13 may be connected to a tool, as discussed above. Similarly, the cap manifold 120 may include a material line fitting 136 that connects to a material line that is also connected to a tool, as discussed above. A snorkel hose 137 may be connected to the exterior valve outlet 138 such that the entire pump may be submerged in drywall material without risk of either introducing drywall material into the valve or percolating air through the material upon release of such air from the valve outlet 138.

Figure 30:
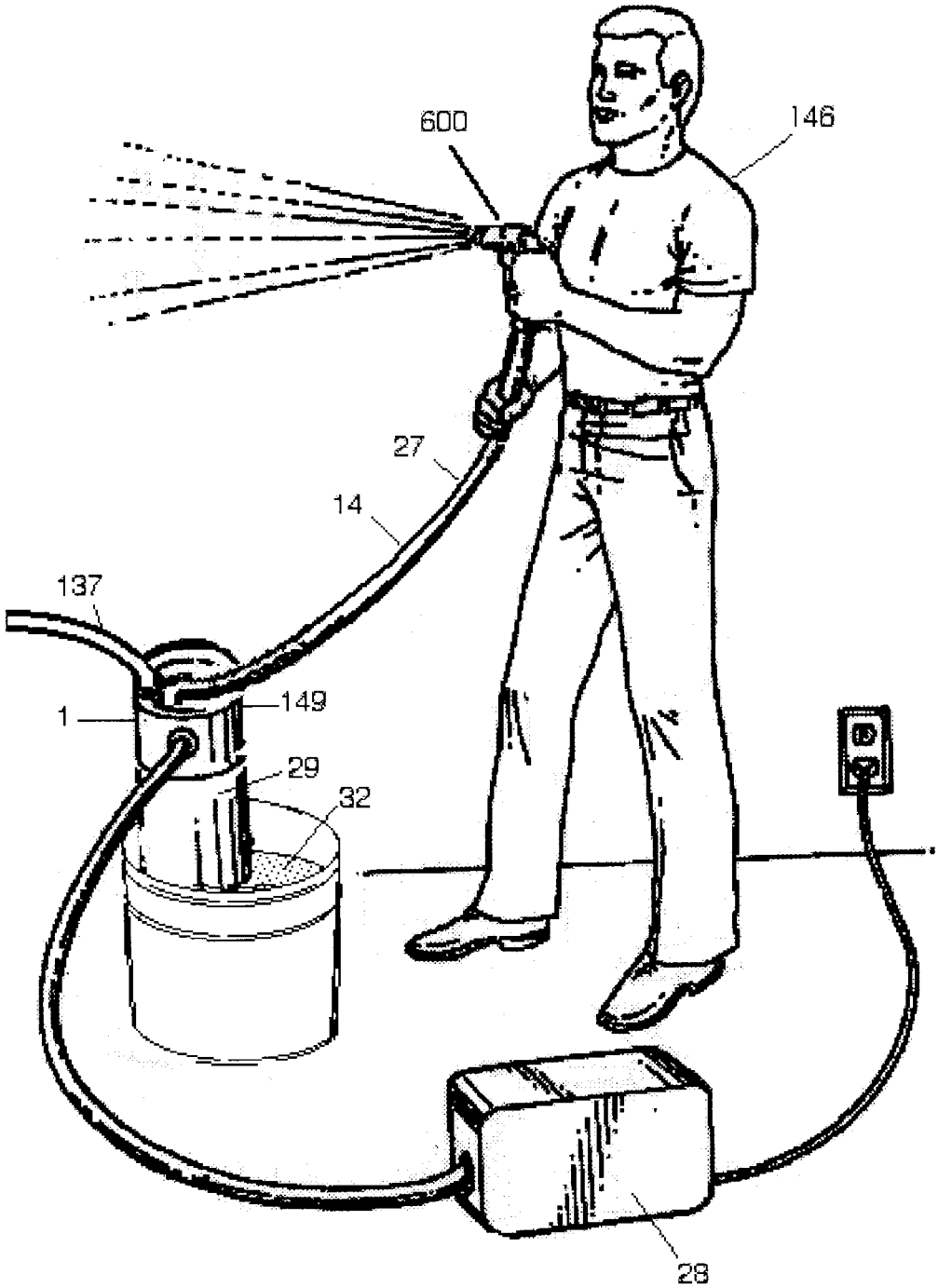
FIG. 30 is a drawing of the pump in use showing an operator and a small compressor

Embodiments of the present invention are directed to an improved drywall taping and texture system as shown in FIG. 30, wherein an improved bladder pump is employed which obviates, for practical purposes, the limitations in prior systems. In one aspect, an automatic bladder pump allows mud on demand to make drywall taping and texturing easier. Additionally, a pneumatic, automatic flip flop logic switching system may include an air-release mechanism that operates pneumatically, as opposed to electronically or mechanically, with a magnetic valve core assembly.

The ideal function for a bladder pump is to have the bladder fill relatively slowly but discharge quickly to allow a more-or-less continuous flow of fluid. Flexible material hoses tend to expand under pressure creating an expansion chamber which allows the material to continue to flow, when the upper material valve closes briefly to allow the pump to refill with material, thus smoothing out surges in the material flow. When filling with air, the bladder displaces fluid trapped within the space between upper and lower one-way fluid valves and forces it through the upper one way valve exiting the pump. As the bladder quickly discharges air from a hyper inflated state, the bladder's resilient reduction to its original size creates a partial vacuum which refills the pump body with fluid vacuumed upwards through the lower fluid valve. When a control valve is sensitive to, and controlled by, the bladder state, the pump operates at maximum cycle speed and efficiency. Most current bladder pumps use expensive, often inefficient, time-delay devices to fill and discharge the bladder, which is a major complication and disadvantage of prior bladder pumps.

In a preferred embodiment, the control system for a bladder pump may be a device that is powered, sequentially in each cycle, by a number of forces, including: the effect of a set of strong magnets opposing an alternative set of strong magnets; the energy exerted between two distal points on the bladder wall; powered first by bladder expansion by way of an air compressor introducing more air into the system than is being discharged by the system, by the elastic memory action of the rubber bladder, and also a set of opposing springs which alternately store and release kinetic energy.

Energy to operate the control system is taken from the power required to compress air, which is used to expand the bladder. Some energy is taken from the forceful contraction of the bladder reducing in size from a hyper inflated state when a control valve or control line is opened to the atmosphere. In both expansion and contraction of the bladder, some energy is saved by opposing springs which allow a sudden release of kinetic energy that flips the pneumatic control valve open or jerks it closed to create a fully mechanical flip flop air release control mechanism.

This system utilizes a device including a continuous air supply feeding into a manifold cavity and a trapped sliding valve core, wherein the latter is capable of sealing automatically when the bladder state becomes deflated and thus ready to be refilled, and flipping back open to discharge air as the bladder reaches the set maximum inflation limit. When this series of actions is repeated, a continuous cycle of inflation and deflation is created. The cycle is managed by an automatic bladder pump control system that is free of electronics in this mode. The pump in this preferred embodiment uses only compressed air to operate.

Figure 28:
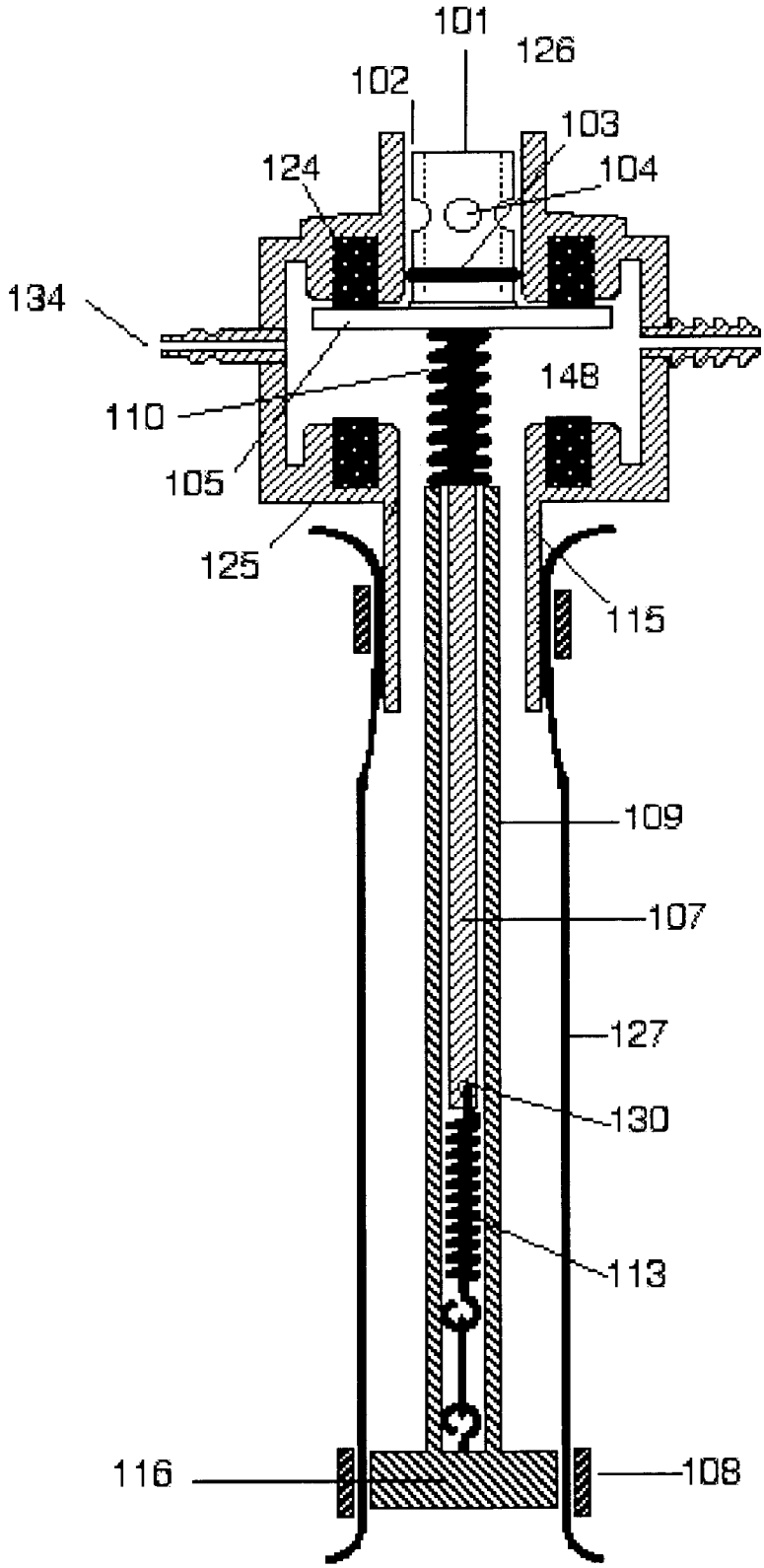
FIG. 28 is a perspective view of a pneumatic pressure relief valve in accordance with the pump depicted in FIGS. 26 and 27*a*–*e*.

Referring to FIG. 28, the sliding pneumatic valve core 101, is attached to a heavy steel washer 105, which is suspended between two sets of strong permanent magnets, an upper set of magnets 124, mounted adjacent to the valve core chamber 102, magnets each set in small cavities in the cap manifold and an opposing set of magnets 125, mounted below the valve chamber which are also set in the cartridge manifold part which also has such small cavities for magnets to be mounted or glued in place. The opposing sets of magnets 124 and 125, tend to decisively select either a fully open or fully closed valve state by both pulling upon the steel washer 105 mounted to the valve core 101. The magnets also tend to resist the valve core 101 changing position while at rest, until a sufficient carrying force is gathered by stressed springs 110 and 113, to cleanly push the valve core 101 all the way to engage the other set of magnets, which are also pulling the valve core 101 to firmly capture it.

The trapped valve core 101 is aligned by the valve core chamber 102 and by a valve core rod sliding within a rigid closing tube member 109, the tube 109 being attached to a distal point on the bladder whereby, as the discharged bladder 5, elastically reduces in size, the bladder shrinkage forces the rigid closing rod 109, to move upwards against a closing spring 110, and suddenly push the valve core 101 into a closed position. The bladder 5, then begins to inflate. When fully inflated to the flip open point, the enlarging bladder 5 pulls the closing cable to pull the valve core 101 towards the open position which causes it to flip back to the open position, thus creating a continuous cycle of inflation and deflation.

Remote control of the pump is accomplished at the distal end of a control line hose 15. An operator can start and stop the pump action at any time by using a pneumatic trigger 405, or button 50, that normally releases air into the atmosphere or selectively holds air in the control line hose 15, which is interconnected to the interior of the pump head assembly 149.

In a second embodiment, a similar flip flop effect is created by using electrical reed switches 150, controlled by a magnet 151, mounted on the rubber bladder wall 127, using an electric current to open or close an electrically actuated pneumatic control valve 152, to operate the bladder pump, 1. Here, two reed switches 150 are disposed as bladder condition sensors, one of which is mounted on the interior surface of the pump body cylindrical housing 29, and the other reed switch is mounted at the inside center of the bladder, 5. One or more magnet(s) are mounted on the rubber bladder wall 127, which align with the opposing sensors, to act in combination as sensors and a switch activator. A latching electrical relay 153, which is hooked up with wires to an electrical power supply 154. Both magnetic reed switches 150, are wired to control power to the relay's actuation coil. The relay 153, is also wired to a normally closed electrically powered pneumatic solenoid valve 152,, which parts in combination, create a flip flop effect, which controls a bladder pump's action. The remote control action of an operator 146, can start or stop the pump action at any time by way of a trigger 405, or button 50, to distally open or close the control line hose 15, to release compressed air into the atmosphere. Control may also be effected by using an electrical control switch 155, that would also open the electrical solenoid valve 152, upon the user's demand.

In a third embodiment, a pressure relief valve 25 that is interconnected to the air way 18, within the pump head assembly 149, and the outer atmosphere, which pressure release valve 25 may be dampened by an added spring 30, to close more slowly to allow more air to discharge before resetting, thus to again fill the bladder Ideally a two stage relief valve (not shown), may open at a high pressure limit and close at low pressure limit is mounted at the same position as 25. Should the control line hose 15, be opened by the operator 146, remotely, the default condition is that the bladder 5, deflates and is ready to refill with air and again pump fluid material 32, as soon as the control line hose 15 is closed.

An additional embodiment is that the control valve core 101 is held in either of two positions by way of a spring loaded clip 22 mounted near the control valve chamber, 102. The resilient clips hold the valve core by a steel washer mounted on the valve core, at fully open and at fully closed until sufficient force in the closing and opening springs builds up to effect a flip open or closed. FIG. 34 a depicts the valve clip arrangement, here described, showing the valve closed. FIG. 34*b* shows the same valve in the closed position.

Another embodiment of the valve is when a spring or pair of springs is set to rotate to various vectors to favor a fully open or fully closed position of the valve core where the spring is oriented to follow the moving valve core. See FIG. 34*c* and FIG. 34*d*. One end of the spring is loosely secured to the valve core cavity and the other end of the springs are loosely attached to the valve core. The compression springs are therefore less compressed when the valve core is fully open or fully closed. This approach works in conjunction with the closing spring and opening spring device of the preferred embodiment which carries the valve core through the full movement of the core. This embodiment is shown in FIG. 34*c* closed and FIG. 34*d* in the open position.

Another embodiment uses groove on the valve core wall that traps a cylindrical ring member is shown in FIG. 34*e* in the closed position and in FIG. 34*f* in the open position. The O rings on the valve core act as the cylindrical ring to catch on grooves in the valve cylinder wall. While this is not the preferred embodiment, this mode can be made to work with the closing spring and opening spring as previously described, offer sufficient power to effect flipping the valve to the opposite position.

The preferred embodiment of the valve core switching device is opposing magnets. FIG. 34*g* and FIG. 34*h* show the preferred embodiment using strong magnets that oppose a second set of strong magnets pulling a steel washer mounted to the trapped sliding valve core. FIG. 34*g* shows the valve closed and FIG. 34*h* shows the valve open.

According to a preferred embodiment of the present invention, a drywall taping and texture system for pumping drywall mastic material from a container filled with the drywall mastic material to a work surface includes a pump housing 29, a small air compressor 28, or air supply to operate the pump 1, interchangeable tools for applying and dressing the drywall mastic material upon the work surface, a hose set consisting of; a material line hose, 14 and pump control line hose 15, a third hose 158, is a high pressure air supply from a second larger air compressor (also not shown) which is required for some tools, an inflatable bladder 5 (e.g., made of rubber or similar elastic material 127), a pneumatic pressure control system, and an airway 18.

It is noted that one large air compressor may be used with a regulator to supply both a small flow of compressed air to run the pump and the remaining larger air flow is used for the tools that require a lot of air.

The pump housing 29, is either partially or fully immersed in a container filled with slightly thinned drywall mastic material 32, and the small air compressor's 28, air supply hose is, connected to the pump head assembly 149.

Figure 31:
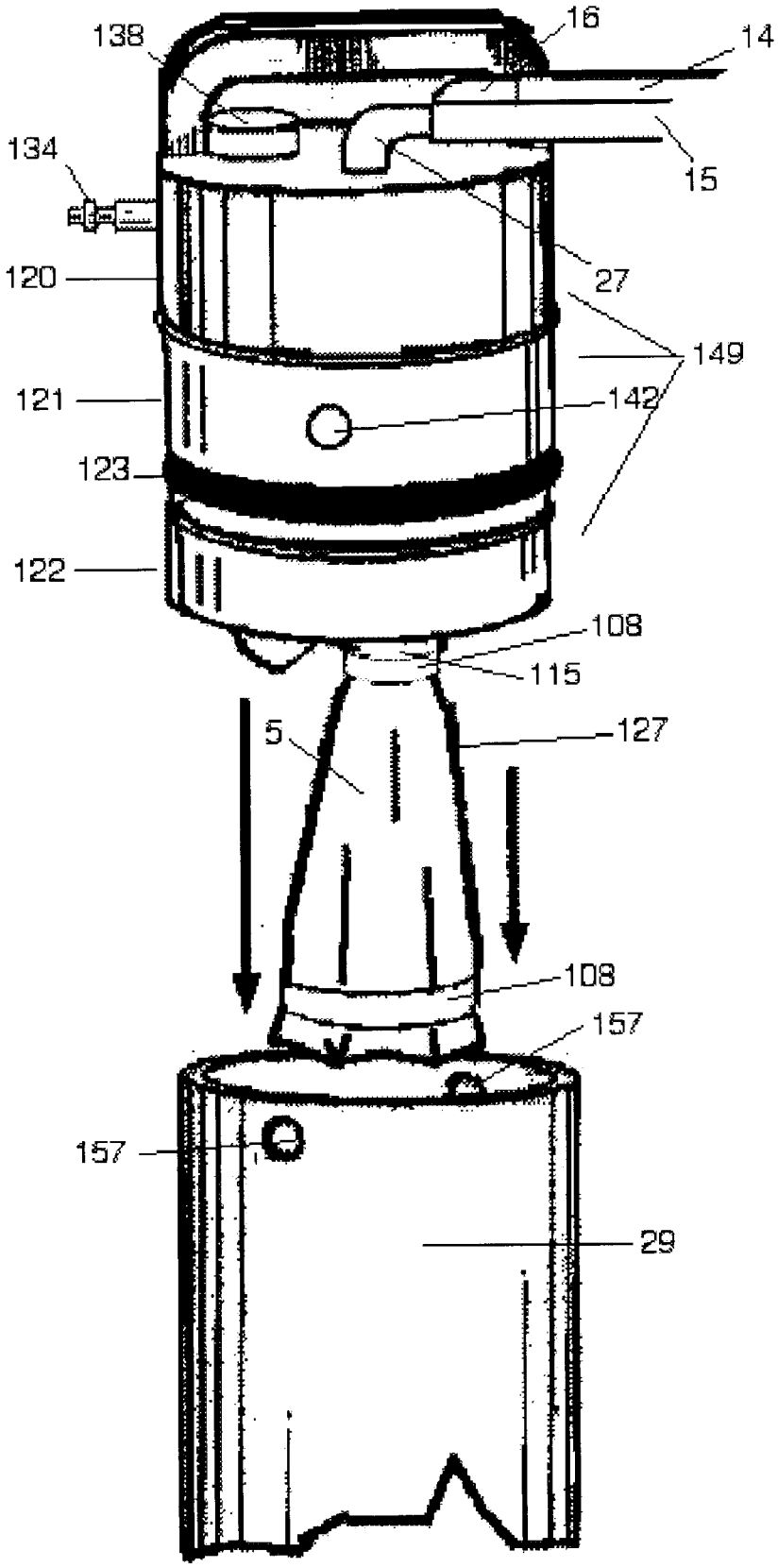
FIG. 31 is a perspective drawing of a manifold cartridge with bladder assembly being inserted into the hollow cavity of the pump.

The bladder 5, and pump head assembly 149 may be inserted (as a removable cartridge) into a the hollow cylindrical pump housing 29, which housing includes the lower material check valve 118 and intake screen 9. See FIG. 31. The pump head assembly 149, supports an "O" ring 123, that allows an air tight pneumatic fit with the interior wall of the pump housing 29. A bolt 139,may be passed through two adjacent holes 157, in the pump housing 29 and also pass through a matching passage 142, in the cartridge manifold 121 section of the pump head 149, passage 142 is located above the large "O" ring 123, to secure the pump head and bladder assembly securely in place during use. A butterfly retaining nut 140, holding the bolt 139, is removed to allow the bolt 139, to be extracted by the user to allow the bladder and pump head assembly to be removed as a single cartridge unit for cleaning.

The material hose 14, control line hose 15, and a separate high pressure air line 158 are all connected between the pump head and the various tools such that there is material and air flow communication, respectively, therebetween. The bladder 5 is mounted within the pump housing 29 between upper 131 and lower 118, one-way fluid valves for controlling the flow of the drywall mastic material 32. The airway 18, connects the air compressor 28, the control line 15, the bladder 5, and the pneumatic pressure relief valve, such that there is continuous air flow communication therebetween.

When the pneumatic control valve is closed and the control line hose is open to the atmosphere, the pump is in the ready mode. The operator then closes the control line orifice on any attached tool, which orifice is normally open and continuously releases air into the atmosphere. This works as a trigger mechanism that is pulled to stop the outflow of air at the tool. As a result, the bladder inflates, such that drywall mastic material in the sealed pump housing is pumped through the upper one-way valve, through the material line, and through any hollow dressing tool to the work surface. When the pneumatic pressure relief valve flips opens automatically at the preset fill limit, or when the operator opens the control line at a distal tool, the bladder deflates such that drywall mastic material in the container is pumped upwards through the lower valve into the pump housing by way of a partial vacuum that causes the bottom material valve to open and the upper material valve to close.

Part of the air release mechanism consists of a stiff hollow tube 109, that is attached at one distal point within the bladder 5, and extends through the interior of the bladder to a proximal point into the head of the pump. See FIG. 26*a* and FIG. 26*b*. A valve core rod 107 slides freely inside the hollow tube 109, keeping both rod and tube in substantial alignment. An air release valve core 101, is mounted on the top end of the rod 107. The valve core's opposing dual hold and release mechanism may be any of the following: the valve core has a heavy steel washer 105 mounted under it which is attracted magnetically to two opposing sets of strong magnets 124 and 125, mounted within the head of the pump, there may be resilient clips 128, grooves 141 and ridges 143, a one 25 or two stage air release valve 156, an electro-pneumatic valve 152, or vector changing spring(s) see FIGS. 34*c* and 34*d*.

As air is constantly introduced into the pump head 149, when the air release mechanism closes, the bladder 5, hyper-inflates such that drywall mastic material 32 in the pump housing 29 is pumped through the upper valve 131, the material line 14, and an attached tool to the work surface. When the air release mechanism on any tool opens, the bladder 5 deflates such that drywall mastic material 32, in the container is pumped through the lower valve 118, into the pump housing 29, thus refilling it. The bladder 5, then returns to a ready state.

Figure 16A:
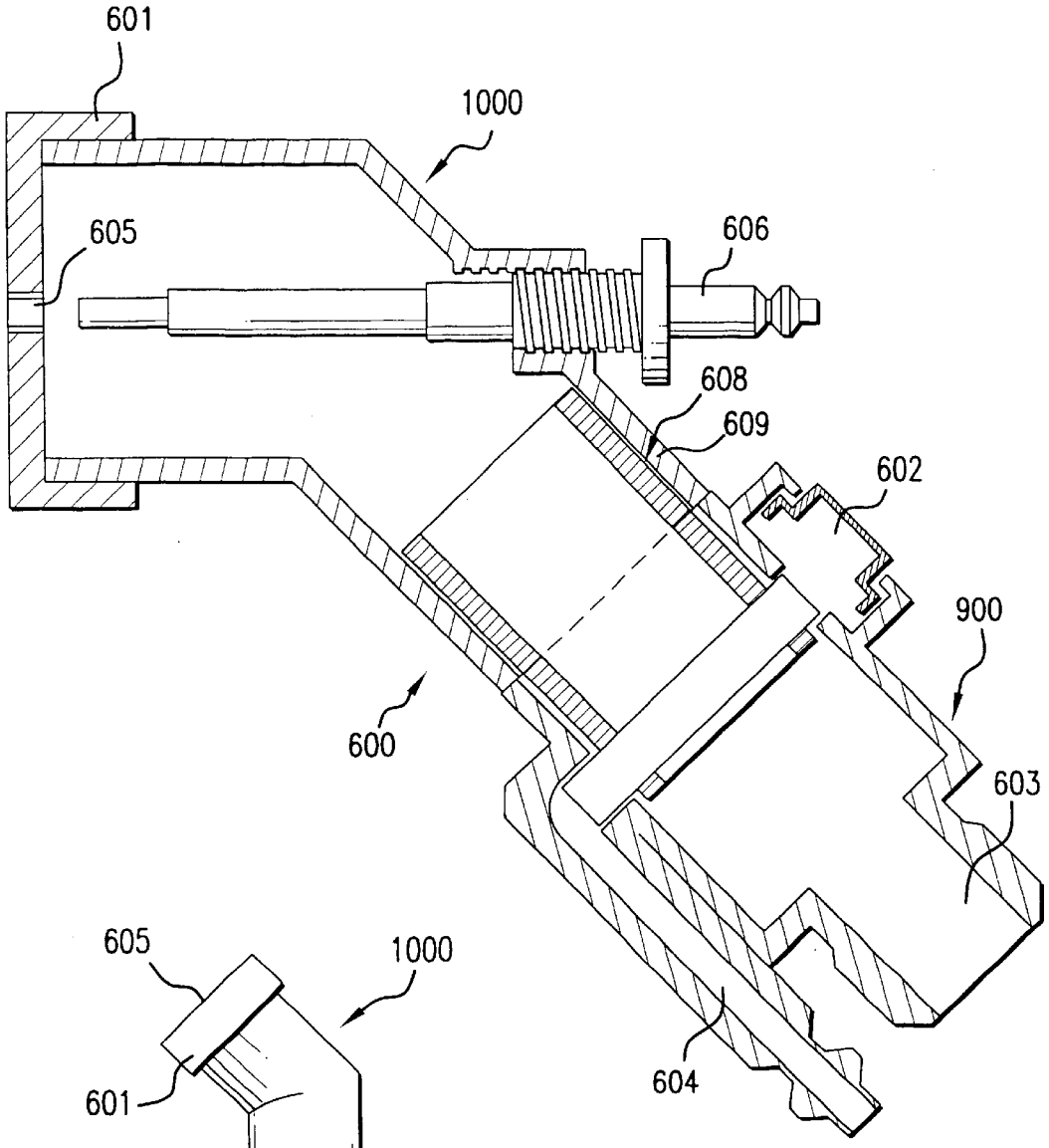
FIGS. 16*a* and 16*b* are cross-sectional and perspective views of a wall texture spray tool in accordance with an embodiment of the present invention.
Figure 16B:
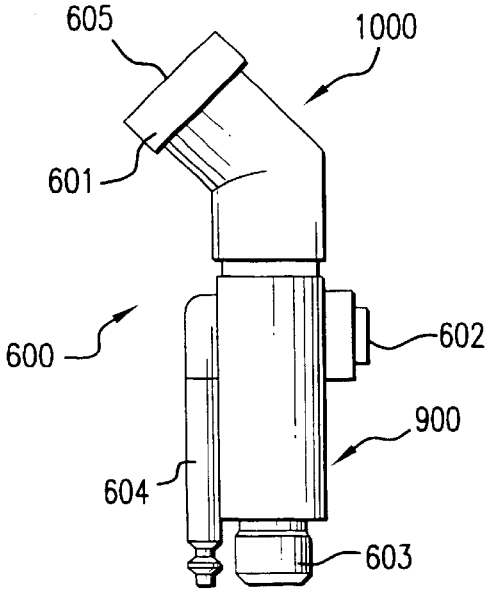
Figure 17:
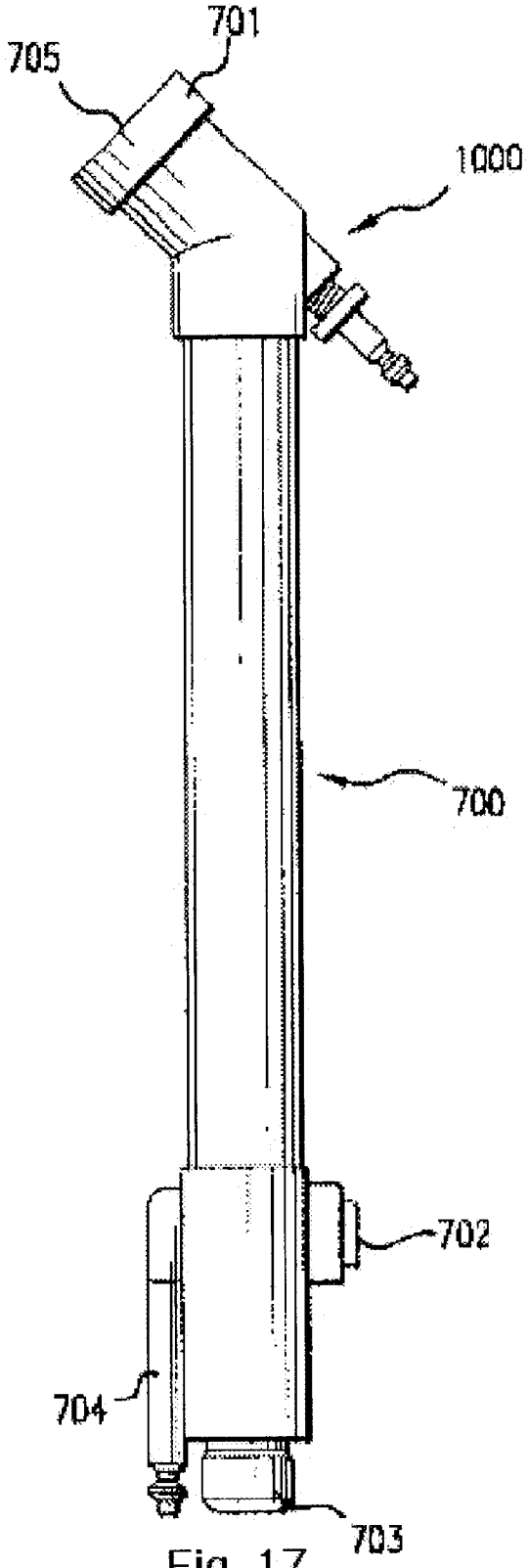
FIGS. 17 is a perspective view of an acoustic texture spray tool in accordance with an embodiment of the present invention.
Figures 35B, 35C:
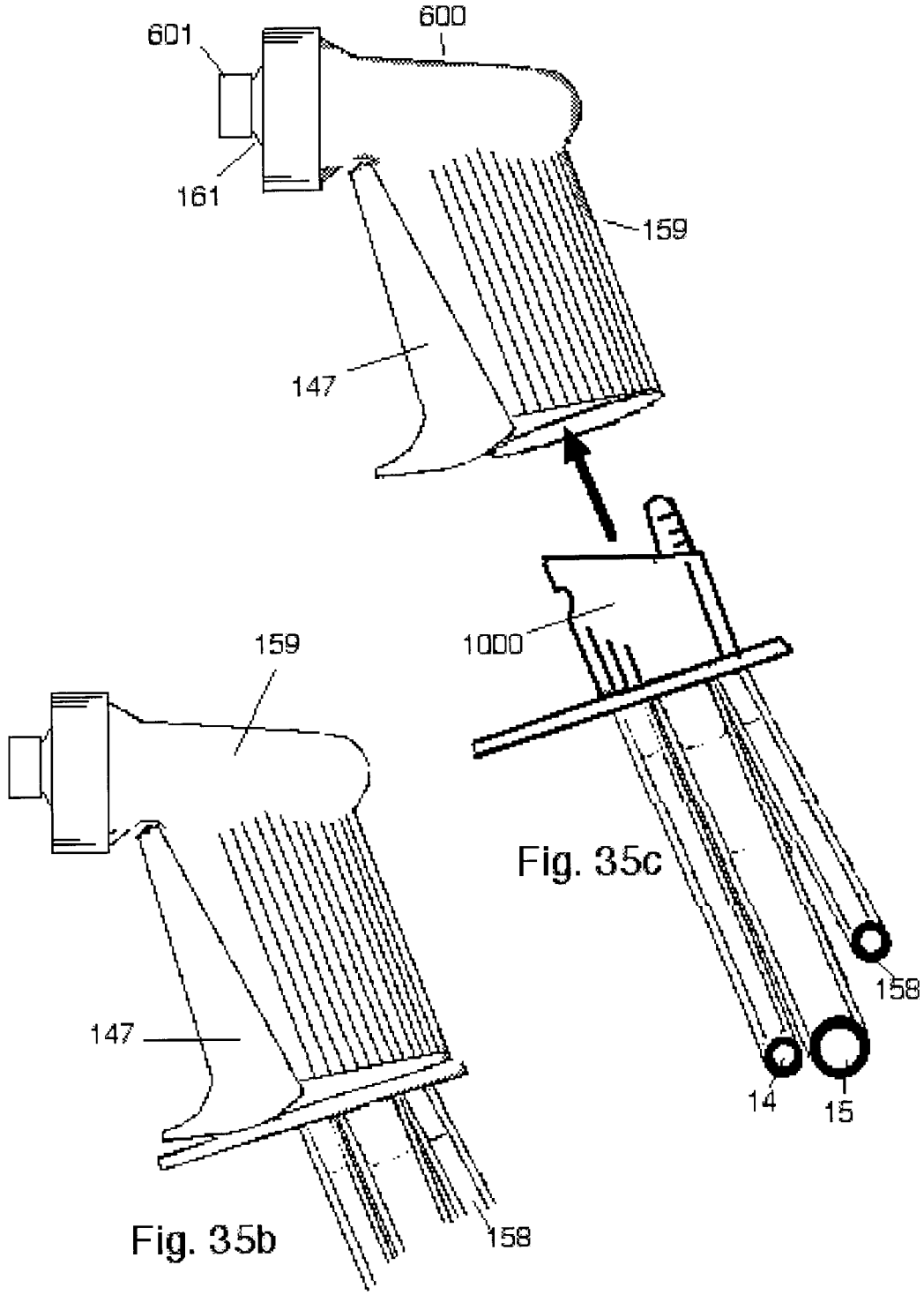
FIG. 35*b* is a perspective view of the gun with universal hose connector in place.
FIG. 35*c* shows a universal hose connector being inserted into the hollow gun body and the hose set.

FIGS. 19*a–e* show a common connection system for texture guns using the system. FIG. 16*a* and 16*b* show a gun with a button 50 using the universal connection system of FIG. 19. FIG. 17 shows a ceiling texture gun also using the universal connection system of FIG. 19. FIG. 35*a*, FIG. 35*b* and FIG. 35*c* show another texture gun design that includes a trigger 147, that selectively plugs the control line 15, to manage the pump system. Both of the above gun designs also provide for a material line 14 attachment and can be connected to a high pressure air line 158, for proper atomization of sprayed textures. In particular embodiments of the present invention, all the various drywall mud dressing tools further include a pneumatic button 50, or trigger 147, for remotely controlling the pump. The air release orifice on an attached tool is an extension of the air release orifice of the control line hose which may extend through the universal hose fitting 900, of the drywall system.

In other embodiments of the present invention, each of the upper 132 and lower valves 118, for controlling the flow of the fluid drywall mastic material 32,(which may include particulate matter in suspension) includes a raised beveled rim 144, on the seat lip, defining an orifice 119 and 132, through which the drywall mastic material flows. See FIG. 29. The orifice in each of the valve seats selectively accepts a plug member 116 and 132, having a matching flat surface (which flat surface may be covered with a soft washer 145) for sealing the flow of the fluid drywall mastic material through the orifice. When the member 116 or 132 mates with a seat, a seal is formed to block the flow of the drywall mastic material backwards through the orifice. When the member moves in a direction transverse to the seat, flow of the drywall mastic material through the orifice is allowed.

Figure 29:
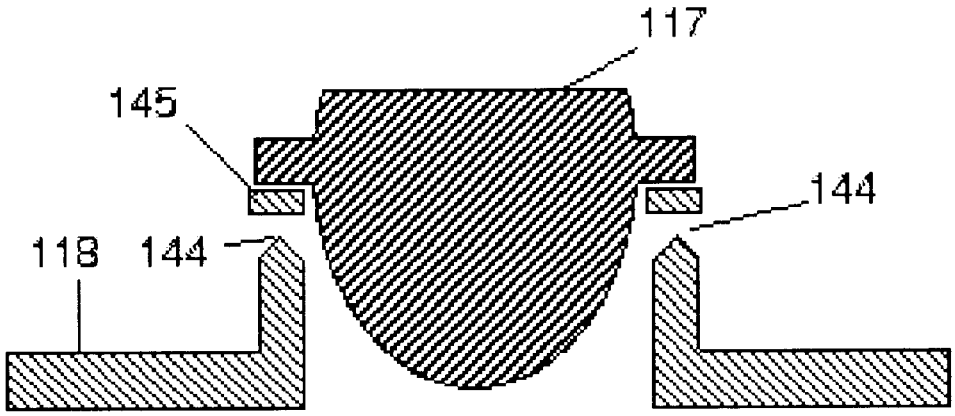
FIG. 29 is a fluid valve in accordance with an embodiment of the present invention.

In a preferred embodiment of the invention, as depicted in FIG. 29, a valve plug 117 mates with a seat 118 to block an orifice 119, and a ridge 144 is included on the seat 118. The ridge 144 may facilitate the movement of particles suspended in the drywall material to either side of the ridge 144 upon closing of the valve, thus preventing the plug 117 from improperly mating with the seat 118 (i.e., preventing particles from being lodged between the plug 117 and the seat 118). A soft washer 145 may be mounted on the plug 117 In yet other embodiments of the present invention, the pump housing further includes a screen mounted at the bottom thereof for filtering excessively large particles out of the drywall mastic material or texture which might plug the material line.

A set of interchangeable drywall texture spray application guns and drywall tape finishing tools may be alternatively attached to the universal hose fitting 1000, and used with the drywall taping and texture system. A second industrial design for a universal tool fitting is shown at FIG. 35*a*–FIG. 35*c*. Such tools include: a paper tape applicator tool with a pneumatic tape cutter feature for applying muddy drywall tape to a drywall work surface; a wand applicator tool for putting a bead of mud down on flat seams and in corners; a corner finishing tool attachment for placing a bead of mud upon an inside corner seam while glazing mud upon a strip of paper tape; a mud knife tool for dispensing and dressing coats of mud on flat surface seams; a box tool also for coating flat seams; a wall texture spray gun 600, with an adjustable nozzle; and an acoustic texture spray tool head, a universal extension handle that supports various attachments. A set of adapter parts that allow use of the pump with Ames tools may also be attached to and filled with the pump.

In another embodiment of the present invention, a drywall taping and texture system for pumping drywall mastic material from a container filled with the drywall mastic material to a work surface includes a pump housing, a tool for applying the drywall mastic material to the work surface, material and control lines, an inflatable bladder, an inflation sensor, a control unit, a pneumatic solenoid control valve and an air compressor. The pump housing is either partially or fully immersed in the container filled with the drywall mastic material. The material and control lines are connected between the pump housing and the tool such that there is material and air flow communication, respectively, therebetween. The bladder is mounted within the pump housing between upper and lower valves for controlling the flow of the drywall mastic material;

Part of the inflation sensor is coupled to the bladder for determining when the bladder is inflated and when the bladder is deflated. The air compressor is connected to the control line and the bladder such that there is flow communication therebetween. When the inflation sensor determines that the bladder is fully deflated, the air release solenoid is activated to close and the bladder inflates such that drywall mastic material in the pump housing is pumped through the upper valve, the material line, and the tool to the work surface. When the inflation sensor determines that the bladder is fully inflated, the air valve is opened and the bladder deflates such that drywall mastic material in the container flows through the lower valve into the pump housing.

Figure 33:
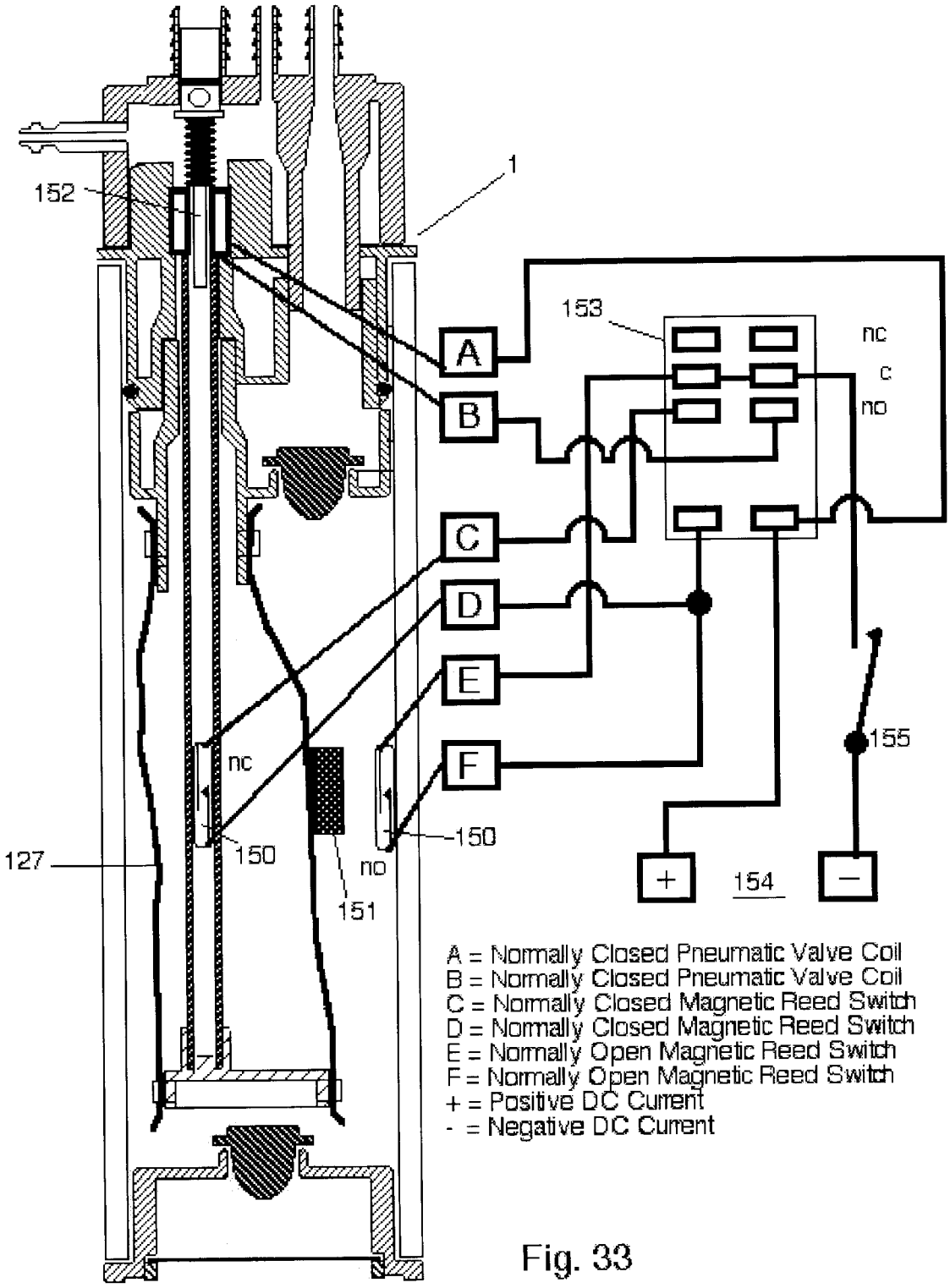
FIG. 33 is a drawing of a bladder pump that uses electrical sensors and a magnet on the bladder to operate, with a schematic for the sensors, electro-pneumatic valve, latching relay and power input.

A further possible embodiment is a system using two magnetic sensors which control an electrical relay, which controls a pneumatic valve, which controls the pump. See FIG. 33. One, normally closed, magnetic reed switch 150 is mounted in the center of the bladder to sense a magnet mounted on the bladder when the bladder is discharged, and a second, normally open, magnetic reed switch is mounted on the pump cylinder wall to sense the bladder being full. The relay is wired to trip a pneumatic valve open when the bladder wall approaches pump wall and to re-close when the bladder wall reaches a point near the center of the bladder. The control line will reset the bladder to the ready and discharged state at any time.

When short bursts of material are required, the operator closes the control line but not long enough to reach the fill limit and trigger automatic discharge. This is the logic for "Burst Mode" (Chart No. 1 below). On the other hand, when the operator wants a continuous cycle for a more or less steady flow of fluid material he closes the control line and keeps in closed until he opens the control line to cause the bladder to reset to Ready at any point in the cycle. This is "Auto Cycle Mode" (Chart No. 2 below). Drawing numbers in the first column refer to the drawings 27*a–e*.

Flow Chart of Pneumatic Flip Flop
Logic Control System - Chart No. 1

| Drawing # | Cycle # | Bladder State | Valve | Control Line | Logic | Fluid Flow |
|---|---|---|---|---|---|---|
| 27a | 1 | Ready | Closed | Open | Static Closed | No |
| 27b | 2 | Fills | Closed | Closed | Static Closed | Yes |
| 27c | 3 | Fill to Limit | Closed | Closed | Static Closed | Yes |
| 27b | 3 | Disc/control | Closed | Open | Static Closed | Yes |
| 27a | 1 | Ready | Closed | Open | Static Closed | No |

Flow Chart of Pneumatic Flip Flop
Logic Control System - Chart No. 2

| Drawing # | Cycle # | Bladder State | Valve | Control Line | Logic | Fluid Flow |
|---|---|---|---|---|---|---|
| 27a | 1 | Ready | Closed | Open | Static Closed | No |
| 27b | 2 | Fills | Closed | Closed | Static Closed | Yes |
| 27c | 3 | Fills to Limit | Closed | Closed | Static Closed | Yes |
| 27d | 4 | Flip Open | Open | Closed | Flip open | Slows |
| 27d | 5 | Rapid Discharge | Open | Closed | Stay open | Slows |
| 27e | 6 | Discharge Limit tripped | Close | Closed | close | Begins |
| 27b | 7 | fills | Closes | Closed | Static Closed | Yes |
| 27c | 3 | fills to limit | Closed | Closed | Static Closed | yes |
| 27a | 1 | Ready | Closed | Open | Static Closed | no |

Figure 23:
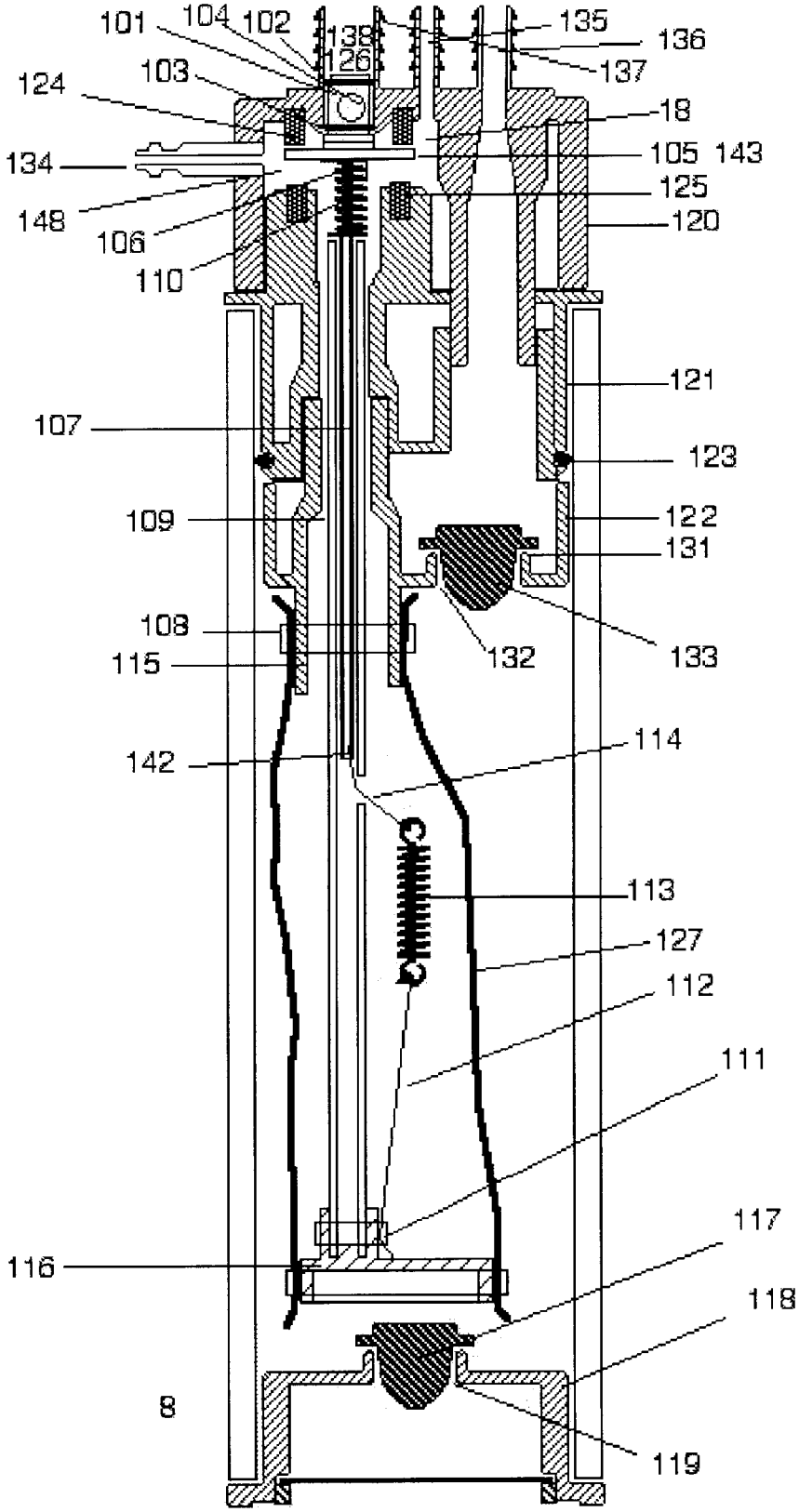
FIG. 23 is a perspective view of the interior parts of a pump in accordance with an embodiment of the present invention.
Figure 24A:
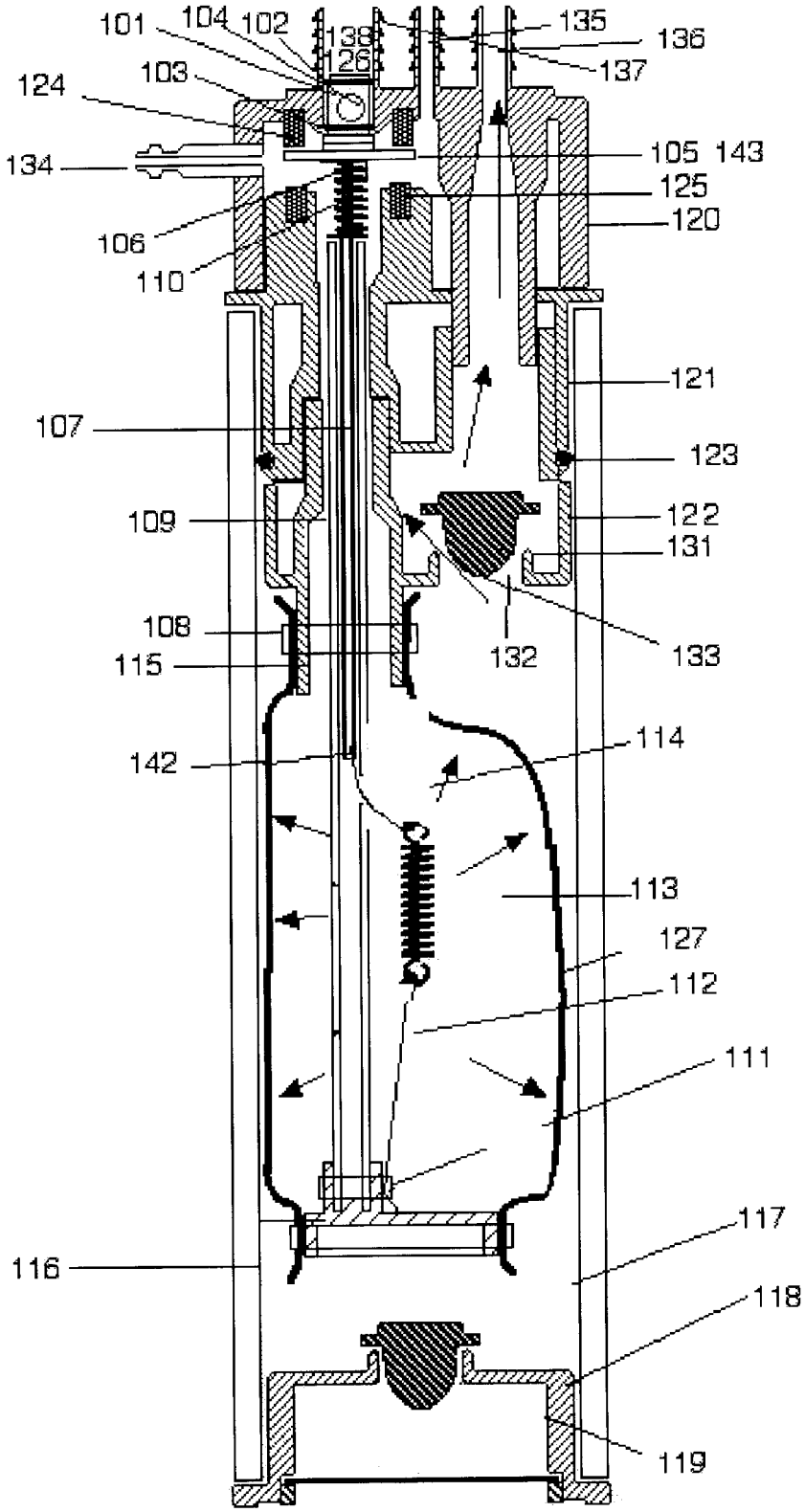
FIGS. 24*a* and 24*b* are partial cross-sectional views of the interior of the pump depicted in FIG. 23, illustrating the pump in action.
Figure 24B:
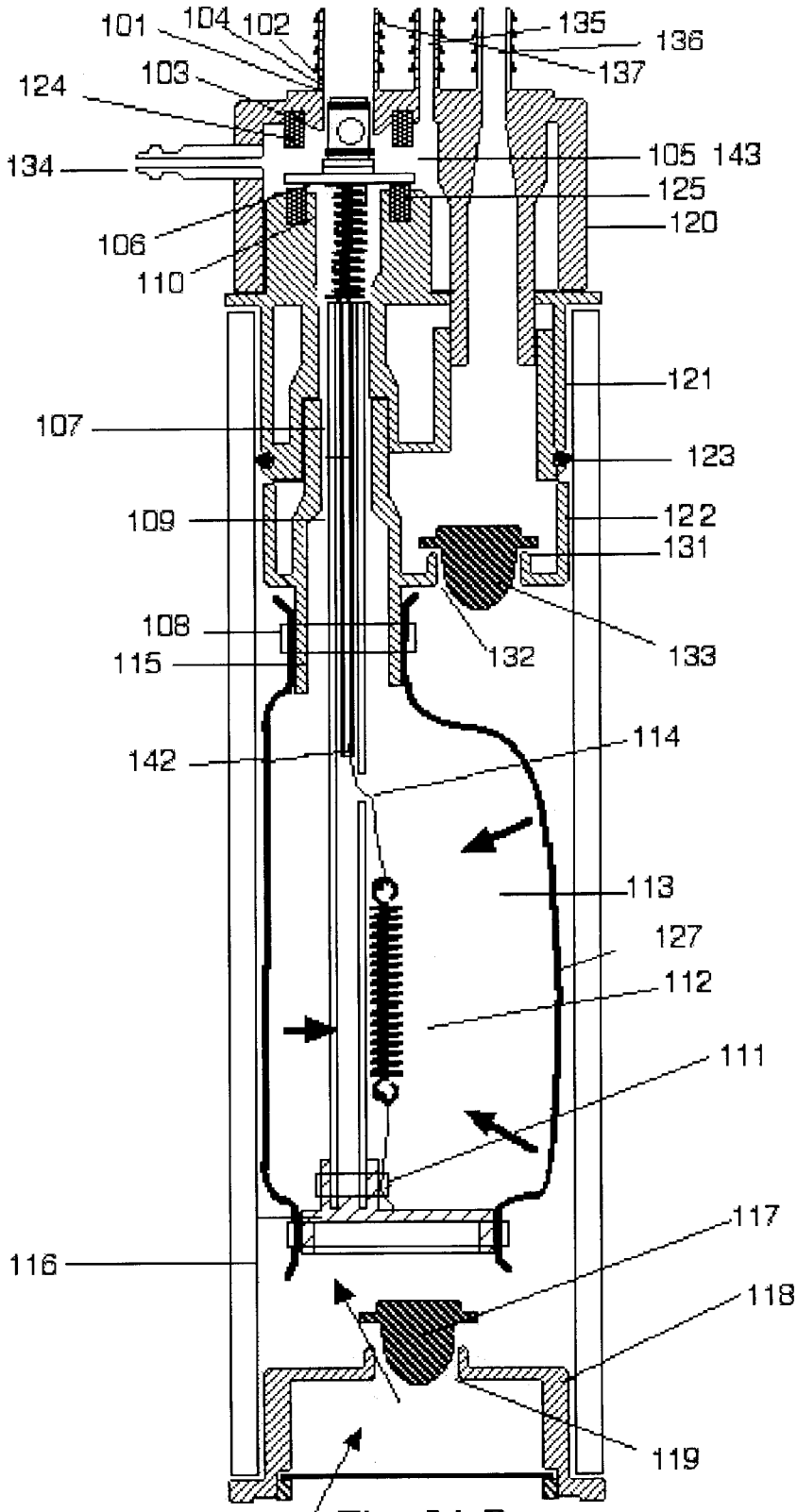
Figure 25:
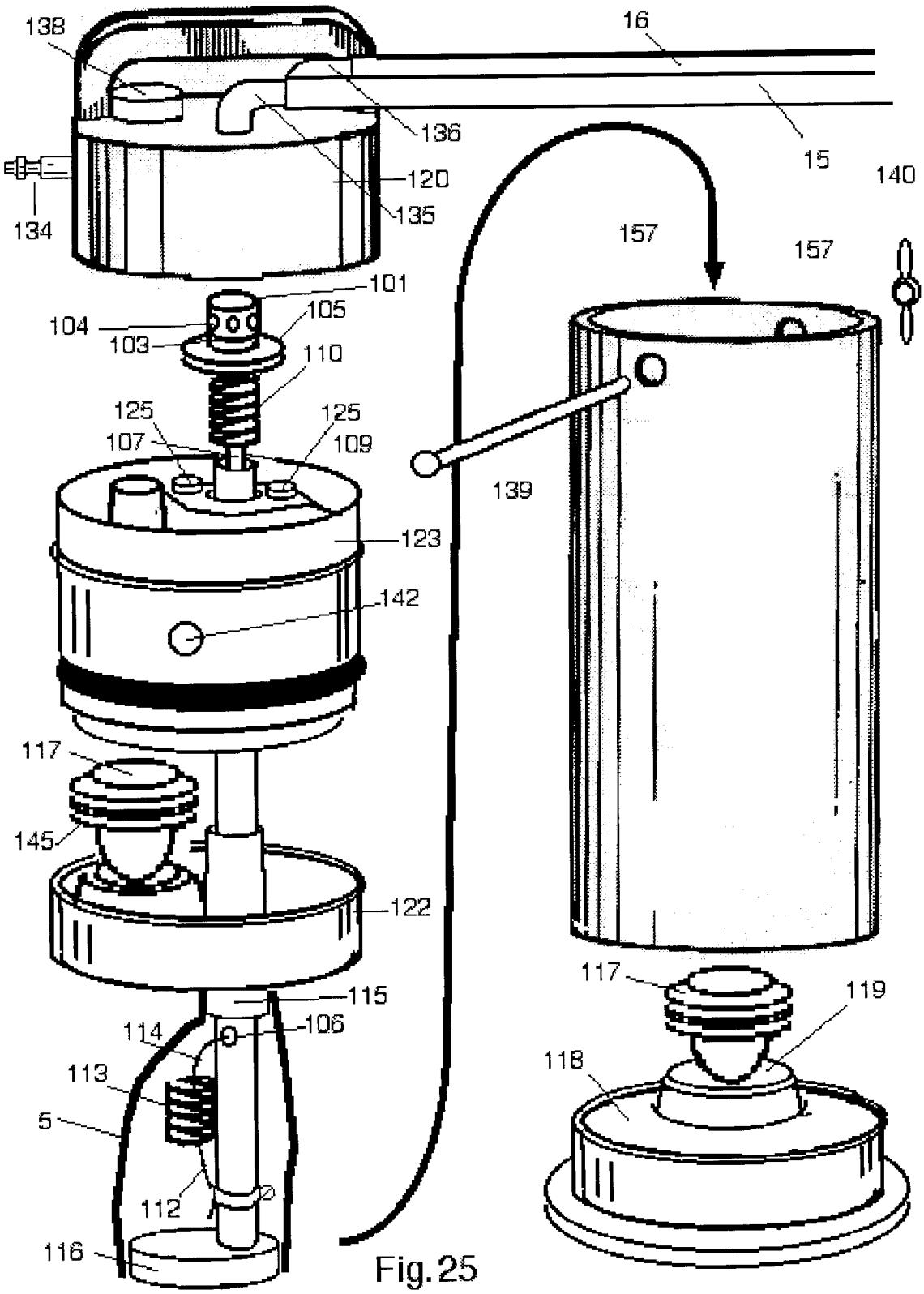
FIG. 25 is a perspective exploded view of a bladder pump with pneumatic pressure relief valve in accordance with the pump depicted in FIGS. 23 and 24.
Figure 26A:
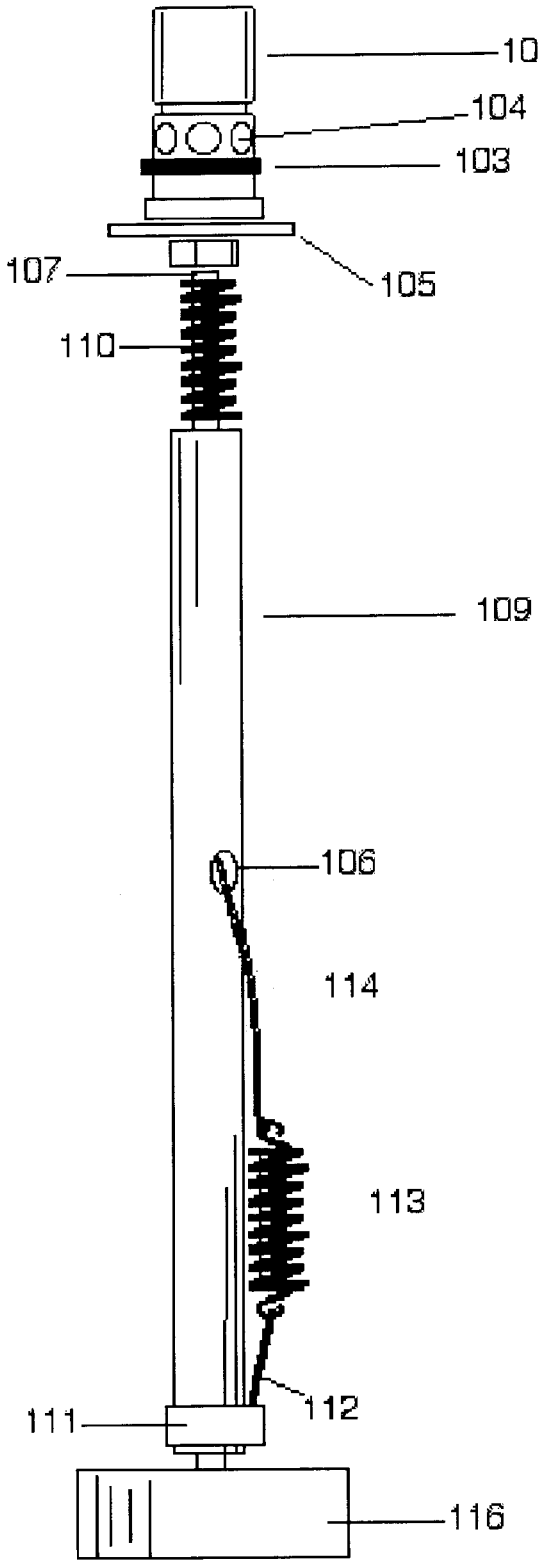
FIG. 26*a* is a perspective view of the interior valve core assembly parts of a pump in accordance with an embodiment of the present invention.
Figure 26B:
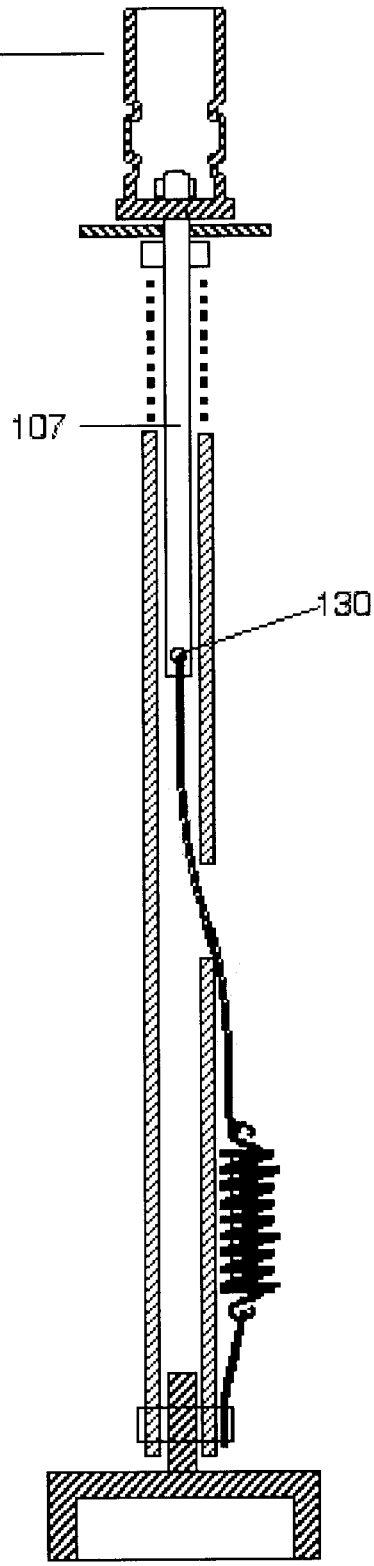
FIG. 26*b* is a partial cross-sectional view of the parts of this same embodiment.

One complete pneumatic cycle of the pump in this preferred embodiment depicted in FIGS. 23 and 24 may begin with the introduction of compressed air to the pump head through the air intake 134. The introduction of compressed air is continuous whenever the pump is in use or in the ready mode. The pressure within the system may be regulated by a user of the system remotely at the distal end of the control line selectively discharging air through a tool attachment or holding air at the tool attachment, as discussed above. Irrespective of the mechanism that initiates a higher pressure in the pump head and the bladder 5, the bladder 5 preferably expands both radially and axially. Axial bladder expansion most preferably causes the lower bladder part 116 to migrate away from the upper bladder attachment to pump head part 115. Correspondingly, the leader attachment 111 may pull on the spring attachment cable 112, stretching the opening spring 113 and pulling on the steel leader 114. The steel leader may pull on the valve core 101, forcing the pneumatic pressure relief valve to abruptly pop open into the fully open position, once the requisite force level is met to overcome the additional friction provided by the mating of circumferential ring 143 and upper groove 129. Air is then preferably released from the interior of the bladder 127 to the local atmosphere, through the valve stem 130, the at least one orifice 104 and hollow center of the valve core 101, through the valve tube 107. Release of air preferably causes the bladder 127 to return to its initial shape, the bladder 127 preferably being sufficiently elastic so as to have a memory of this initial shape and a mechanical propensity to return thereto.

Thus, the lower bladder part 116 preferably migrates axially toward the upper bladder attachment to the pump head 115 upon deflation. Correspondingly, the shelf member 143 of closing rod 107 may press on the closing spring 110, which may press on the valve core 101, and force the pneumatic pressure relief valve into the fully closed position once a sufficient amount of air has been evacuated from the bladder assembly 5, and the requisite force level is met to overcome the additional friction provided by the mating of circumferential ring 143 and lower groove 1. The next cycle may then begin, with compressed air being introduced into the pump.

Figure 27:
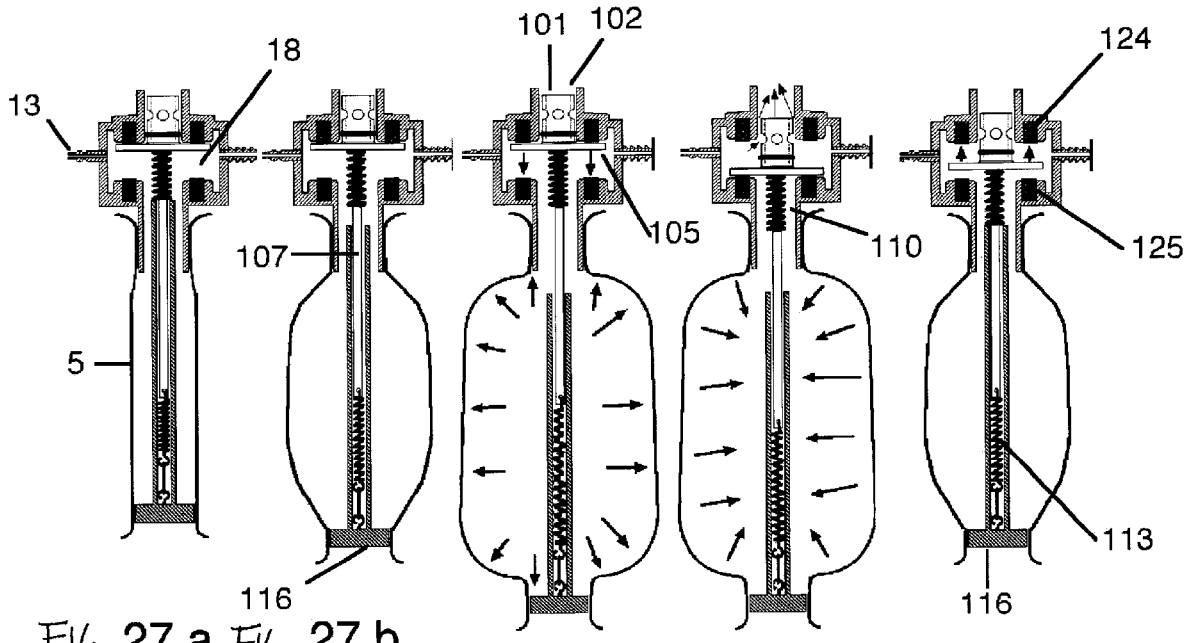
FIG. 27*a* is the pump at rest, 27*b* is the pump with bladder filling.
FIG. 27*c* is at valve opening.
FIG. 27*d* is at bladder discharge.
FIG. 27*e* is at valve closing.

In an alternative embodiment of the present invention, as depicted in FIGS. 26–28, the pneumatic pressure relief valve may be included at a point at or near the top of the housing. In this most preferred embodiment of the present invention, the pneumatic pressure relief valve operates in substantially the same fashion as described above. Further included in this embodiment may be an opening cable 114, connected via an hole in the closing rod 106, at its lower end to the lower bladder part 116, and at its upper end to the valve rod 107 through an attachment hole. Most preferably, a shelf member 143 is attached to the top of the valve rod at the bottom of the valve core 101. The valve rod may pass through the interior of the closing spring 110. Cable may further pass through a small hole bored through the lower end of the valve rod 107 core to affix the opening cable members thereto. The valve rod preferably resides at least partially within closing rod 107, such that the two rods may move independent of one another while staying aligned. Most preferably, a closing rod hole is bored through the end of closing rod 107, such that steel leader 114 may pass there through, preferably being operable connected to valve rod at one end and to opening spring 113 at the other end.

One complete pneumatic cycle of the pump in this most preferred-embodiment depicted in FIGS. 26–27 may begin with the introduction of compressed air to the pump through the air intake 134, as above. The bladder 5 preferably expands both radially and axially upon introduction of air. Axial bladder expansion most preferably causes the lower bladder part 116 to migrate away from the upper bladder attachment to the pump head. Correspondingly, the leader attachment 111 may pull on the spring attachment cable 112, stretching the opening spring 113 and pulling on the steel leader 114. The steel leader may pull on the valve rod, which may pull on valve core 101, forcing the pneumatic pressure relief valve into the fully open position, once the requisite force level is met to overcome the additional friction provided by the mating of circumferential ring 143 and upper groove 141. Air is then preferably released from the interior of the bladder 5 to the local atmosphere, through the closing rod, the cap manifold 120, the at least one orifice 104 and hollow center of the valve core 101. Release of air preferably causes the bladder 5 to return to its initial shape, the bladder 5 preferably being sufficiently elastic so as to have a memory of this initial shape and a mechanical propensity to return thereto.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. A drywall taping and texture system for pumping fluid mastic material from a container to a work surface, the system comprising:

a pump housing defining a hollow shell, said housing being immersed in the container filled with the material;

a compressed air supply connected to a pump head of said pump housing;

a tool for applying the material to the work surface;

a material line connected between the pump head and the tool such that there is material flow communication therebetween;

a control line inter-connected between the pump head and the tool such that there is air flow communication therebetween;

an inflatable bladder mounted to a pump head manifold, said manifold being configured to be selectively inserted as a cartridge unit within the hollow shell of the pump housing and said inflatable bladder being held between an upper and a lower valve for controlling the flow of the fluid mastic material;

a two stage air release mechanism controlling a normally closed pneumatic valve sensitive and reactive to maximum pressure disposed within the pump head and also sensitive and reactive to a low pressure condition; and an airway connecting the compressed air supply, the pump head, the control line, the tool, the bladder, and the air release mechanism, such that there is air flow communication therebetween, wherein when the pneumatic valve closes and the control line is sealed by an operator, the bladder inflates and expands radially and vertically relative to the housing such that the material in the pump housing is pumped through displacement through the upper valve, the material line, and the tool to the work surface, and when the inflating bladder encounters the pump housing walls air pressure increases rapidly until the pneumatic valve pops opens, the bladder suddenly deflates and retracts radially and vertically relative to the housing such that a partial vacuum is produced within the housing sufficient to draw more of the material from the container up through the lower valve into the pump housing.

2. The drywall taping and texture system of claim 1, wherein said manifold includes a valve cavity, said air release mechanism comprising:

a valve body providing air flow communication between the airway and the atmosphere surrounding the housing;

a trapped hollow valve core slidably disposed within the valve cavity of the manifold;

a magnetically attractive washer mounted to the base of the hollow valve core, wherein said washer is trapped in a gap between a set of strong magnets disposed above the washer and a set of strong magnets disposed below the washer;

at least one orifice on a side of the valve core, connecting the hollow interior of the valve core to the exterior of the valve core, the at least one orifice residing at least partially above a top of the valve core when the pneumatic valve is held open by one set of magnets, and the at least one orifice residing below the top of the valve core when the pneumatic valve is closed;

at least one orifice at or near a bottom of the valve core, connecting the hollow interior of the valve core to the airway;

a closing rod coupled at its bottom end to said bladder;

a first spring disposed between the washer and the top end of said closing rod;

an opening cable; and a second spring disposed between the opening cable and the bladder, such that the springs alternatively store kinetic energy captured from mechanical force exerted due to size changes in the bladder, said kinetic energy being collected by one of the springs to be released suddenly when the magnetically attractive valve washer breaks free from one set of said magnets and flips quickly to the other set of said magnets propelled by said stored kinetic energy thereby crisply flipping the valve open and then crisply flipping it closed in perfect synchronization to the bladder state.

3. The drywall taping and texture system of claim 2, wherein the pneumatic valve has two stages, whereby said valve flips open when the bladder inflates to a maximum air pressure level and remains open until the bladder deflates to a minimum air pressure level which causes the valve to flip closed.

4. The drywall taping and texture system of claim 1 further comprising a snorkel hose providing air flow communication between the pneumatic valve and a local atmosphere for use when the pump is fully submerged in the fluid material.

5. The drywall taping and texture system of claim 1, wherein said tool includes a wheel air release mechanism comprising:

a hollow axle having a radial axle air hole; and a wheel around the axle and having a radial wheel air hole;

wherein as the wheel is rolled over the work surface, the wheel rotates around the axle, and the wheel air release mechanism opens when the radial wheel air hole in the wheel is aligned with the radial axle air hole in the axle, and the wheel air release mechanism closes when the radial wheel air hole in the wheel is not aligned with the radial axle air hole in the axle.

6. The drywall taping and texture system of claim 1, said tool comprising an operator controlled button or trigger type air hold or release mechanism, communicating with the control line and the pump head, wherein the tool's air release mechanism closes when the trigger is pulled by an operator which plugs the control line at the atmosphere, the tool's air release mechanism opens when the trigger is released, and said air release mechanism is returned to a normally open condition, venting compressed air into the atmosphere.

7. The drywall taping and texture system of claim 1, where in the bladder pump includes a pneumatic valve to control inflation and deflation of the bladder, where a control system element is attached at a point on the bladder, such that stored energy from the force of the movement of the inflating or deflating bladder wall is used to correctly change the valve setting to respond to the bladder state.

8. The drywall taping and texture system of claim 1, wherein the upper and lower valves for controlling the flow of the fluid material are check valves creating a one-way flow of the material upward through the pump housing, through the pump head through the material line, and through the tool to be exuded upon said work surface.

9. The drywall taping and texture system of claim 1, wherein each of the upper and lower valves for controlling the flow of the fluid material comprises:

a seat having an orifice through which the material flows; and a member for controlling the flow of the material through the orifice, wherein the member mates with the seat such that a seal is formed to block the flow of the material through the orifice, and the member moves in a direction transverse to the seat to allow the flow of the material through the orifice.

10. The drywall taping and texture system of claim 8, wherein at least one of the upper and lower valves includes a beveled ridge about the circumference of the orifice to facilitate the proper mating of the member with the seat thereof.

11. The drywall taping and texture system of claim 1, wherein the housing further includes a fluid materials inlet port and a screen placed over the inlet port for filtering large particles out of the mixed material to prevent jamming of the lower and upper valves.

12. The drywall taping and texture system of claim 1, wherein the pneumatic valve comprises:

a valve chamber providing gaseous communication between the bladder and an exterior of the system; and a valve member slidably disposed within the valve chamber, the valve member alternating between an open and a closed position.

13. The drywall taping and texture system of claim 12, wherein the pneumatic valve further includes:

a rigid closing rod attached to, and at least partially contained within the bladder;

a closing spring disposed between the closing rod and the valve member;

a spring attachment cable attached to the closing rod and bladder;

an opening spring attached at one end to the spring attachment cable; and a leader attached at a first end to the opening spring and at a second end to the valve member, wherein when the bladder deflates to a minimum inflation level, the pneumatic valve flips closed, and when the bladder expands to a maximum inflation level, the pneumatic valve flips open.

14. The drywall taping and texture system of claim 13, wherein the opening spring is attached at the second end to the closing rod, and the closing rod is attached to the valve member by an opening member.

15. The drywall taping and texture system of claim 14, further including a valve core shaft slidably disposed within the hollow closing rod, wherein the spring attachment cable passes through a hole in the closing rod.

16. The drywall taping and texture system of claim 12, wherein the pneumatic valve further comprises:

a flexible clip including an upper groove and a lower groove; and a circumferential ring disposed about the valve member, wherein the circumferential ring interlocks with the upper groove when the pneumatic valve is closed, and the circumferential ring interlocks with the lower groove when the pneumatic valve is open.

17. A drywall taping and texture system for pumping material from a container filled with the material to a work surface, the system comprising:

a pump housing immersed in the container filled with the material;

a tool for applying the material to the work surface;

a material line connected between the pump housing and the tool such that there is material flow communication therebetween;

a control line connected between the pump housing and the tool such that there is air flow and electrical communication therebetween;

an inflatable bladder mounted within the pump housing between upper and lower valves for controlling the flow of the material;

a normally-closed pneumatic solenoid valve;

an electronic inflation sensor system comprising:

a first magnetic sensor element coupled to the center of the bladder for determining when the bladder is deflated;

a second magnetic sensor element mounted on the cylinder wall to determine when the bladder is fully inflated;

a magnet element attached to the bladder wall for determining when the bladder is inflated and when the bladder is deflated; and a latching electrical relay electronically connected to said valve, magnetic sensors, and magnetic element, an air compressor mounted within the pump housing and connected to the control line and the bladder such that there is flow communication therebetween, wherein when the first magnetic sensor determines that the bladder is fully deflated, the pneumatic solenoid valve is closed and if the control line is also closed, the bladder inflates such that the material in the pump housing is pumped through the upper valve, the material line, and the tool to the work surface, and when the second magnetic sensor determines that the bladder has fully inflated, the solenoid valve is opened and the bladder deflates such that fluid material in the container flows through the lower valve into the pump housing.

18. A drywall taping and texture system for pumping fluid material from a container filled with the material to a work surface, the system comprising:

a pump housing immersed in the container filled with the material;

an air compressor connected to the pump housing;

a tool for applying the material to the work surface;

a material line connected between the pump housing and the tool such that there is material flow communication therebetween;

a control line connected between the pump housing and the tool such that there is airflow communication therebetween;

an inflatable bladder mounted within the pump housing between upper and lower one way valves for controlling the flow of the material;

a wheel air release mechanism connected to the tool and the control line comprising:

a hollow axle having a radial axle air hole; and a wheel around the axle and having a radial wheel air hole, wherein as the wheel is rolled over the work surface, the wheel rotates around the axle, and the wheel air release mechanism opens when the radial wheel air hole in the wheel is aligned with the radial axle air hole in the axle, and the wheel air release mechanism closes when the radial wheel air hole in the wheel is not aligned with the radial axle air hole in the axle; and an airway connecting the air compressor, the control line, the wheel air release mechanism, and the bladder, such that there is airflow communication therebetween;

wherein when the wheel air release mechanism closes, the bladder inflates and expands radially and vertically relative to the housing such that the material in the pump housing is pumped through the upper valve, the material line, and the tool to the work surface, and when the wheel air release mechanism opens, the bladder deflates and retracts radially and vertically relative to the housing such that the material in the container is pumped through the lower valve into the pump housing.

19. A drywall taping and texture system for pumping material from a container filled with the material to a work surface, the system comprising:

a pump housing immersed in the container filled with the material;

an air supply connected to the pump housing;

a set of interchangeable tools for applying the material to the work surface;

a material line connected between the pump housing and the tool such that there is material flow communication therebetween;

a control line connected between the pump housing and the tool such that there is airflow communication therebetween;

an inflatable rubber like bladder mounted within the pump housing between upper and lower valves for controlling the flow of the fluid material;

a pneumatic air pressure relief valve configured to be in communication with the atmosphere and the interior of the pump head, said pressure relief valve comprising:

a valve chamber providing gaseous communication between the bladder and an exterior of the system;

a valve member slidably disposed within the valve chamber, the valve member alternating crisply back and forth between open and closed positions;

a closing rod at least partially contained within the bladder and attached to the bladder wall;

a closing spring disposed between the closing rod and the valve member;

a spring attachment cable attached to the bladder;

an opening spring attached to the spring attachment cable; and a leader attached at a first end to the opening spring and a second end to the valve member, wherein, when the bladder deflates to a minimum inflation level, the pneumatic pressure relief valve automatically flips closed, and when the bladder expands to a maximum inflation level, the pneumatic pressure relief valve automatically flips open, at least one manifold attached to the housing, the pressure relief valve residing at least partially within the at least one manifold; and an airway connecting the air supply, the control line, the bladder, and the pressure relief valve, such that there is airflow communication therebetween, wherein when the pressure relief valve is normally closed, when the control line is closed by the operator manipulating one of said tools, the bladder inflates and expands radially and vertically relative to the housing such that the material in the pump housing is pumped through the upper valve, the material line, and the tool to the work surface, and when the pressure relief valve opens, the bladder deflates and retracts radially and vertically relative to the housing such that the material in the container is pumped up through the lower valve into the pump housing.

20. The drywall taping and texture system of claim 19, wherein a cable is attached, at a first end, to a distal point on the bladder and, at a second end, to the lower end of the opening spring.

21. The drywall taping and texture system of claim 19, wherein a valve core member is slidably disposed within the closing rod member and a linear slot in one member allows the alternative member to slide freely for only the length of the slot to meet a stop limit pin in the other member.

22. A drywall taping and texture system for pumping material from a container filled with the material to a work surface, the system comprising:

a pump housing immersed in the container filled with the material;

an air supply connected to the pump housing;

a set of interchangeable tools for applying the material to the work surface;

a material line connected between the pump housing and the tool such that there is material flow communication therebetween;

a control line connected between the pump housing and the tool such that there is airflow communication therebetween;

an inflatable rubber like bladder mounted within the pump housing between upper and lower valves for controlling the flow of the fluid material;

a pneumatic air pressure relief valve configured to be in communication with the atmosphere and the interior of the pump head, said pressure relief valve comprising:

a flexible or spring loaded clip with an upper groove and a lower groove; and a matching circumferential ring disposed about the valve member, wherein the circumferential ring interlocks with the upper groove when the pneumatic pressure relief valve is closed, and the circumferential ring interlocks with the lower groove when the pneumatic pressure relief valve is open with said clip shaped to favor either a fully open or fully closed position;

at least one manifold attached to the housing, the pressure relief valve residing at least partially within the at least one manifold; and an airway connecting the air compressor, the control line, the bladder, and the pressure relief valve, such that there is airflow communication therebetween, wherein when the pressure relief valve is normally closed, when the control line is closed by the operator manipulating a tool, the bladder inflates and expands radially and vertically relative to the housing such that the material in the pump housing is pumped through the upper valve, the material line, and a tool to surge upon the work surface, and when the pressure relief valve opens, the bladder deflates and retracts radially and vertically relative to the housing such that the material in the container is pumped up through the lower valve into the pump housing.

23. A drywall taping and texture system for pumping material from a container filled with the material to a work surface, the system comprising:

a pump housing immersed in the container filled with the material;

an air supply connected to the pump housing;

a set of interchangeable tools for applying the material to the work surface;

a material line connected between the pump housing and the tool such that there is material flow communication therebetween;

a control line connected between the pump housing and the tool such that there is airflow communication therebetween;

an inflatable rubber like bladder mounted within the pump housing between upper and lower valves for controlling the flow of the fluid material;

an air pressure relief valve configured to be in communication with the atmosphere and the interior of the pump head;

at least one manifold attached to the housing, the pressure relief valve residing at least partially within the at least one manifold;

an airway connecting the air supply, the control line, the bladder, and the pressure relief valve, such that there is airflow communication therebetween; and three manifolds configured to be permanently attached to one another to form a complete factory sealed pump head cartridge unit, including a least one material valve and the bladder assembly, wherein, when the pressure relief valve is normally closed, when the control line is closed by the operator manipulating one of said tools, the bladder inflates and expands radially and vertically relative to the housing such that the material in the pump housing is pumped through the upper valve, the material line, and the tool to the work surface, and when the pressure relief valve opens, the bladder deflates and retracts radially and vertically relative to the housing such that the material in the container is pumped up through the lower valve into the pump housing.

24. A drywall taping and texture system for pumping material from a container filled with the material to a work surface, the system comprising:

a pump housing immersed in the container filled with the material;

an air supply connected to the pump housing;

a set of interchangeable tools for applying the material to the work surface;

a material line connected between the pump housing and the tool such that there is material flow communication therebetween;

a control line connected between the pump housing and the tool such that there is airflow communication therebetween;

an inflatable rubber like bladder mounted within the pump housing between upper and lower valves for controlling the flow of the fluid material;

an air pressure relief valve configured to be in communication with the atmosphere and the interior of the pump head;

at least one manifold attached to the housing, the pressure relief valve residing at least partially within the at least one manifold; and an airway connecting the air supply, the control line, the bladder, and the pressure relief valve, such that there is airflow communication therebetween, wherein, at least one of the upper and lower valves includes a beveled ridge about its circumference to facilitate the proper sealing of the valve with a flat surface of a plug member, said flat surface being selectively covered with a layer of resilient material so as to ensure complete valve closure even when the fluid material has particulate matter in suspension, and wherein, when the pressure relief valve is normally closed, when the control line is closed by the operator manipulating one of said tools, the bladder inflates and expands radially and vertically relative to the housing such that the material in the pump housing is pumped through the upper valve, the material line, and the tool to the work surface, and when the pressure relief valve opens, the bladder deflates and retracts radially and vertically relative to the housing such that the material in the container is pumped up through the lower valve into the pump housing.

25. A drywall taping and texture system for pumping material from a container filled with the material to a work surface, the system comprising:

a pump housing immersed in the container filled with the material;

an air supply connected to the pump housing;

a set of interchangeable tools for applying the material to the work surface;

a material line connected between the pump housing and the tool such that there is material flow communication therebetween;

a control line connected between the pump housing and the tool such that there is airflow communication therebetween;

an inflatable rubber like bladder mounted within the pump housing between upper and lower valves for controlling the flow of the fluid material;

an air pressure relief valve configured to be in communication with the atmosphere and the interior of the pump head;

at least one manifold attached to the housing, the pressure relief valve residing at least partially within the at least one manifold;

an airway connecting the air supply, the control line, the bladder, and the pressure relief valve, such that there is airflow communication therebetween; and a snorkel hose providing air flow communication between the pressure relief valve and a local atmosphere for use when the pump is fully submerged in the material, wherein, when the pressure relief valve is normally closed, when the control line is closed by the operator manipulating one of said tools, the bladder inflates and expands radially and vertically relative to the housing such that the material in the pump housing is pumped through the upper valve, the material line, and the tool to the work surface, and when the pressure relief valve opens, the bladder deflates and retracts radially and vertically relative to the housing such that the material in the container is pumped up through the lower valve into the pump housing.

26. A drywall taping and texture system for pumping material from a container filled with the material to a work surface, the system comprising:

a pump housing immersed in the container filled with the material;

an air supply connected to the pump housing;

a set of interchangeable tools for applying the material to the work surface;

a material line connected between the pump housing and the tool such that there is material flow communication therebetween;

a control line connected between the pump housing and the tool such that there is airflow communication therebetween;

an inflatable rubber like bladder mounted within the pump housing between upper and lower valves for controlling the flow of the fluid material;

an air pressure relief valve configured to be in communication with the atmosphere and the interior of the pump head, said valve including a valve core;

at least one manifold attached to the housing, the pressure relief valve residing at least partially within the at least one manifold; and an airway connecting the air supply, the control line, the bladder, and the pressure relief valve, such that there is airflow communication therebetween, wherein, a pneumatic flip flop valve function is provided by way of a magnetically attractive member attached to the valve core which is closely trapped between two sets of strong magnets such that the lower set of magnets holds the valve open and the upper set of magnets holds the valve closed, and wherein, when the pressure relief valve is normally closed, when the control line is closed by the operator manipulating one of said tools, the bladder inflates and expands radially and vertically relative to the housing such that the material in the pump housing is pumped through the upper valve, the material line, and the tool to the work surface, and when the pressure relief valve opens, the bladder deflates and retracts radially and vertically relative to the housing such that the material in the container is pumped up through the lower valve into the pump housing.

* * * * *